US007511708B2

(12) United States Patent
Numao

(10) Patent No.: US 7,511,708 B2
(45) Date of Patent: Mar. 31, 2009

(54) DISPLAY DEVICE AND DRIVING METHOD THEREOF

(75) Inventor: Takaji Numao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 627 days.

(21) Appl. No.: 11/196,427

(22) Filed: Aug. 4, 2005

(65) Prior Publication Data

US 2006/0028409 A1 Feb. 9, 2006

(30) Foreign Application Priority Data

Aug. 5, 2004 (JP) ..... 2004-229854

(51) Int. Cl.
*G09G 5/00* (2006.01)

(52) U.S. Cl. ..... 345/204; 345/205; 345/209; 345/211; 345/210

(58) Field of Classification Search ..... 345/76–89, 345/204–213, 90–92, 95–98, 100, 45–51, 345/30, 33, 55, 154; 257/428, 72; 315/169.1, 315/169.3; 361/152; 327/108, 112
See application file for complete search history.

(56) References Cited

U.S. PATENT DOCUMENTS 6,169,532 B1 * 1/2001 Sumi et al. ..... 345/98
6,229,506 B1 5/2001 Dawson et al.
6,441,560 B1 * 8/2002 Hunter ..... 315/169.1
6,633,287 B1 * 10/2003 Yatabe et al. ..... 345/211
6,693,610 B2 * 2/2004 Shannon et al. ..... 345/76
6,853,370 B2 * 2/2005 Numao ..... 345/204
6,937,222 B2 * 8/2005 Numao ..... 345/98
7,009,590 B2 * 3/2006 Numao ..... 345/76
7,042,447 B2 * 5/2006 Numao ..... 345/205
7,057,587 B2 * 6/2006 Numao ..... 345/76
7,071,932 B2 * 7/2006 Libsch et al. ..... 345/211
7,116,301 B2 * 10/2006 Numao ..... 345/89
7,205,966 B2 * 4/2007 Numao ..... 345/76
7,256,774 B1 * 8/2007 Senda et al. ..... 345/204
7,271,599 B2 * 9/2007 Endoh ..... 324/705

(Continued)

FOREIGN PATENT DOCUMENTS

JP 2002-514320 A 5/2002

(Continued)

OTHER PUBLICATIONS

"A Self-compensated Voltage Programming Pixel Structure for Active-Matrix Organic Light Emitting Diodes" (S.M. Choi et al., IDW'03, pp. 535-538).

*Primary Examiner*—Prabodh Dharia
(74) *Attorney, Agent, or Firm*—Harness, Dickey & Pierce, P.L.C.

(57) ABSTRACT

A display device in accordance with the present invention changes to Vc the voltage of a terminal of a capacitor C2 the other terminal of which is connected to the gate of a driver TFT Q1. Thus, a desired voltage Vda is fed from a source line Sj to the drain of the driver TFT Q1 so as to adjust the threshold voltage Vth of the driver TFT Q1. The device then changes the voltage of the terminal of the capacitor C2 to Va to render the gate voltage of the driver TFT Q1 Vda-Vth-Vc+Va. A power supply voltage Vp is fed from the source of the driver TFT Q1.

7 Claims, 40 Drawing Sheets

U.S. PATENT DOCUMENTS

| | | | | |
|---|---|---|---|---|
| 7,336,247 | B2 * | 2/2008 | Akimoto et al. | 345/82 |
| 7,446,338 | B2 * | 11/2008 | Shirasaki et al. | 257/72 |
| 2002/0175887 | A1 * | 11/2002 | Yamazaki | 345/87 |
| 2003/0107560 | A1 * | 6/2003 | Yumoto et al. | 345/204 |
| 2003/0122747 | A1 * | 7/2003 | Shannon et al. | 345/76 |
| 2003/0122805 | A1 * | 7/2003 | So | 345/204 |
| 2003/0169247 | A1 * | 9/2003 | Kawabe et al. | 345/204 |
| 2004/0095168 | A1 | 5/2004 | Miyazawa | |
| 2004/0095338 | A1 | 5/2004 | Miyazawa | |
| 2004/0140515 | A1 * | 7/2004 | Yasukawa | 257/428 |
| 2004/0196239 | A1 | 10/2004 | Kwon | |
| 2004/0239696 | A1 * | 12/2004 | Okabe et al. | 345/690 |
| 2004/0263506 | A1 * | 12/2004 | Koyama et al. | 345/204 |
| 2005/0007357 | A1 * | 1/2005 | Yamashita et al. | 345/204 |
| 2005/0007361 | A1 * | 1/2005 | Fujikura et al. | 345/204 |
| 2005/0030304 | A1 * | 2/2005 | Inukai | 345/204 |
| 2005/0078104 | A1 * | 4/2005 | Matthies et al. | 345/204 |
| 2005/0180083 | A1 * | 8/2005 | Takahara et al. | 361/152 |
| 2005/0206590 | A1 | 9/2005 | Sasaki et al. | |
| 2005/0206593 | A1 | 9/2005 | Kwon | |
| 2005/0218946 | A1 | 10/2005 | Miyazawa | |
| 2005/0265071 | A1 | 12/2005 | Kwon | |
| 2005/0285822 | A1 * | 12/2005 | Reddy et al. | 345/76 |
| 2006/0044244 | A1 * | 3/2006 | Numao | 345/92 |
| 2006/0245121 | A1 | 11/2006 | Numao | |
| 2006/0261864 | A1 | 11/2006 | Miyazawa | |
| 2006/0290617 | A1 | 12/2006 | Miyazawa | |
| 2008/0136795 | A1 * | 6/2008 | Numao et al. | 345/204 |

FOREIGN PATENT DOCUMENTS

| | | |
|---|---|---|
| JP | 2003-271095 | 9/2003 |
| JP | 2003-288055 | 10/2003 |
| JP | 2004-145278 | 5/2004 |
| JP | 2004-145301 | 5/2004 |
| JP | 2004-310006 | 11/2004 |
| JP | 2005-62794 | 3/2005 |
| JP | 2005-134838 | 5/2005 |
| WO | WO 98/48403 | 10/1998 |

* cited by examiner

DISPLAY DEVICE AND DRIVING METHOD THEREOF

This Nonprovisional application claims priority under 35 U.S.C. § 119(a) on Patent Application No. 2004-229854 filed in Japan on Aug. 5, 2004, the entire contents of which are hereby incorporated by reference.

FIELD OF THE INVENTION

The present invention relates to display devices and driving methods for OLED (organic light-emitting diode) displays, FEDs (field emission displays), and other current-driven devices.

BACKGROUND OF THE INVENTION

Recent years have seen many research and development activities to manufacture OLED displays, FEDs, and other current-driven light-emitting devices. Especially, the OLED display is the focus of attention in view of possible applications in mobile phones, PDAs (personal digital assistants), and like mobile devices, to exploit its low voltage/low power consumption.

FIG. 39 shows the circuit structure of an OLED pixel disclosed in Published Japanese Translation of PCT Application 2002-514320 (Tokuhyo 2002-514320; published on Oct. 29, 1998).

A pixel circuit 300 in FIG. 39 includes four p-type TFTs (thin film transistors) 360, 365, 370, 375, two capacitors 350, 355, and an OLED 380. The TFTs 365, 375 and OLED 380 are connected in series between a power supply line 390 and a common cathode (GND line). The capacitor 350 and switching TFT 360 are connected in series between the gate of the driver TFT 365 and a data line 310. The switching TFT 370 is present between the gate and drain of the driver TFT 365. The capacitor 355 is present between the gate and source of the driver TFT 365. The gates of the TFTs 360, 370, 375 are connected respectively to a select line 320, an auto-zero line 330, and a lighting line 340.

In this pixel circuit 300, the auto-zero line 330 and the lighting line 340 go LOW in the first period. This turns on the switching TFTs 370, 375, placing the drain and gate of the driver TFT 365 at the same potential. The driver TFT 365 is therefore turned on, allowing a current flow from the driver TFT 365 to the OLED 380.

In this condition, the data line 310 is fed with reference voltage, and the select line 320 is set to LOW, which in turn keeps one of terminals of the capacitor 350 which connects to the TFT 360 at reference voltage.

In the second period, the lighting line 340 is set to HIGH, turning off the TFT 375.

The gate voltage of the driver TFT 365 then gradually increases. As the gate voltage reaches a value (+VDD+Vth) corresponding to the threshold voltage Vth of the driver TFT 365 (Vth<0), the driver TFT 365 is turned off.

In the third period, the auto-zero line 330 is set to HIGH, turning off the switching TFT 370. Thus, the capacitor 350 holds the difference between its gate voltage and the reference voltage.

In other words, the gate voltage of the driver TFT 365 is equal to a value (+VDD+Vth) corresponding to the threshold voltage (Vth) when the reference voltage is on the data line 310. If the voltage on the data line 310 changes from the reference voltage, a current in accordance with the change needs to flow through the driver TFT 365, regardless of the threshold voltage of the driver TFT 365.

To this end, the voltage on the data line 310 is changed by that desired amount. The select line is set to HIGH, turning off the switching TFT 360. The capacitor 355 maintains the gate voltage of the driver TFT 365. This ends a select period for the pixel.

The use of the pixel circuit in FIG. 39 in this manner enables the current output level of the driver TFT 365 to the OLED 380 to be specified regardless of the threshold voltage of the driver TFT 365.

FIG. 40 shows the circuit structure of another OLED pixel disclosed in IDW '03, pp. 535-538 (workshops held on Dec. 3, 2003).

A pixel circuit in FIG. 40 includes six p-type TFTs M1 to M6, a capacitor C1, and an OLED. The TFTs M5, M1, M6 and the OLED are connected in series between a power supply line VDD and a common cathode (GND line). The switching TFT M3 is present between the gate and drain of the driver TFT M1. The capacitor C1 is present between the gate of the driver TFT M1 and the power supply line VDD. The switching TFT M4 is present between the gate of the driver TFT M1 and an electric potential line VI. The switching TFT M2 is present between the source of the driver TFT M1 and a data line data[m].

The gates of the TFTs M5, M6 are connected to a control line em[n]. The gates of the TFTs M2, M3 are connected a gate line scan[n]. The gate of the TFT M4 is connected to a gate line scan[n−1].

In this pixel structure, the control line em[n] is set to HIGH in the first period, turning off the switching TFTs M5, M6. Further, the gate line scan[n−1] goes LOW, turning on the switching TFT M4. The gate line scan[n] is HIGH, keeping the switching TFTs M2, M3 turned off.

This makes the gate voltage of the driver TFT M1 equal to the voltage VI. This voltage VI can be specified to such a value that it turns on the driver TFT M1.

In the second period, the gate line scan[n−1] is set to HIGH, turning off the switching TFT M4. Further, the gate line scan[n] is set to LOW, turning on the switching TFTs M2, M3.

This short-circuits the source of the driver TFT M1 to the data line data[m], allowing a current flow from the data line data[m] to the gate of the driver TFT M1. The gate voltage of the driver TFT M1 is equal to Vda+Vth, or higher than the voltage, Vda, on the data line data[m] by a threshold voltage Vth (Vth<0).

In the following third period, the gate line scan[n] is set to HIGH, turning off the switching TFTs M2, M3. The control line em[n] is then set to LOW, turning on the switching TFTs M5, M6.

This renders the gate-to-source voltage of the driver TFT M1 Vda+Vth−VDD. When the gate-to-source voltage Vgs of the TFT M1 is less in absolute value than the drain-to-source voltage Vds, the current flow Ids through the TFT M1 is given by the following expression:

$$\begin{aligned} Ids &= k(Vgs - Vth)^2 \\ &= k((Vda + Vth - VDD) - Vth)^2 \\ &= k(Vda - VDD)^2 \end{aligned}$$

where k is a constant, and Vth is positive. The current flow through the driver TFT M1 is therefore determined by the power supply line VDD and the voltage, Vda, on the data line data[m], regardless of the threshold voltage Vth of the driver TFT M1.

The use of the pixel circuit in FIG. 40 in this manner also enables the current output level of the driver TFT M1 to be specified regardless of the threshold voltage of the driver TFT M1.

A desired current can be fed to the OLED by the use of the pixel circuit structure of FIG. 39 or FIG. 40 regardless of the threshold voltage of the driver TFT.

Inconveniences may however occur with these structures. In the pixel circuit structure in FIG. 39, each pixel includes four TFTs, two capacitors, and one OLED. For an amorphous silicon TFT, polysilicon TFT, or CG silicon TFT, the capacitors are each made up of either a silicon film and a gate electrode or a gate electrode and a source electrode. The capacitor's dielectric layer is made of a gate insulating film, which is an ordinary insulating film. The relative permittivity of the film is so low that the capacitor needs be large in area to provide necessary capacitance.

This capacitor size requirement in the pixel of the circuit structure in FIG. 39 places constraints on pixel size reduction. A required number of pixels may not be accommodated in a predetermined screen size. These problems can occur even with a top emission structure where emitted light is let out from the sealing film, opposite the TFT substrate.

The same description is applicable to the pixel circuit structure in FIG. 40. In the pixel circuit structure in FIG. 40, each pixel includes six TFTs, one capacitor, and one OLED.

The need for as many as six TFTs in the pixel places constraints on pixel size reduction. A required number of pixels may not be accommodated in a predetermined screen size. These problems can occur, again, even with a top emission structure.

SUMMARY OF THE INVENTION

The present invention, in view of the problems, has an objective to provide a display device and its driving method for better image quality. The invention achieves this by reducing element counts per pixel, hence pixel size (by even a small amount), to cram more pixels in a predetermined screen size.

A display device in accordance with the present invention, to achieve the objective, includes: source lines for feeding voltages Vda representing display data; first capacitors having first terminals whose voltages switch between at least three values regardless of voltages of other elements and second terminals connected to gates of driver transistors; electric potential lines connected to the first terminals of the first capacitors; electro-optical elements located near intersections of the source lines and the electric potential lines to form a matrix; the driver transistors, having a threshold voltage Vth, connected at sources and drains thereof to the electro-optical elements and power supply lines; the driver transistors and first switching transistors connected in series between the power supply lines and the electro-optical elements; second switching transistors connected between the gates and first current input/output terminals which are either the sources or the drains of the driver transistors; and third switching transistors connected between the source lines and second current input/output terminals which are either the drains or the sources of the driver transistors.

According to the structure, the gate voltage of the driver transistor is restored to a default state. Then, while feeding a desired voltage to the second current input/output terminal of the driver transistor, the voltage of the first terminal of the first capacitor is changed to enable the adjustment of the threshold voltage compensate of the driver transistor. In other words, the output current value of the driver transistor is controlled regardless of the threshold voltage of the driver transistor. By connecting either the first current input/output terminal or the second current input/output terminal of the driver transistor to the power supply line, the desired current is fed to the electro-optical element.

A method of driving a display device in accordance with the present invention is a method of driving the above display device, a short-circuit state being referred to as ON, a non-short-circuit state being referred to as OFF, ON/OFF between the driver transistors and the power supply lines by the first switching transistors, ON/OFF between the gates and the first current input/output terminals of the driver transistors by the second switching transistors, and ON/OFF between the source lines and the second current input/output terminals of the driver transistors by the third switching transistors being expressed in a sequential format, (ON/OFF, ON/OFF, ON/OFF), said method including the sequential steps of: in a first period, firstly switching the voltages of the first terminals of the first capacitors to a first predetermined value, achieving (ON, ON, OFF), and after gate voltages of the driver transistors having become equal to voltages on the power supply lines, achieving (OFF, ON, OFF); in a second period, achieving (OFF, ON, ON) to match voltages of the second current input/output terminals of the driver transistors with the voltages Vda on the source lines, switching the voltages of the first terminals of the first capacitors to a second predetermined value to render the driver transistors ON and rendering the gate voltages equal to Vda+Vth via the drains and the sources of the driver transistors to compensate for variations of the threshold voltage of the driver transistors, and when the driver transistors are rendered OFF as a result, achieving (OFF, OFF, OFF); and in a third period, rendering the voltages of the first terminals of the first capacitors equal to a third predetermined value which is between the first and second predetermined values, and achieving (ON, OFF, OFF) to feed the voltages on the power supply lines to the first current input/output terminals of the driver transistors in order to control based on magnitudes of Vda so that desired currents flow from the driver transistors to the electro-optical elements.

According to the structure, in the first period, firstly, the voltage of the first terminal of the first capacitor is switched to the first predetermined value (=Vb for p type and Vc for n type), (ON, ON, OFF) is achieved, and after the gate voltage of the driver transistor has become equal to the voltage on the power supply line, (OFF, ON, OFF) is achieved.

Next, in the second period, (OFF, ON, ON) is achieved to match the voltage of the second current input/output terminal of the driver transistor with the voltage Vda on the source line, the voltage of the first terminal of the first capacitor is switched to the second predetermined value (=Vc for p type and Vb for n type) render the driver transistor ON and the gate voltage is rendered equal to Vda+Vth (Vth>0 for an n-type driver transistor and Vth<0 for a p-type driver transistor) via the drain and source of the driver transistor, and when the driver transistor is rendered OFF as a result, (OFF, OFF, OFF) is achieved.

Next, in the third period, the voltage of the first terminal of the first capacitor is rendered equal to the third predetermined value (Va) between the first and second predetermined values, and (ON, OFF, OFF) is achieved to feed the voltage on the power supply line to the first current input/output terminal of the driver transistor.

For example, first, in the first period, the gate voltage of the driver transistor (Q1) is restored to a default state.

In the second period, a voltage Vda is fed from the source line (Sj) to the second current input/output terminal (drain) of the driver transistor (Q1) to change the voltage on the electric potential line (Ui). This renders the gate voltage of the driver transistor (Q1) equal to Vda+Vth (Vth is the threshold voltage; Vth>0 for an n-type driver transistors (Q1) and Vth<0 for a p-type driver transistors (Q1)).

In the third period, Vp (or Vn) is fed from the power supply line as the voltage of the first current input/output terminal or the second current input/output terminal (source or drain) of the driver transistor (Q1).

In the second period, the voltages Vda specified so that an inverse voltage or a non-light-on voltage is applied across the electro-optical element (EL1). Therefore, in the third period, to adjust the gate voltage of the driver transistor (Q1), the voltage on the electric potential line (Ui) is changed by ΔVx (=Va−Vb).

This renders the gate voltage of the driver transistor (Q1) equal to Vda+threshold voltage Vth+ΔVx. Thus, the threshold voltage Vth is adjusted.

The gate-to-source voltage Vgs of the driver transistor (Q1) becomes equal to Vda+Vth+ΔVx−Vp.

If the gate-to-source voltage Vgs of a TFT is less than the drain-to-source voltage Vds in terms of absolute value, the current flow Ids through the TFT is given by:

$$\begin{aligned} Ids &= k(Vgs - Vth)^2 \\ &= k\{(Vda + Vth + \Delta Vx - Vp) - Vth\}^2 \\ &= k(Vda + \Delta Vx - Vp)^2 \end{aligned}$$

where k is a constant. Hence, the current flow through the driver transistors (Q1) is specified by the data voltages Vda, the variation, ΔVx, of the voltage on the electric potential line (Ui), and the power supply voltage Vp regardless of the threshold voltage Vth of the driver transistor (Q1).

In this manner, the method of driving the display device enables the adjustment of the threshold voltage of the driver transistor. In other words, the desired current is fed to the electro-optical element regardless of the threshold voltage of the driver transistor.

The pixel circuit includes the switch section (for example, four transistors), one capacitor, and an electro-optical element.

Therefore, element counts per pixel, hence pixel size, are reduced over the conventional art to accommodate more pixels in a predetermined screen size. Display quality improves. The invention allows improvement on image quality.

Additional objects, advantages and novel features of the invention will be set forth in part in the description which follows, and in part will become apparent to those skilled in the art upon examination of the following or may be learned by practice of the invention.

DESCRIPTION OF THE EMBODIMENTS

The following will describe embodiments of the present invention in reference to FIG. 1 through FIG. 38.

The switching element in accordance with the present invention can be made of a low temperature polysilicon TFT or a CG (continuous grain) silicon TFT, to name a few examples. The present embodiment assumes that the element is made of a CG silicon TFT.

The structure of the CG silicon TFT is presented in "4.0-in. TFT-OLED Displays and a Novel Digital Driving Method" (SID '00 Digest, pp. 924-927, Semiconductor Energy Laboratory Co. Ltd.) for example. A CG silicon TFT manufacturing process is presented in "Continuous Grain Silicon Technology and Its Applications for Active Matrix Display" (AM-LCD 2000, pp. 25-28, Semiconductor Energy Laboratory Co. Ltd.) for example. Both the structure of the CG silicon TFT and its manufacturing process are publicly known; no detailed description will be given here.

The structure of the OLED, electro-optical element, used in the present embodiment is also presented in "Polymer Light-Emitting Diodes for use in Flat Panel Display" (AM-LCD '01, pp. 211-214, Semiconductor Energy Laboratory Co. Ltd.) for example. The structure is publicly known, and no detailed description will be given here.

Embodiment 1

Present embodiment 1 will describe a first example of the display device in accordance with the present invention.

Figure 1:
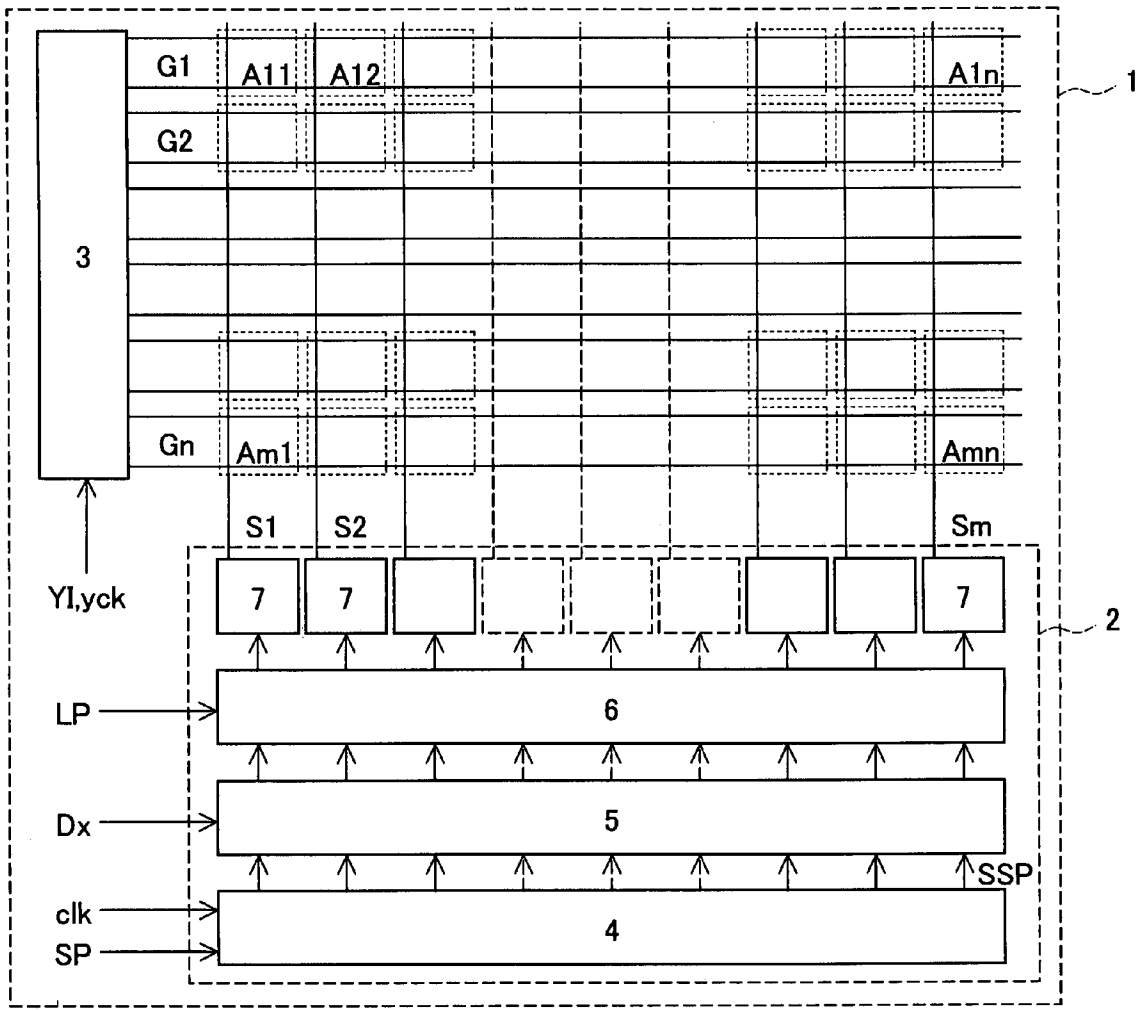
FIG. 1 is a block diagram illustrating the structure of a display device for embodiments 1, 2, 4 to 6 of the present invention.

As shown in FIG. 1, a display device 1 of the present embodiment has pixel circuits Aij, a gate driver circuit 3, and a source driver circuit 2. The circuits Aij are arranged in a matrix. The circuits 2, 3 control the lines.

Each pixel circuit Aij is located at an intersection of a source line Sj and a gate line Gi (i and j are integers). The source driver circuit 2 has an m-bit shift register 4, a 6 m-bit register 5, a 6 m-bit latch 6, and m 6-bit D/A converter circuits 7.

As such, in the source driver circuit 2, a start pulse SP is fed to the first register in the m-bit shift register 4 and transferred through the shift register 4 in accordance with a clock clk. Concurrently, the start pulse SP is also supplied to the register 5 as timing pulses SSP. The 6 m-bit register 5 holds 6-bit data Dx for the source lines Sj at the timing pulses SSP from the shift register 4. The latch 6 acquires the 6 m-bit data at a latch pulse LP for a later output to the D/A converter circuit 7. The D/A converter circuit 7 supplies voltages corresponding to the incoming 6-bit data to the source lines Sj.

Thus, the source driver circuit 2 of the present embodiment is arranged similarly to an ordinary source driver IC in the liquid crystal display.

The gate driver circuit 3 has a shift register circuit and a buffer circuit (neither shown). An input start pulse YI is transferred through the shift register in accordance with a clock yck. The gate driver circuit 3 performs logic operations in accordance with a timing signal and applies necessary voltage to associated gate lines Gi, control lines Ri, Ci, and electric potential lines Ui via the buffer.

Figure 2:
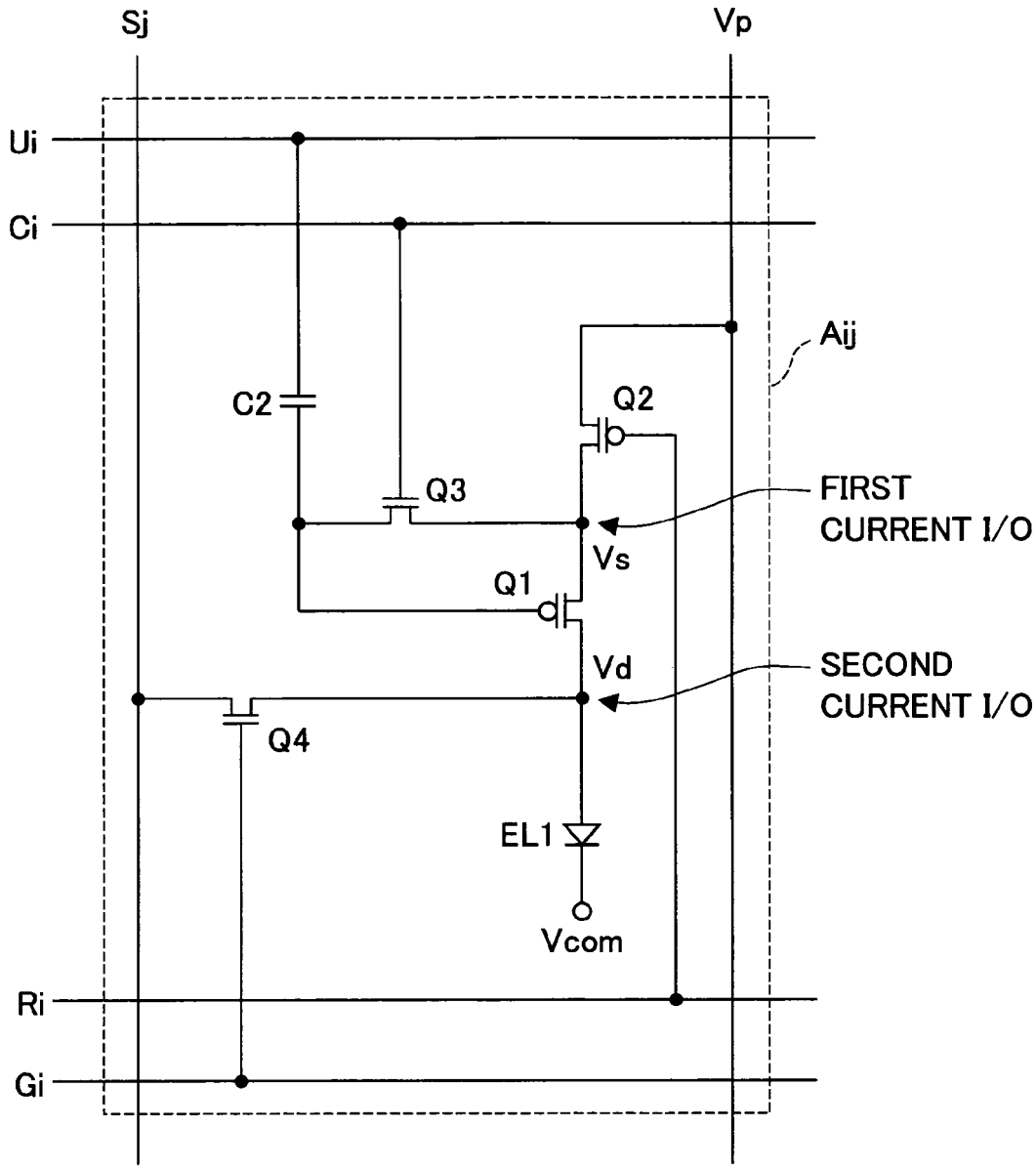
FIG. 2 is a circuit diagram illustrating a pixel circuit structure for embodiment 1.

FIG. 2 shows a pixel circuit structure in accordance with the present invention for present embodiment 1.

The illustrated pixel circuit Aij has a driver TFT (driver transistor) Q1 and a switching TFT (first switching transistor) Q2 connected in series between an OLED (electro-optical element) EL1 and a power supply line Vp.

Between the gate of the driver TFT Q1 and the electric potential line Ui is there provided a capacitor (first capacitor) C2. Between the source (first current input/output terminal) and the gate of the driver TFT Q1 is there provided a switching TFT (second switching transistor) Q3.

A switching TFT (third switching transistor) Q4 is present between the drain (second current input/output terminal) of the driver TFT Q1 and the source line Sj.

The OLED (electro-optical element) EL1 is connected to the drain (second current input/output terminal) of the driver TFT Q1.

In the FIG. 2 pixel circuit, the driver TFT Q1 and the switching TFT Q2 are of p type. The switching TFTs Q3, Q4 are of n type.

The gates of these switching TFTs Q2, Q3, Q4 are connected to the control lines Ri, Ci and the gate line Gi.

A switch section is formed by the three switching TFTs Q2, Q3, Q4, the control line Ri, the control line Ci, and the gate line Gi. This description is applicable also to subsequent embodiments.

Figure 3:
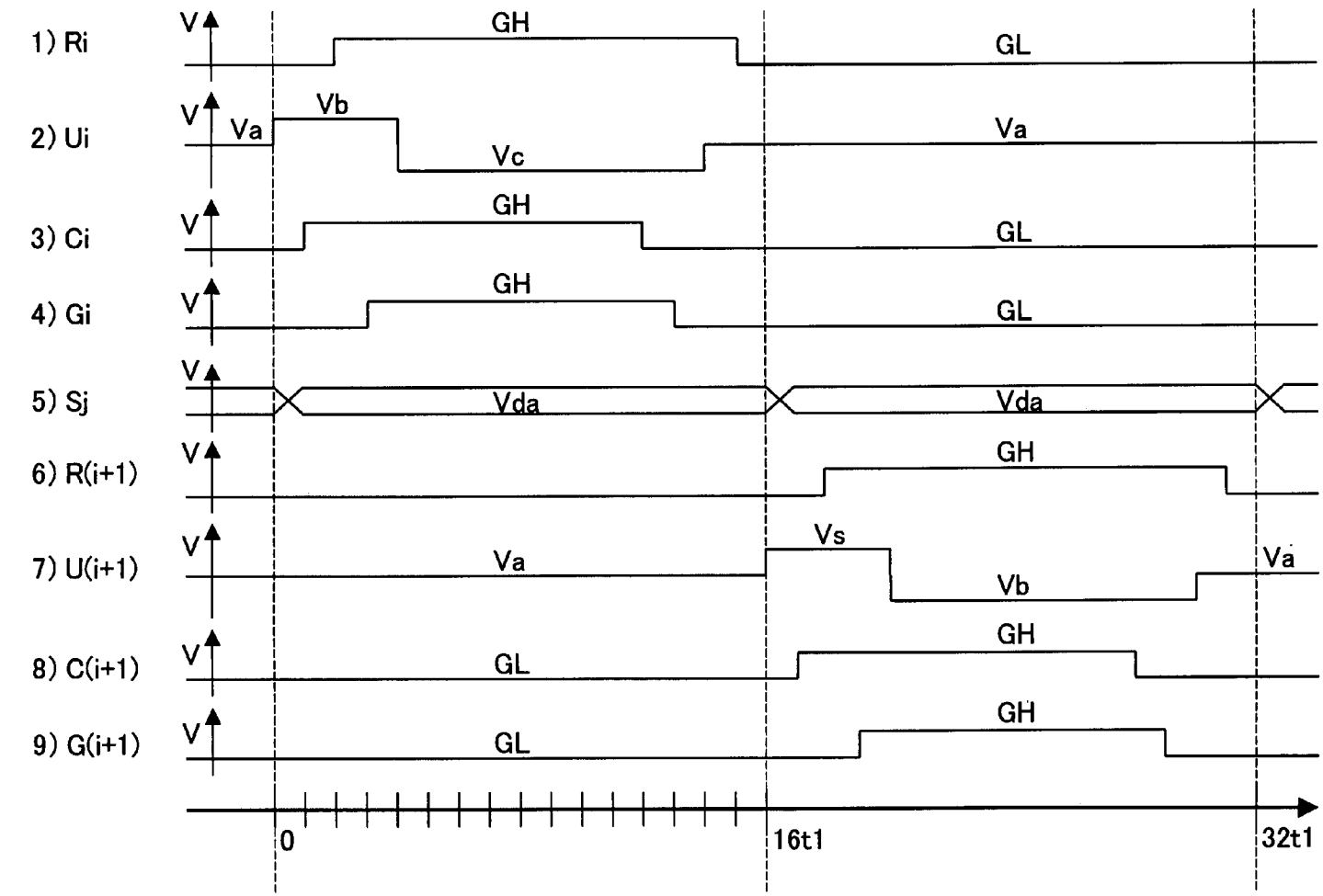
FIG. 3 is a timing diagram illustrating timings given by voltages on lines in a pixel circuit in FIGS. 2, 22.

FIG. 3 shows timings indicated by voltages on 1) the control line Ri, 2) the electric potential line Ui, 3) the control line Ci, 4) the gate line Gi, and 5) the source line Sj in the pixel circuit Aij. 6) R(i+1), 7) U(i+1), 8) C(i+1), and 9) G(i+1) are those for an adjacent pixel A(i+1)j.

The power supply line Vp is kept at a constant voltage (Vp). The control line Ri, the control line Ci, and the gate line Gi assume two voltage levels, GH (HIGH) and GL (LOW). The electric potential line Ui assumes at least three voltage levels. The source line Sj assumes a voltage level (Vda) corresponding to display data. This description is applicable also to subsequent embodiments unless otherwise noted. The From time 0 to 16*t*1 is a select period for the pixel Aij. Voltage on the electric potential line Ui goes from Va to Vb at time 0.

At time t1, the control line Ci switches to GH (HIGH), turning on the switching TFT Q3. This short-circuits the gate and source (first current input/output terminal) of the driver TFT Q1. The gate voltage becomes equal to the voltage Vp. The driver TFT Q1 is turned off.

At time 2t1, the control line Ri switches to GH, turning off the switching TFT Q2.

The gate line Gi then switches to GH at time 3t1, turning on the switching TFT Q4. Hence, the voltage Vda on the source line Sj is applied to the drain (second current input/output terminal) of the driver TFT Q1.

The electric potential line Ui then goes from Vb to Vc at time 4t1, lowering the gate voltage of the driver TFT Q1 to turn on the TFT Q1.

This allows a current flow from the source line Sj through the switching TFT Q4, the driver TFT Q1, and the switching TFT Q3 to the gate of the driver TFT Q1.

The current flows until the gate voltage of the driver TFT Q1 reaches a threshold voltage. The gate voltage of the driver TFT Q1 is therefore Vda+Vth (Vth<0).

At time 12t1, the control line Ci switches to GL (LOW), turning off the switching TFT Q3. Thus, the capacitor C2 retains the gate voltage of the driver TFT Q1 at (Vda+Vth)−Vc.

Subsequently, the gate line Gi switches to GL at time 13t1, turning off the switching TFT Q4. The electric potential line Ui goes from Vc to Va at time 14t1. The control line Ri switches to GL at time 15t1, turning on the switching TFT Q2.

Hence, the voltage Vp is applied to the source of the driver TFT Q1. The gate voltage Vg of the driver TFT Q1 equals (Vda+Vth)+(Va−Vc). Accordingly, if Vg>Vp+Vth, the driver TFT Q1 turns off. Conversely, if Vg<Vp+Vth, the driver TFT Q1 turns on.

The current flow through a TFT in the saturation region is given by:

$$Ids=(W\times\mu\times Co/(2\times L))(Vgs-Vth)^2,$$

where W, L, and μ are the gate width, gate length, and mobility of the TFT respectively, and Co is a constant. From this expression can be derived an expression giving the current flow through the driver TFT Q1 when the drain-to-source voltage Vds of the ON driver TFT Q1 is greater than the gate-to-source voltage Vgs:

$$Ids=k((Vda+Vth)+(Va-Vc)-Vp-Vth)^2=k(Vda+(Va-Vc)-Vp)^2$$

where k=(W×μ×Co/(2×L)).

It is preferable if Vb is a maximum (for example, 16 V) to temporarily turn off the TFT. It is also preferable if Vc is a minimum (for example, 0 V) to turn on TFT again which was temporarily turned off. Put differently, it can be said that as far as at least these purposes are concerned, the greater the difference between Vb and Vc, the better. Va is between Vb and Vc, and calculated as follows: Vda is first determined (for example, 2 V) in consideration of a desirable maximum current through the driver TFT Q1. Va is then derived from the expressions, Vg=(Vda+Vth)+(Va−Vc) and Vg=Vp+Vth. The latter expression represents the ON/OFF behavior of the driver TFT Q1. For example, if Vp=12 V, Vc=0 V, Vda=2 V, Va=10 V. This description about Va, Vb, and Vc is applicable also to all the other embodiments.

The voltage Vda is applied to the anode of the OLED EL1 while the gate line Gi is at GH; a large difference between Vda and Vcom will cause the OLED EL1 to light. It is hence preferable if Vda does not differ greatly from Vcom.

A simulation was done assuming a certain OLED's characteristics, as well as GL=0 V, GH=16 V, Vcom=0 V, Vp=12 V, Vb=16, Vc=0 V, and Va=8 V. The simulation showed that the driver TFT Q1 turned on at Vda=3.6 V. Under these conditions, Vg=(Vda+Vth)+(Va−Vc)=3.6 V+Vth+8 V=11.6 V+Vth. At this Vg, the driver TFT Q1 turns on when the source Vs is voltage Vp=12 V. The driver TFT Q1 turned off at Vda=5 V. Now, Vg=(Vda+Vth)+(Va−Vc)=5 V+Vth+8 V=13 V+Vth. At this Vg, the driver TFT Q1 turns off when the source Vs is voltage Vp=12 V. Therefore, Vda is from 5 V down to about 3 V. Continuously changing Vda in this range achieves analog grayscale display.

At Vda as low as 5 V, the OLED EL1 hardly lit although a 5-V voltage was applied across the anode and cathode of the OLED EL1. This is because the simulation specified a high light-on voltage for the OLED. However, even when the light-on voltage of the OLED is low, the OLED EL1 hardly lights with the switching TFT Q4 turned on, if Vcom or Vda is properly regulated.

Figure 4:
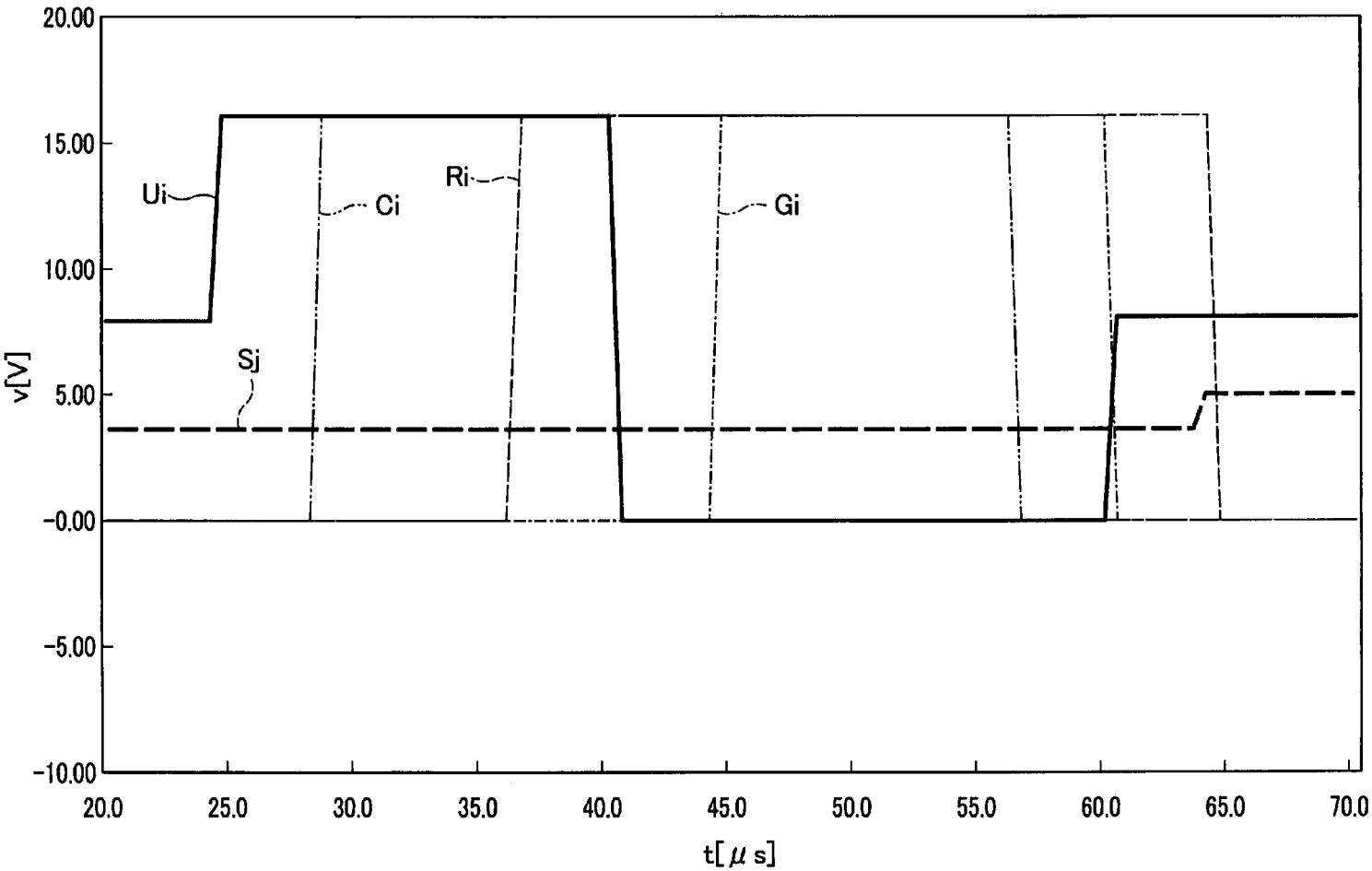
FIG. 4 is a graphical representation of results of simulation of voltage changes on Sj, Gi, Ci, Ui, and Ri in the FIG. 2 pixel circuit.
Figure 5:
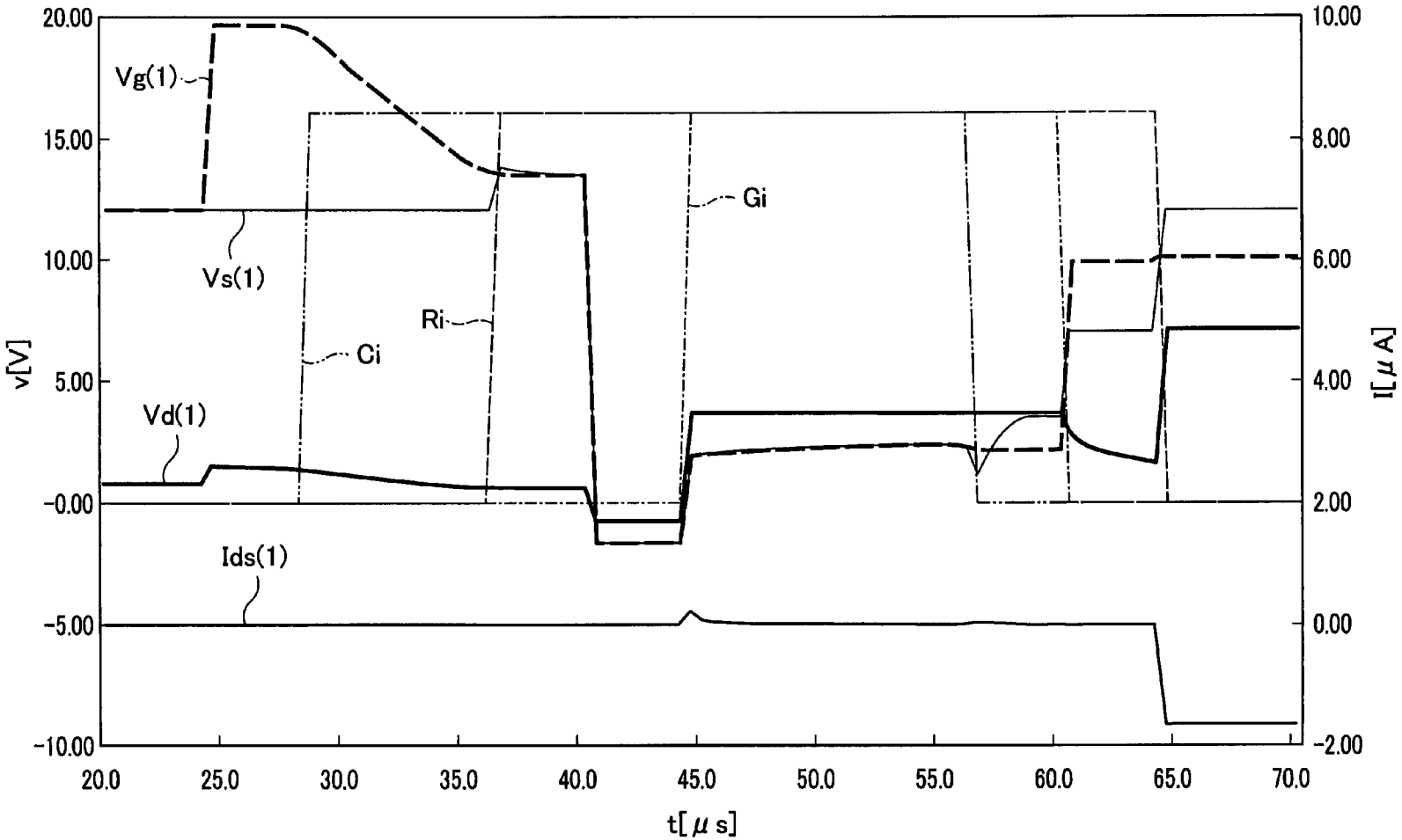
FIG. 5 is a graphical representation of the simulated gate voltage Vg, source voltage Vs, drain voltage Vd, and source-to-drain current Ids of a driver TFT in the FIG. 2 pixel circuit.
Figure 6:
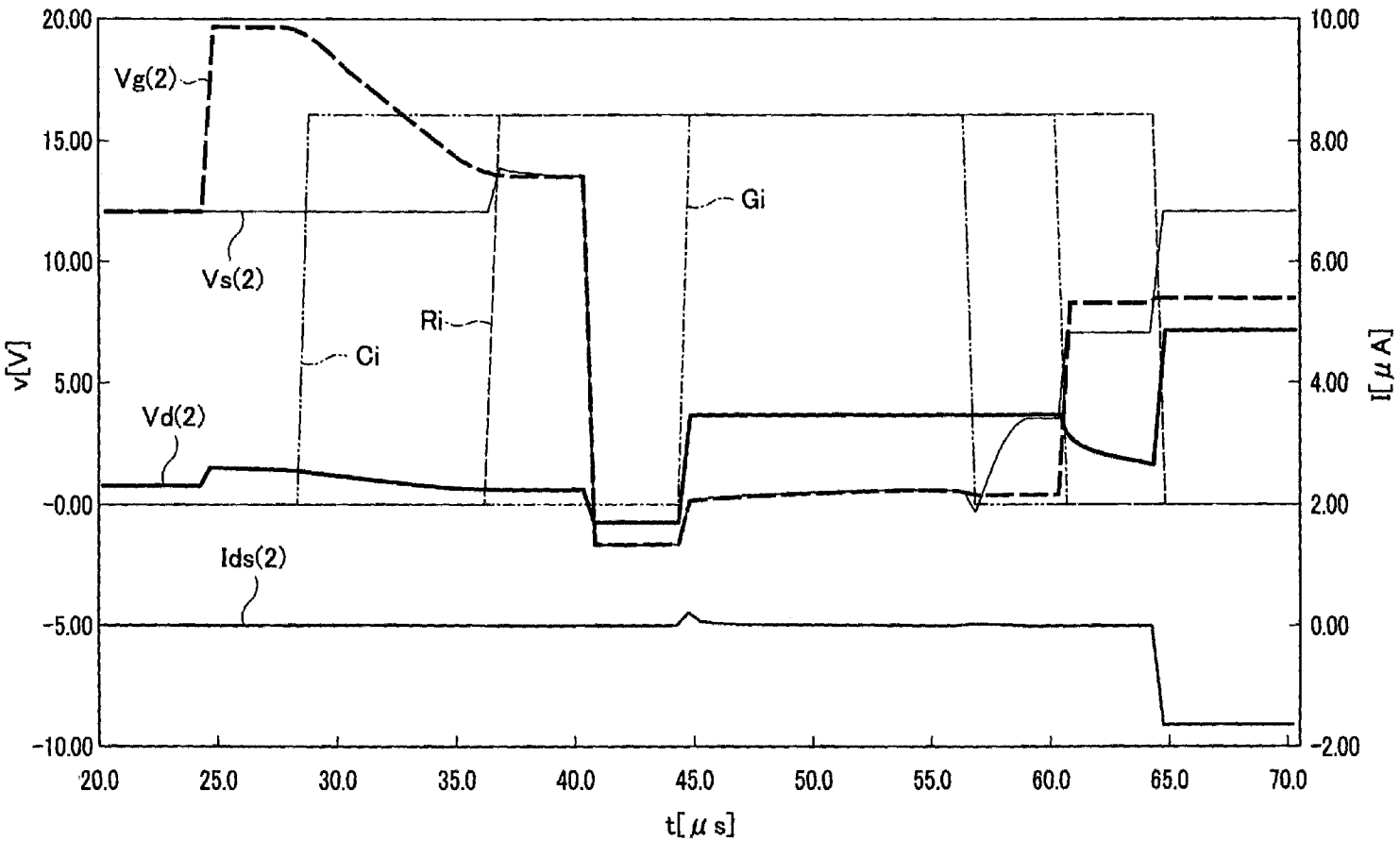
FIG. 6 is another graphical representation of the simulated gate voltage Vg, source voltage Vs, drain voltage Vd, and source-to-drain current Ids of a driver TFT in the FIG. 2 pixel circuit.

FIG. 4 through FIG. 6 show results of the simulation. "(1)" indicates a case where the absolute value of the threshold voltage Vth was a minimum of Vth(min), and the mobility p was a maximum. "(2)" indicates a case where the absolute value of the threshold voltage Vth was a maximum of Vth (max), and the mobility μ was a minimum.

The figures show that the threshold of the driver TFT Q1 was adjusted from time 44 to 55 μs, rendering Vg(1)=2.38 V and Vg(2)=0.5 V. Since Vda=3.6 V, it would be understood that Vth was about −1.2 V in case (1) and about −3.1 V in case (2).

These threshold voltage variations were no more than the mobility variations of the driver TFT Q1. This can be seen from the current Ids through the driver TFT Q1 which was −1.64 μA in case (1) and −1.45 μA in case (2) after time 65 μs when the electric potential line Ui went to Va.

Figure 39:
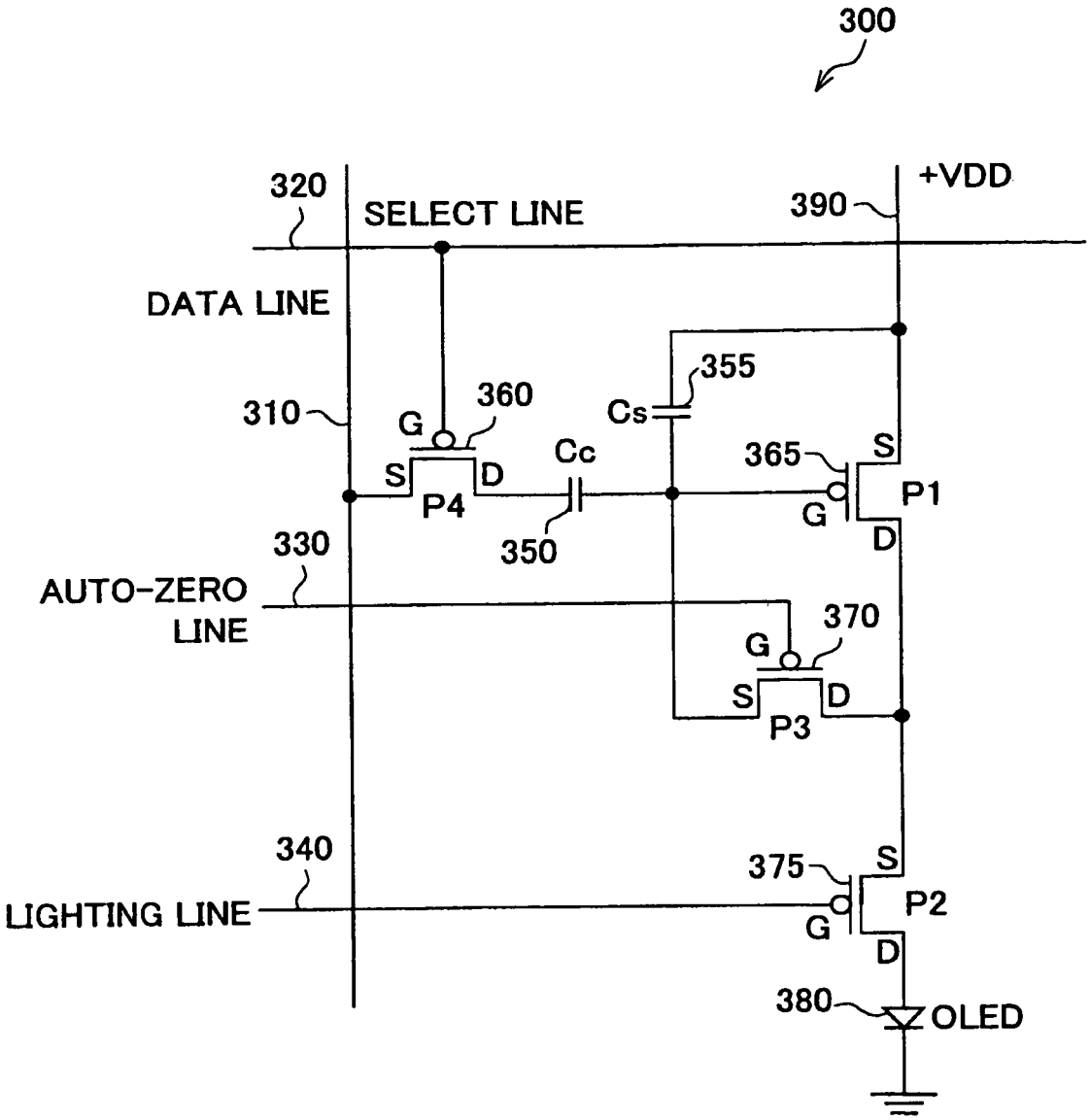
PRIOR ART FIG. 39
FIG. 39 is a first circuit diagram illustrating a pixel circuit structure of a conventional display device as an example.

The present invention enables the adjustment of the threshold of the driver TFT Q1 in this manner. Also, when compared to the pixel circuits discussed in the BACKGROUND OF THE INVENTION, the present invention requires a fewer elements to form a pixel: four TFTs, one capacitor, and one OLED. The invention as such reduces element counts per pixel, hence pixel size, over the conventional art in FIGS. 39, 40 to accommodate more pixels in a predetermined screen size. The invention allows improvement on image quality.

Figure 40:
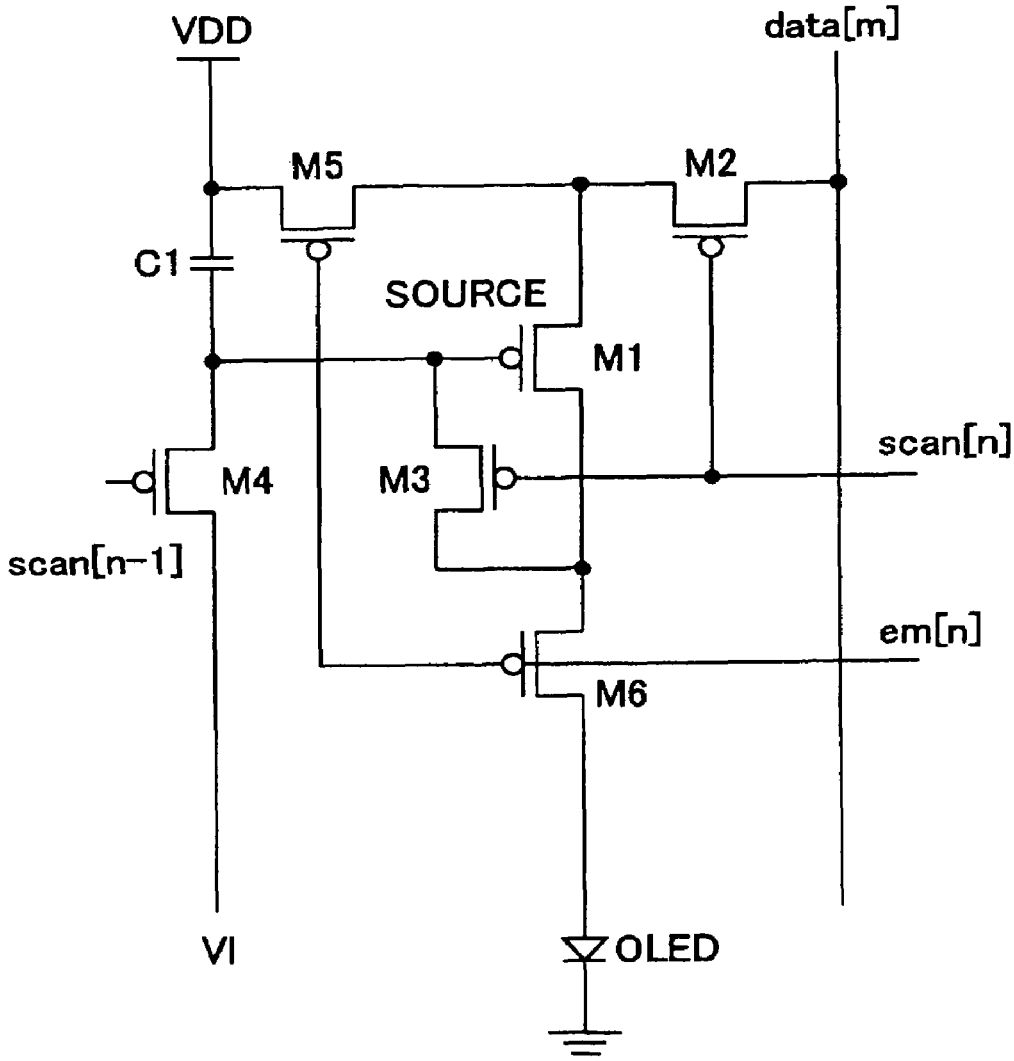
PRIOR ART FIG. 40
FIG. 40 is a second circuit diagram illustrating a pixel circuit structure of a conventional display device as an example.

In the FIG. 40 pixel circuit structure, the three TFTs M5, M1, M6 are present between the power supply line VDD and the OLED. Among them, the TFTs M5, M6 need to have a large gate width because they are switching TFTs located on a current feeder path to the OLED. This requirement makes it difficult to reduce pixel size. In contrast, in the FIG. 2 pixel circuit structure in accordance with the present invention, the two TFTs Q1, Q2 are only present between the power supply line Vp and the OLED EL1. It is however the TFT Q2 alone that is a switching TFT located on a current feeder path to the OLED, which makes it easy to reduce pixel size.

Figure 7:
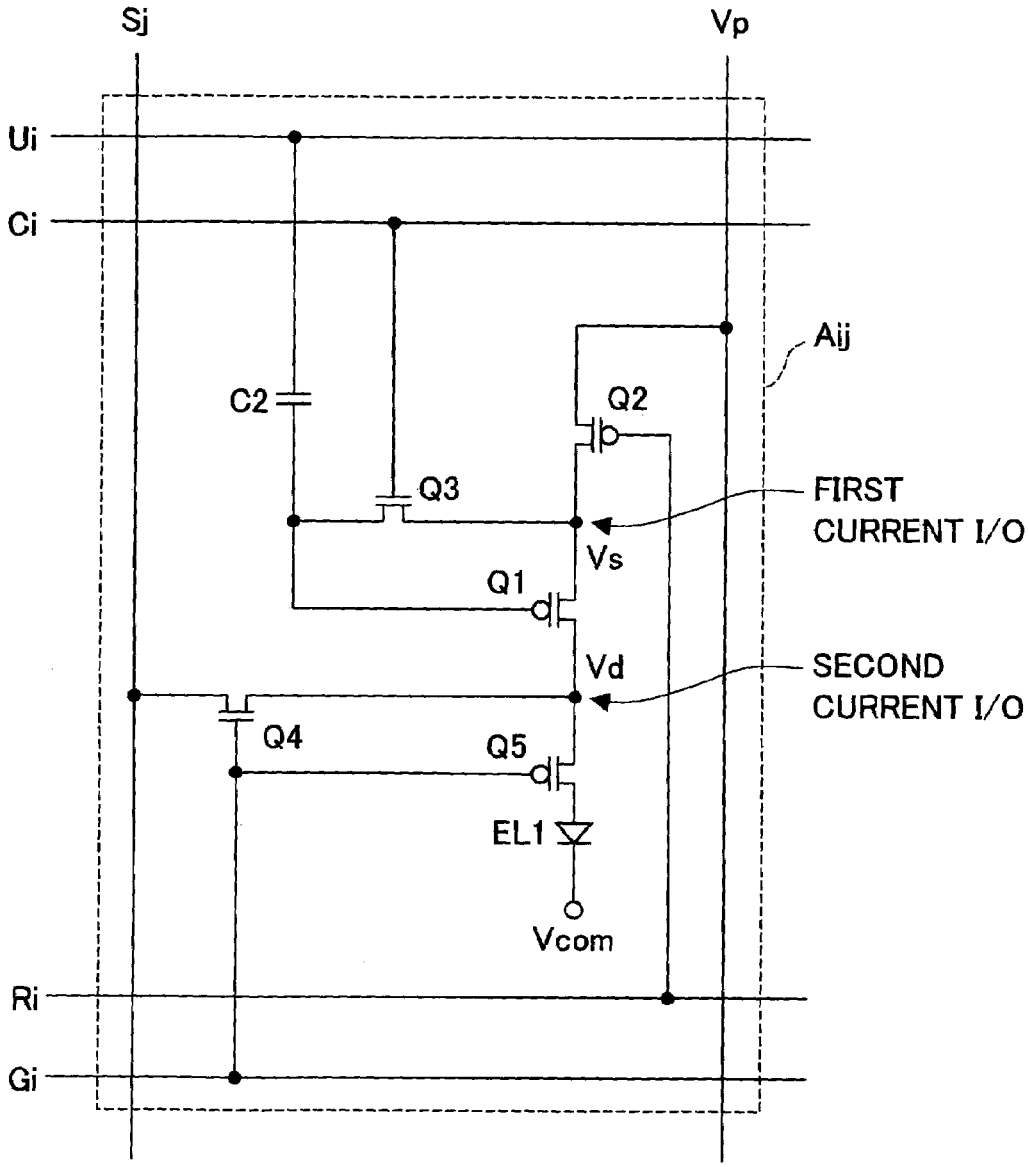
FIG. 7 is a circuit diagram illustrating another pixel circuit structure for embodiment 1.

While the gate line Gi is at GH, the voltage Vda is applied to the anode of the OLED. But, the cathode voltage, Vcom, of the OLED and the voltage Vda on the source line Sj are specified so that the OLED hardly lights as discussed earlier. If one finds the small current still annoying or wants to specify the voltage Vda on the source line Sj more freely, a fourth switching TFT Q5 will present a satisfactory solution. The fourth switching TFT Q5 is a p-type TFT provided between the drain of the driver TFT Q1 and the anode of the OLED EL1 as shown in FIG. 7. The gate of the switching TFT Q5 can be connected to the gate line Gi.

Embodiment 2

Present embodiment 2 will describe a second example of the display device in accordance with the present invention.

Figure 8:
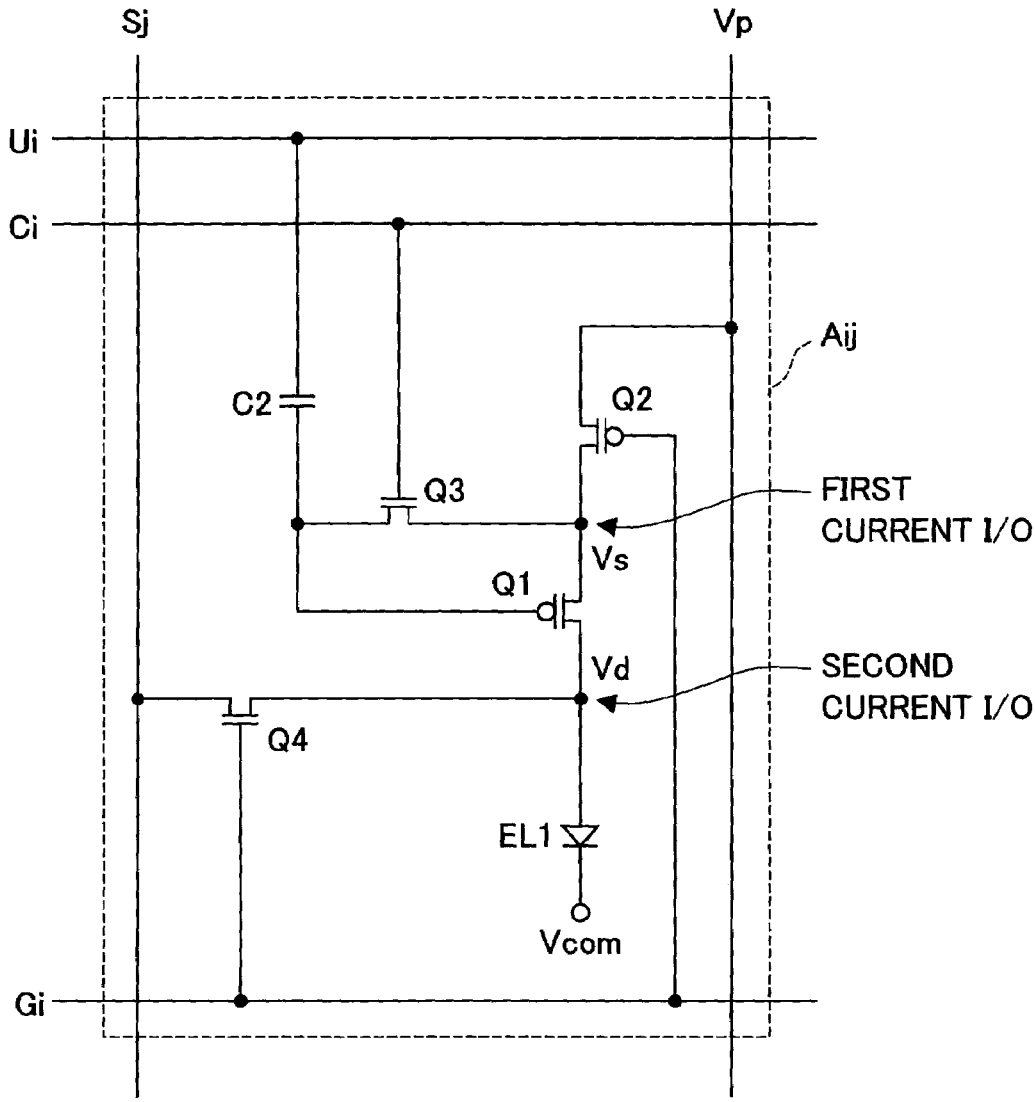
FIG. 8 is a circuit diagram illustrating a pixel circuit structure for embodiment 2.

The display device 1 of the present embodiment is the same as the display device 1 shown in FIG. 1; its description is not repeated here. FIG. 8 shows a pixel circuit structure in accordance with the present invention for present embodiment 2.

The illustrated pixel circuit Aij has a gate line Gi replacing and acting as both the control line Ri and gate line Gi in FIG. 2. The control line Ri was connected to the gate of the switching TFT Q2 (first switching transistor). The gate line Gi was connected to the gate of the switching TFT Q4 (third switching transistor). Otherwise, the pixel circuit Aij is identical to the FIG. 2 pixel circuit; no more description will be given here.

Now, the operation of the pixel circuit Aij will be described in reference to the a timing chart of FIG. 9.

Figure 9:
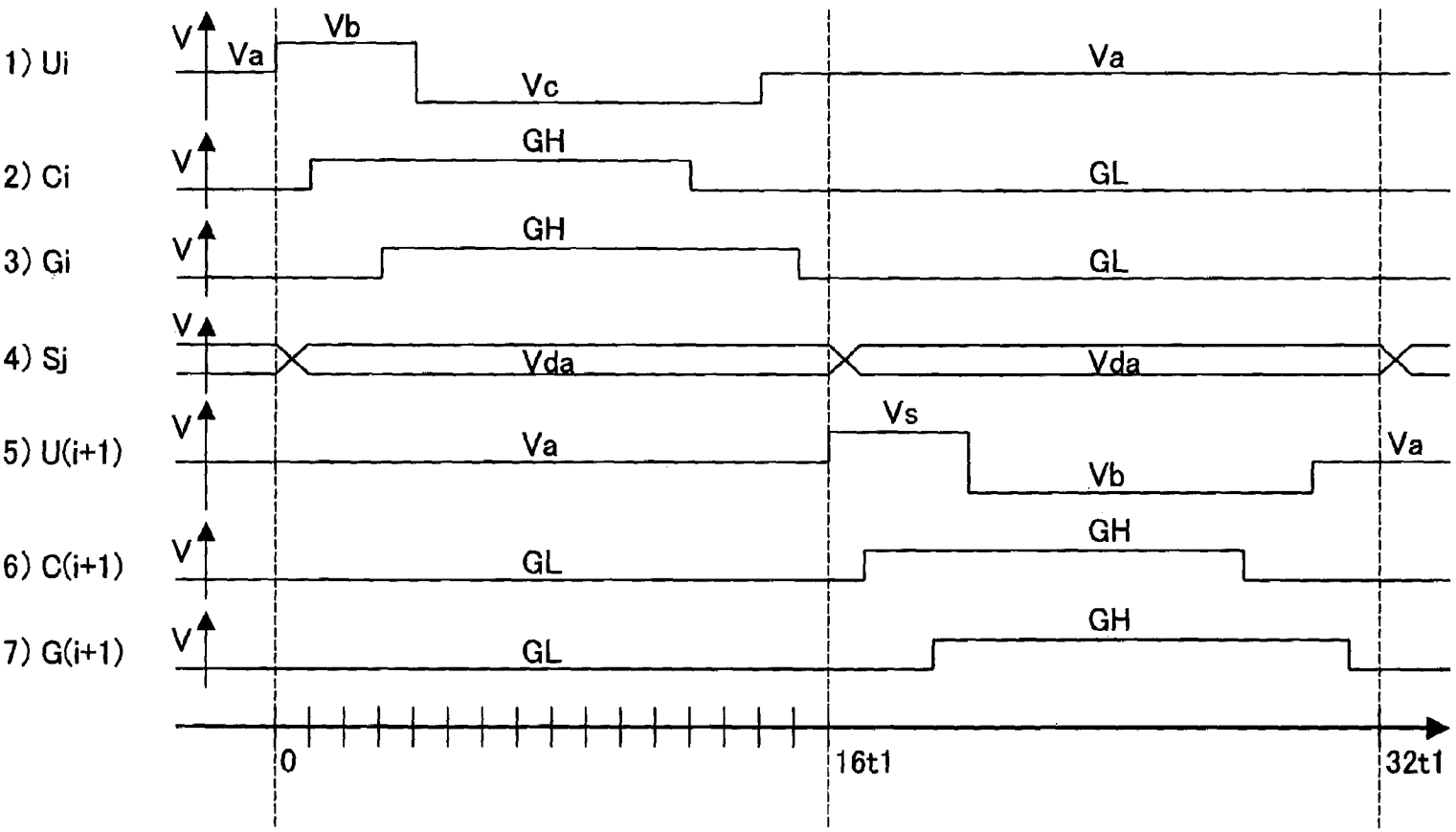
FIG. 9 is a timing diagram illustrating timings given by voltage on lines in a pixel circuit in FIGS. 8, 27.

FIG. 9 shows timings indicated by voltages on 1) the electric potential line Ui, 2) the control line Ci, 3) the gate line Gi, and 4) the source line Sj. 5) U(i+1), 6) C(i+1), and 7) G(i+1) are those for an adjacent pixel A(i+1)j.

From time 0 to 16*t*1 is a select period for the pixel Aij. Voltage on the electric potential line Ui goes from Va to Vb at time 0.

At time t1, the control line Ci switches to GH (HIGH), turning on the switching TFT Q3. This renders the gate voltage of the driver TFT Q1 equal to the voltage Vp, turning off the driver TFT Q1.

At time 3*t*1, the gate line Gi switches to GH, turning off the switching TFT Q2 and turning on the switching TFT Q4. Hence, the voltage Vda on the source line Sj is applied to the drain of the driver TFT Q1 (second current input/output terminal).

The electric potential line Ui then goes to Vc at time 4*t*1, lowering the gate voltage of the driver TFT Q1 to turn on the TFT Q1. This allows a current flow from the source line Sj through the switching TFT Q4, the driver TFT Q1, and the switching TFT Q3 to the gate of the driver TFT Q1. The current flows until the gate voltage of the driver TFT Q1 reaches a threshold voltage. The gate voltage of the driver TFT Q1 is therefore Vda+Vth (Vth<0).

At time 12*t*1, the control line Ci switches to GL (LOW), turning off the switching TFT Q3. Thus, the capacitor C2 retains the gate voltage of the driver TFT Q1 at (Vda+Vth)−Vc.

Subsequently, the electric potential line Ui goes to Va at time 14*t*1. The gate line Gi then switches to GL at time 15*t*1, turning off the switching TFT Q4 and turning on the switching TFT Q2.

Hence, the voltage Vp is applied to the source of the driver TFT Q1. The gate voltage Vg of the driver TFT Q1 equals (Vda+Vth)+(Va−Vc).

These voltages Vda, Vb, Vc, Va are specified similarly to embodiment 1; description is not repeated here.

Figure 10:
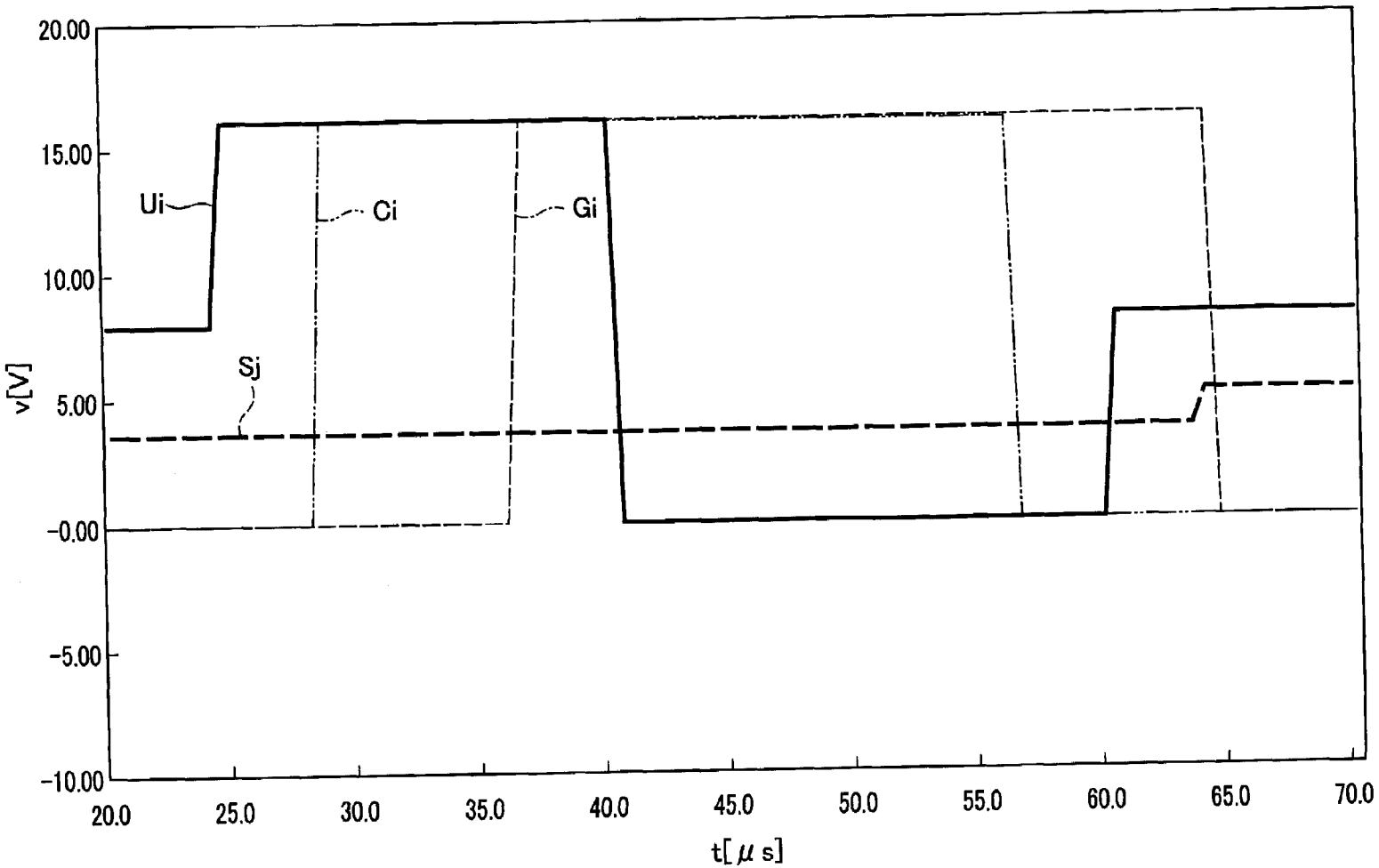
FIG. 10 is a graphical representation of simulated voltages on Sj, Gi, Ci, and Ui in the FIG. 8 pixel circuit.
Figure 11:
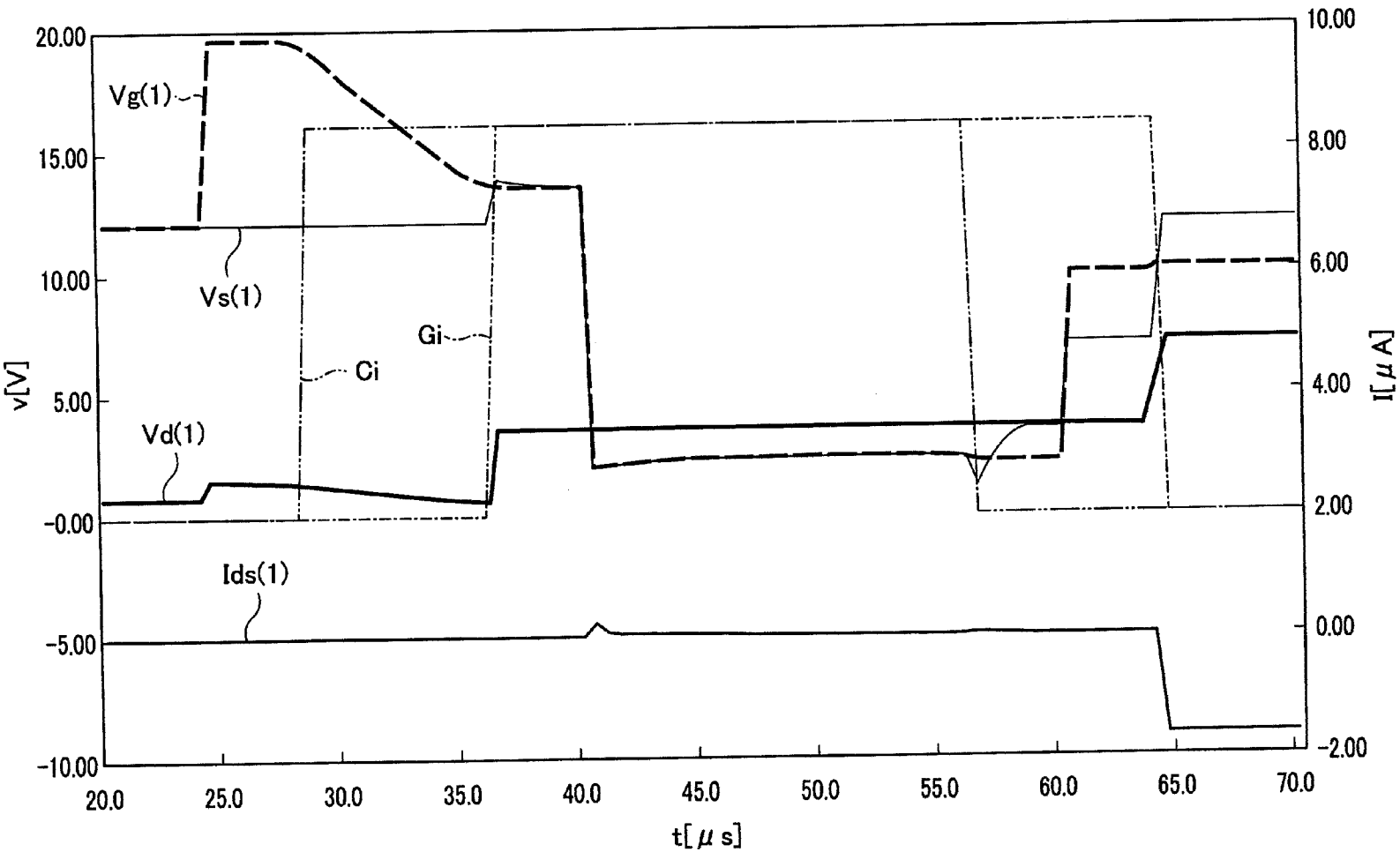
FIG. 11 is a graphical representation of the simulated gate voltage Vg, source voltage Vs, drain voltage Vd, and source-to-drain current Ids of a driver TFT in the FIG. 8 pixel circuit.
Figure 12:
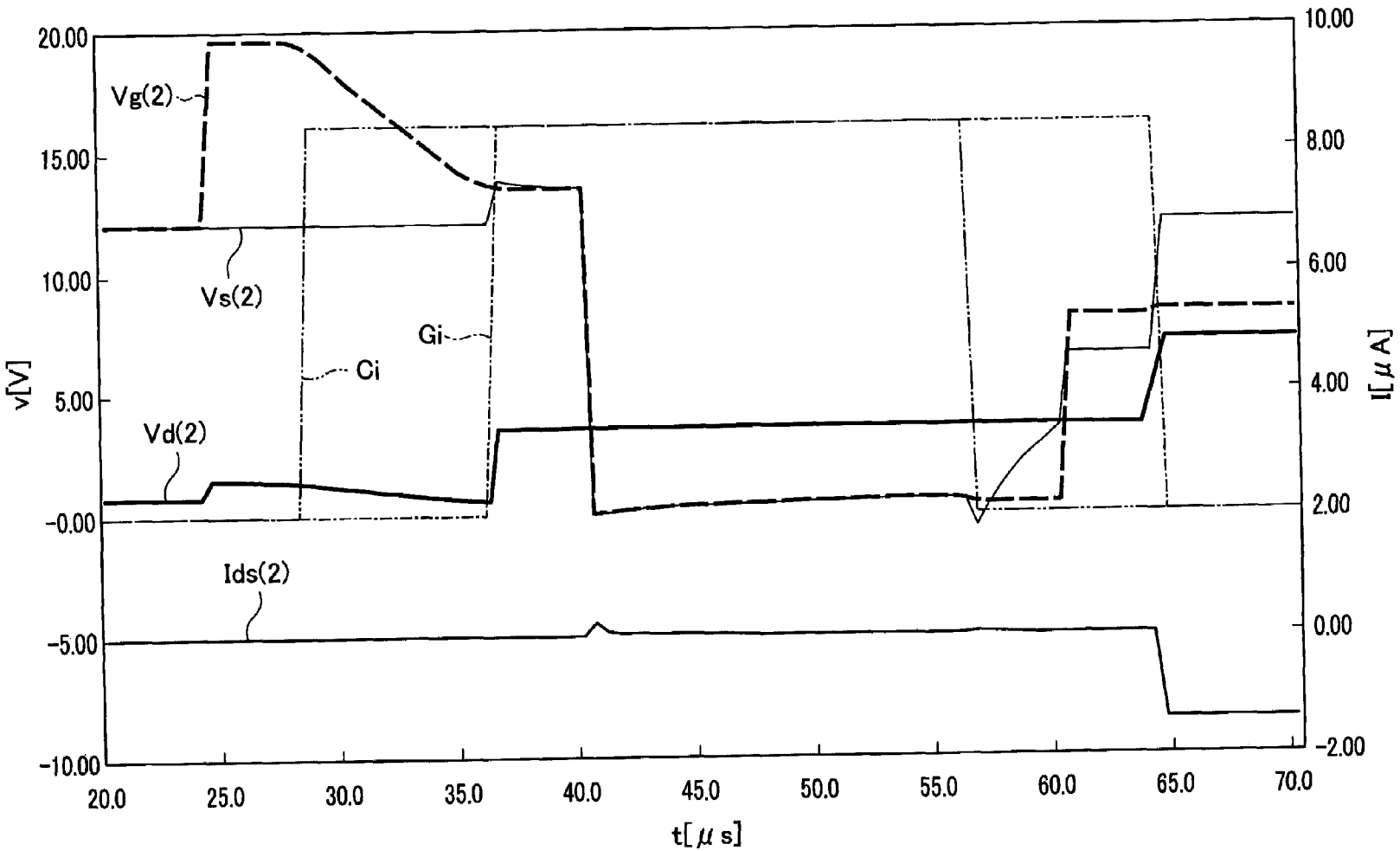
FIG. 12 is another graphical representation of the simulated gate voltage Vg, source voltage Vs, drain voltage Vd, and source-to-drain current Ids of a driver TFT in the FIG. 8 pixel circuit.

FIG. 10 through FIG. 12 show results of a simulation where the FIG. 8 pixel circuit was driven by the timings indicated in FIG. 9. As could be seen from these figures, the results are similar to those shown in FIG. 4 through FIG. 6, even with the switching TFTs Q2, Q4 sharing a common gate line.

This preferred embodiment of the present invention thus reduces element counts per pixel without significantly increasing line counts per pixel. The invention as such reduces element counts per pixel, hence pixel size, over the conventional art to accommodate more pixels in a predetermined screen size. The invention allows improvement on image quality.

Embodiment 3

Figure 13:
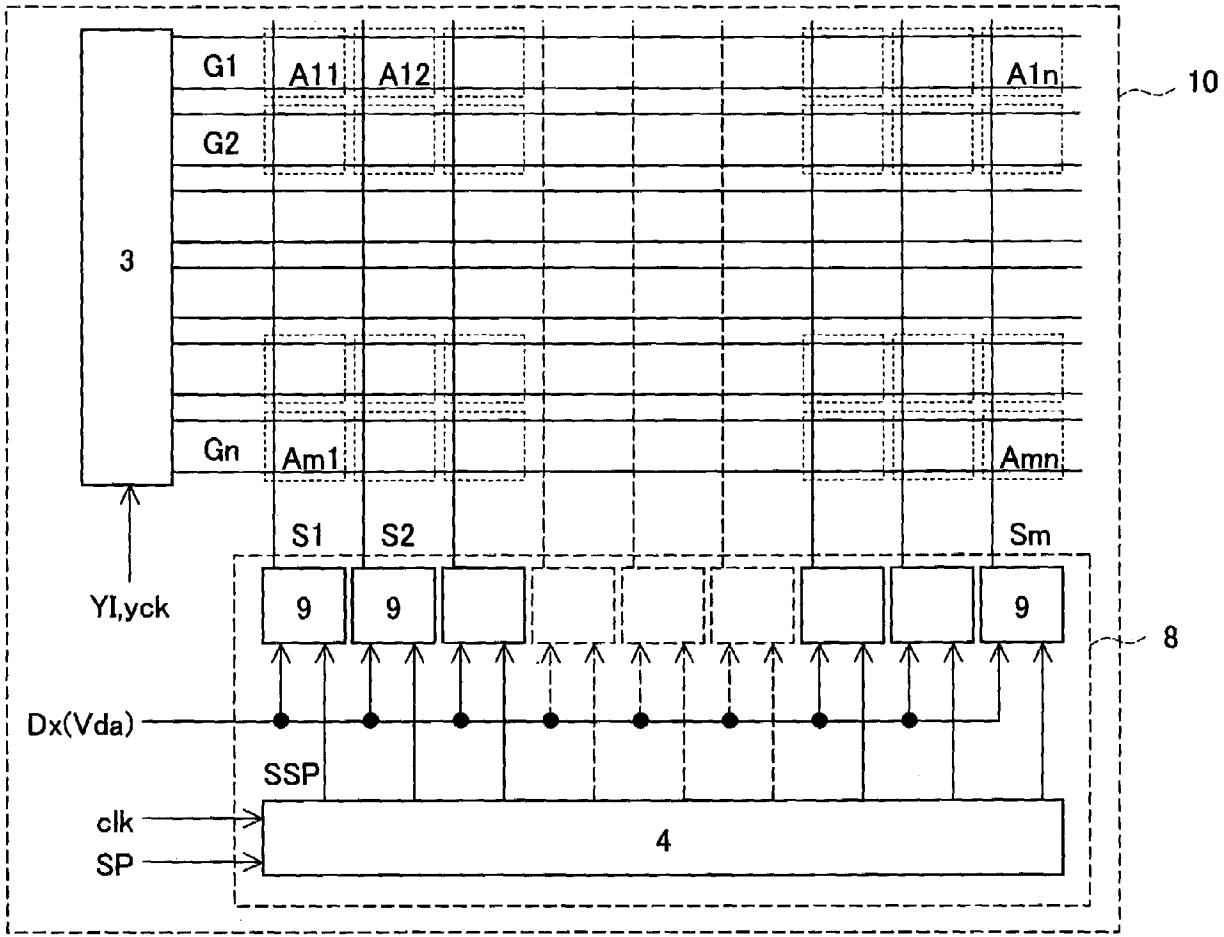
FIG. 13 is a block diagram illustrating the structure of a display device for embodiment 3 of the present invention.

Present embodiment 3 will describe a third example of the display device in accordance with the present invention. As shown in FIG. 13, a display device 10 of the present embodiment has pixel circuits Aij, a gate driver circuit 3, and a source driver circuit 8. The pixel circuits Aij are arranged in a matrix. The circuits 3, 8 control the lines. The FIG. 1 structure may be used in this embodiment. Conversely, the FIG. 13 structure may be used in other embodiments.

Each pixel circuit Aij is located at an intersection of a source line Sj and a gate line Gi. The source driver circuit 8 has an m-bit shift register 4 and m sample and hold circuits 9.

As such, in the source driver circuit 8, a start pulse SP is fed to the first register in the m-bit shift register 4 and transferred through the shift register 4 in accordance with a clock clk. The start pulse SP is supplied to the sample and hold circuits 9 as timing pulses SSP. The sample and hold circuits 9 acquire and hold incoming analog voltage signals Dx from the shift register 4 and supply the signals Dx to the associated source lines Sj at timing pulses SSPj.

Thus, the source driver circuit 8 of the present embodiment is arranged similarly to source driver circuits in polysilicon TFT liquid crystal displays for example.

The gate driver circuit 3 has a shift register circuit and a buffer circuit (neither shown). An input start pulse YI is transferred through the shift register in accordance with a clock yck. The gate driver circuit 3 performs logic operations in accordance with a timing signal and applies voltage to associated gate lines Gi, control lines Ri, Ci, and electric potential lines Ui via a buffer. The timing signal is generated by the circuit 3 itself.

Figure 14:
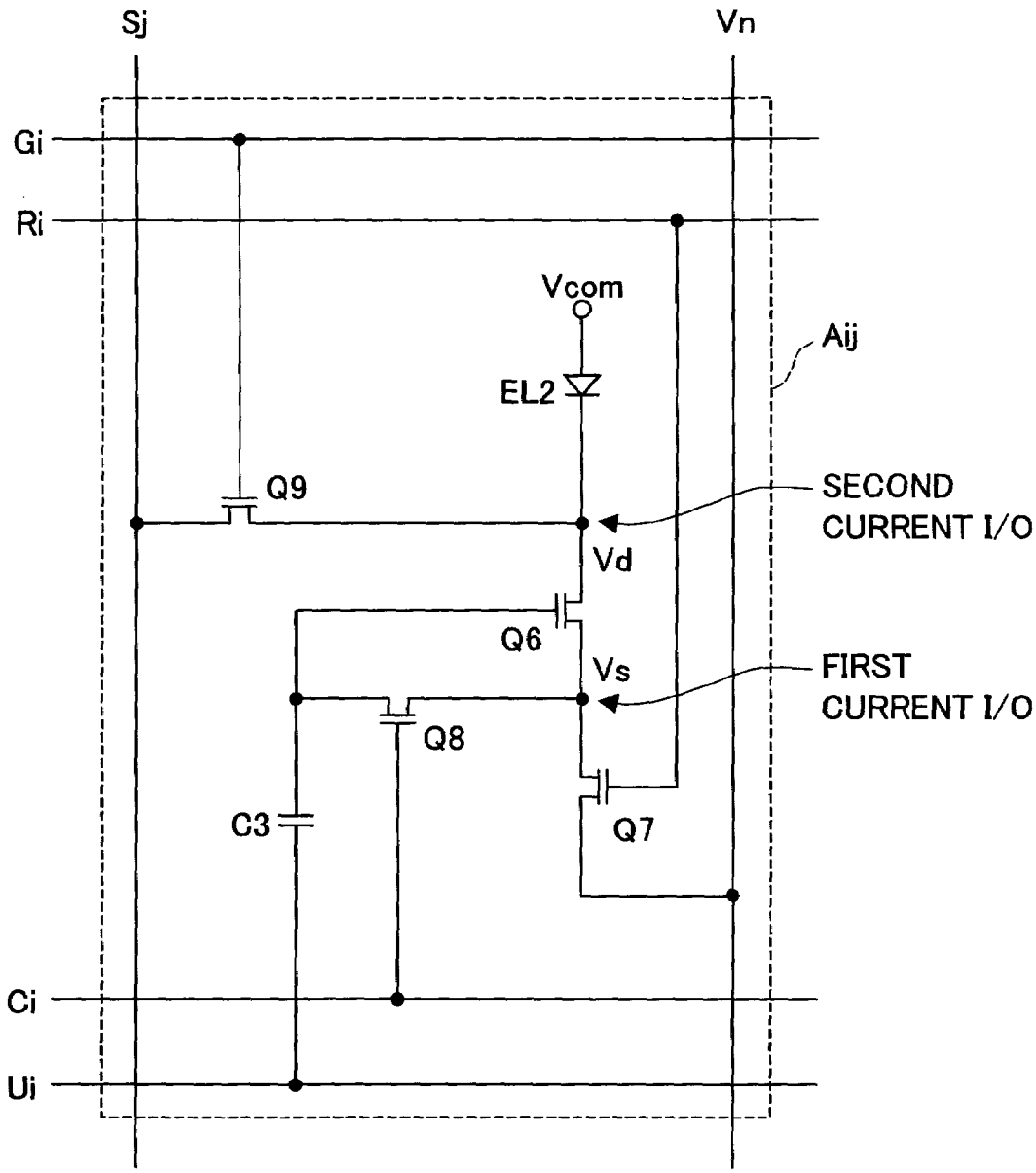
FIG. 14 is a circuit diagram illustrating a pixel circuit structure for embodiment 3.

FIG. 14 shows a pixel circuit structure in accordance with the present invention for present embodiment 3.

The illustrated pixel circuit Aij has a driver TFT (driver transistor) Q6 and a switching TFT (first switching transistor) Q7 connected in series between an OLED (electro-optical element) EL2 and a power supply line Vn.

Between the gate of the driver TFT Q6 and the electric potential line Ui is there provided a capacitor (first capacitor) C3. Between the source (first current input/output terminal) and the gate of the driver TFT Q6 is there provided a switching TFT (second switching transistor) Q8.

A switching TFT Q9 (third switching transistor) is present between the drain (second current input/output terminal) of the driver TFT Q6 and the source line Sj.

The OLED (electro-optical element) EL2 is connected to the drain (second current input/output terminal) of the driver TFT Q6.

In the FIG. 14 pixel circuit, the driver TFT Q6 and the switching TFTs Q7, Q8, Q9 are all of n type. So, all the switching TFTs can be made from amorphous silicon.

The gates of these switching TFTs Q7, Q8, Q9 are connected to the control lines Ri, Ci and the gate line Gi.

Figure 15:
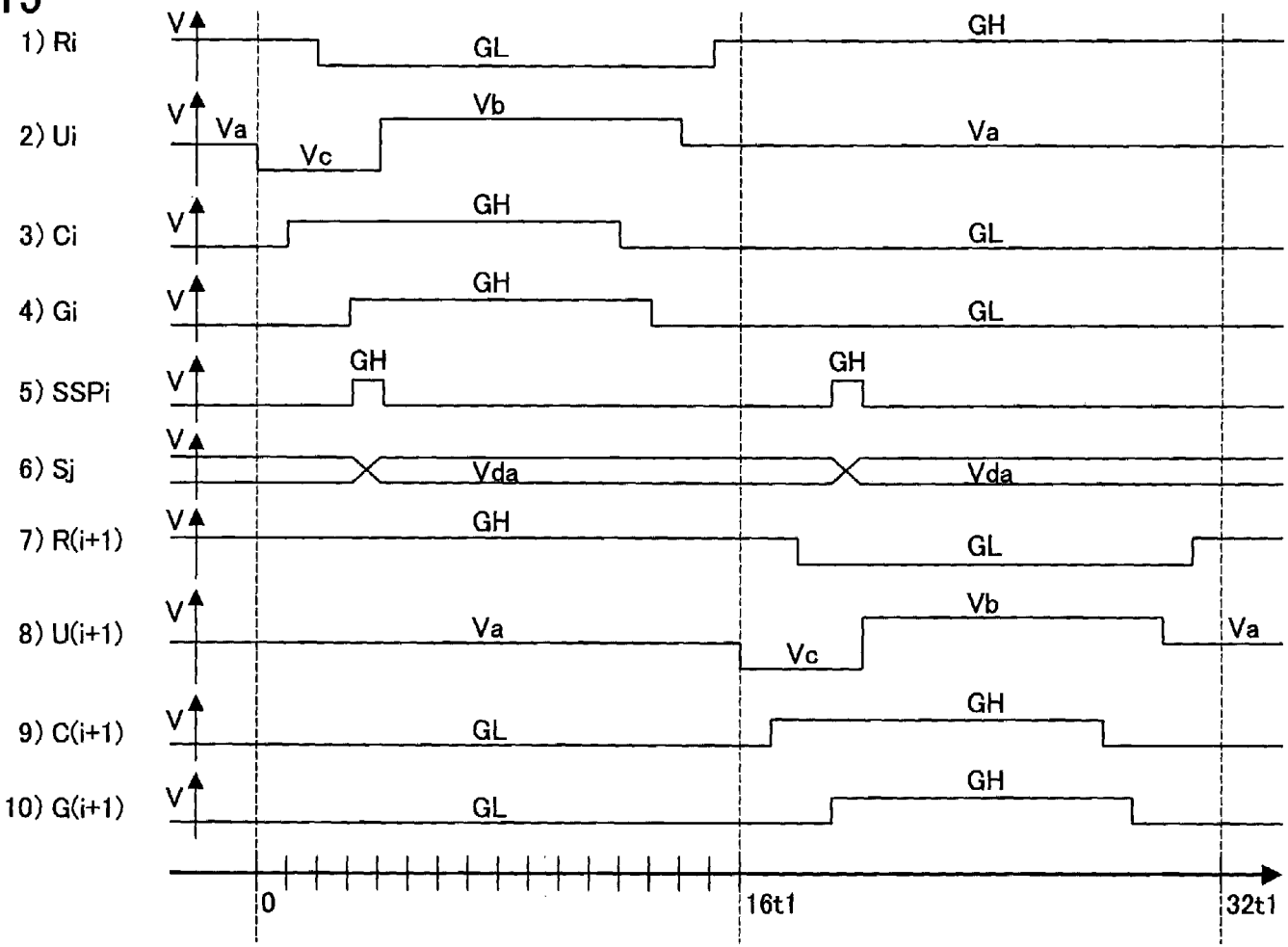
FIG. 15 is a timing diagram illustrating timings given by voltages on lines in the FIG. 14 pixel circuit.

FIG. 15 shows timings indicated by voltages on 1) the control line Ri, 2) the electric potential line Ui, 3) the control line Ci, 4) the gate line Gi, and 6) the source line Sj in the pixel circuit Aij. 7) R(i+1), 8) U(i+1), 9) C(i+1), and 10) G(i+1) are those for an adjacent pixel A(i+1)j. 5) SSPj are those timing pulses SSP that correspond to the source line Sj. The timing pulse SSP is supplied from the shift register 4 to the sample and hold circuits 9. See FIG. 13.

From time 0 to 16t1 is a select period for the pixel Aij. Voltage on the electric potential line Ui goes from Va to Vc at time 0.

At time t1, the control line Ci switches to GH (HIGH), turning on the switching TFT Q8. This renders the gate voltage of the driver TFT Q6 equal to the voltage Vn, turning off the driver TFT Q6.

At time 2t1, the control line Ri switches to GL (LOW), turning off the switching TFT Q7.

The gate line Gi then switches to GH at time 3t1, turning on the switching TFT Q9. At around the same timings, the timing pulses SSPj for the associated source line Sj are supplied to the sample and hold circuit 9. Hence, the voltage Vda on the source line Sj is applied to the drain (second current input/output terminal) of the driver TFT Q6.

The electric potential line Ui then goes to voltage Vb at time 4t1, increasing the gate voltage of the driver TFT Q6 to turn on the driver TFT Q6. The voltage Vda appears at the drain of the ON driver TFT Q6. This allows electric charge to flow from the gate of the driver TFT Q6 through the switching TFT Q8, the driver TFT Q6, and the switching TFT Q9 to the source line Sj. The electric charge flows until the gate voltage of the driver TFT Q6 reaches a threshold voltage. The gate voltage of the driver TFT Q6 is therefore Vda+Vth (Vth>0).

From time 4t1 to 12t1, the sample and hold circuit 9 outputs no current to the source line Sj. The stray capacitance of the source line Sj however is tens of times more than the capacitance of the capacitor C3. Even with electric charge flowing from the capacitor C3, if any, the voltage on the source line Sj hardly changes from Vda. Accordingly, the voltage on the source line Sj is regarded as staying at Vda in the present embodiment.

At time 12t1, the control line Ci switches to GL (LOW), turning off the switching TFT Q8. Thus, the capacitor C3 retains the gate voltage of the driver TFT Q6 at (Vda+Vth)−Vb.

Subsequently, the gate line Gi switches to GL at time 13t1, turning off the switching TFT Q9. The electric potential line Ui goes to Va at time 14t1. The control line Ri then switches to GH at time 15t1, turning on the switching TFT Q7.

Hence, the voltage Vn is applied to the source of the driver TFT Q6. The gate voltage Vg of the driver TFT Q6 equals (Vda+Vth)−Vb+Va. Accordingly, if Vg>Vn+Vth, the driver TFT Q6 turns on. Conversely, if Vg<Vn+Vth, the driver TFT Q6 turns off.

The voltage Vda is applied to the cathode of the OLED EL2 while the gate line Gi is at GH; a large difference between Vda and Vcom will cause the OLED EL2 to light. It is hence preferable if Vda does not differ greatly from Vcom.

A simulation was done assuming a certain OLED's characteristics, as well as GL=0 V, GH=16 V, Vcom=0 V, Vp=12 V, Vb=16, Vc=0 V, and Va=8 V. The simulation showed that the driver TFT Q6 turned on at Vda=9 V. Under these conditions, Vg=(Vda+Vth)−Vb+Va=9 V+Vth−16 V+8 V=1 V+Vth. The driver TFT Q6 turned off at Vda=6 V. Now, Vg=(Vda+Vth)−Vb+Va=6 V+Vth−16 V+8 V=−2 V+Vth.

At Vda as low as 6 V, the OLED EL2 hardly lit. This is because the simulation specified a high light-on voltage for the OLED. However, even when the light-on voltage of the OLED is low, the OLED EL2 hardly lights with the switching TFT Q9 turned on, if Vcom is properly regulated.

Figure 16:
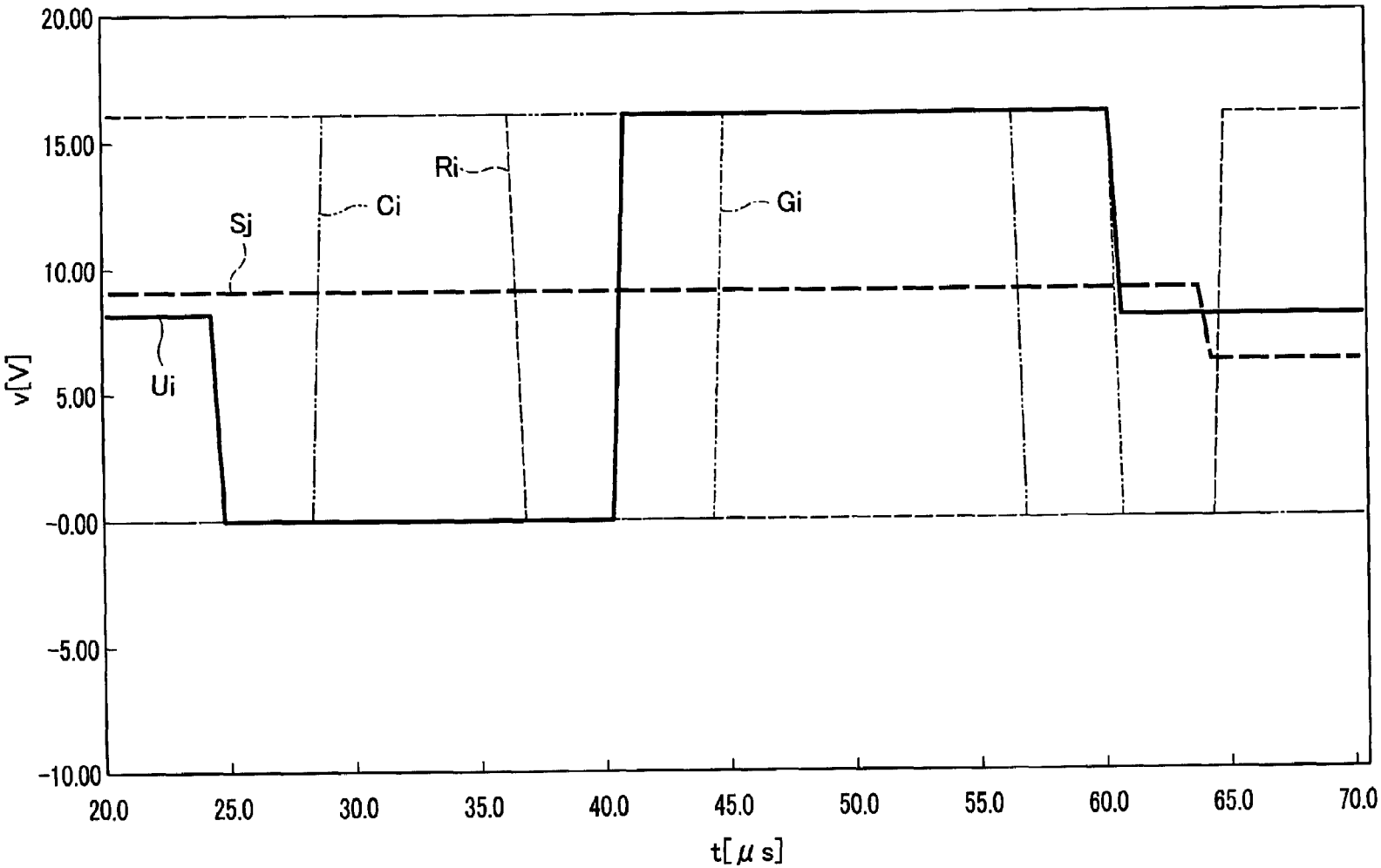
FIG. 16 is a graphical representation of simulated voltages on Sj, Gi, Ci, Ui, and Ri in the FIG. 14 pixel circuit.
Figure 17:
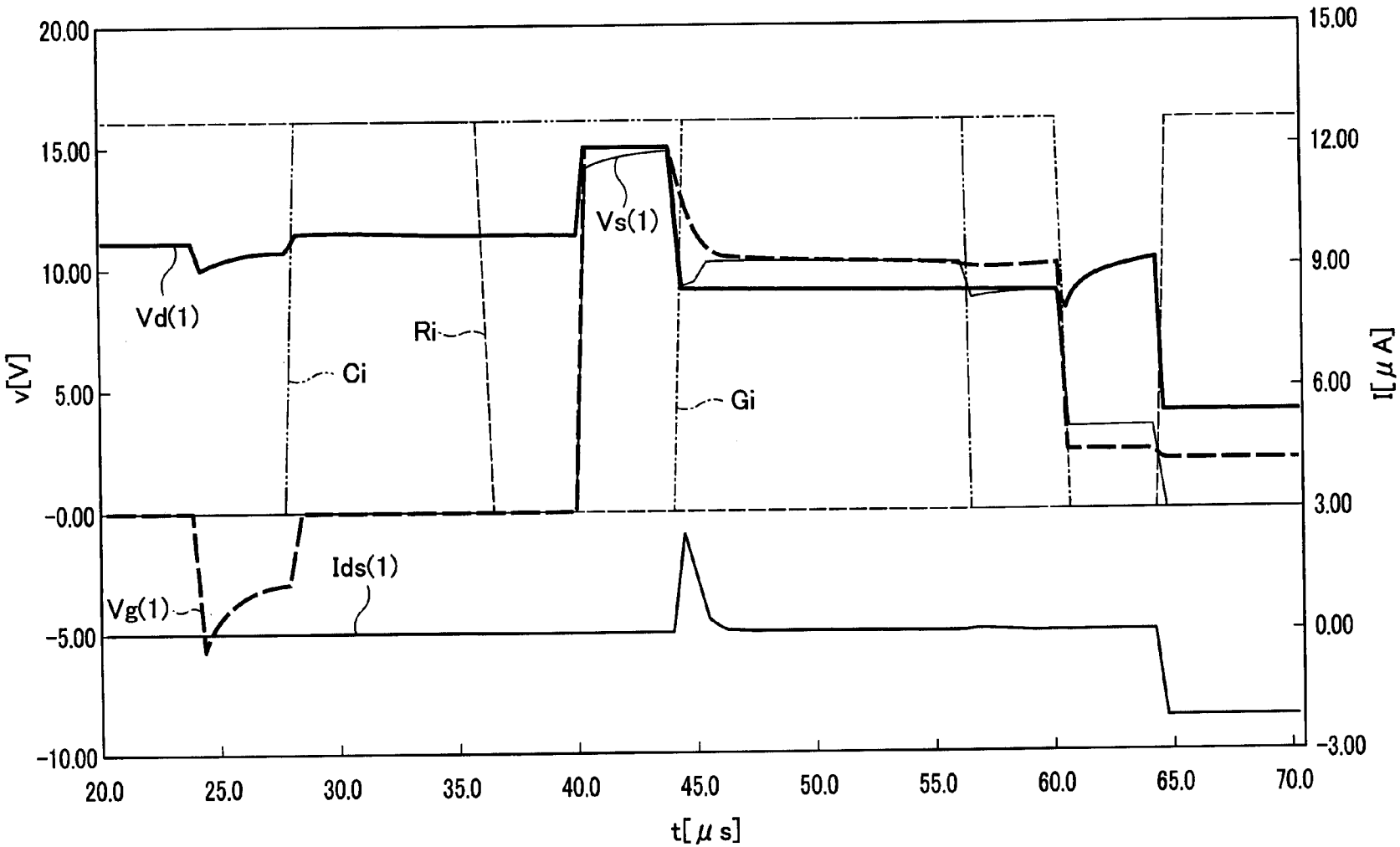
FIG. 17 is a graphical representation of the simulated gate voltage Vg, source voltage Vs, drain voltage Vd, and source-to-drain current Ids of a driver TFT in the FIG. 14 pixel circuit.
Figure 18:
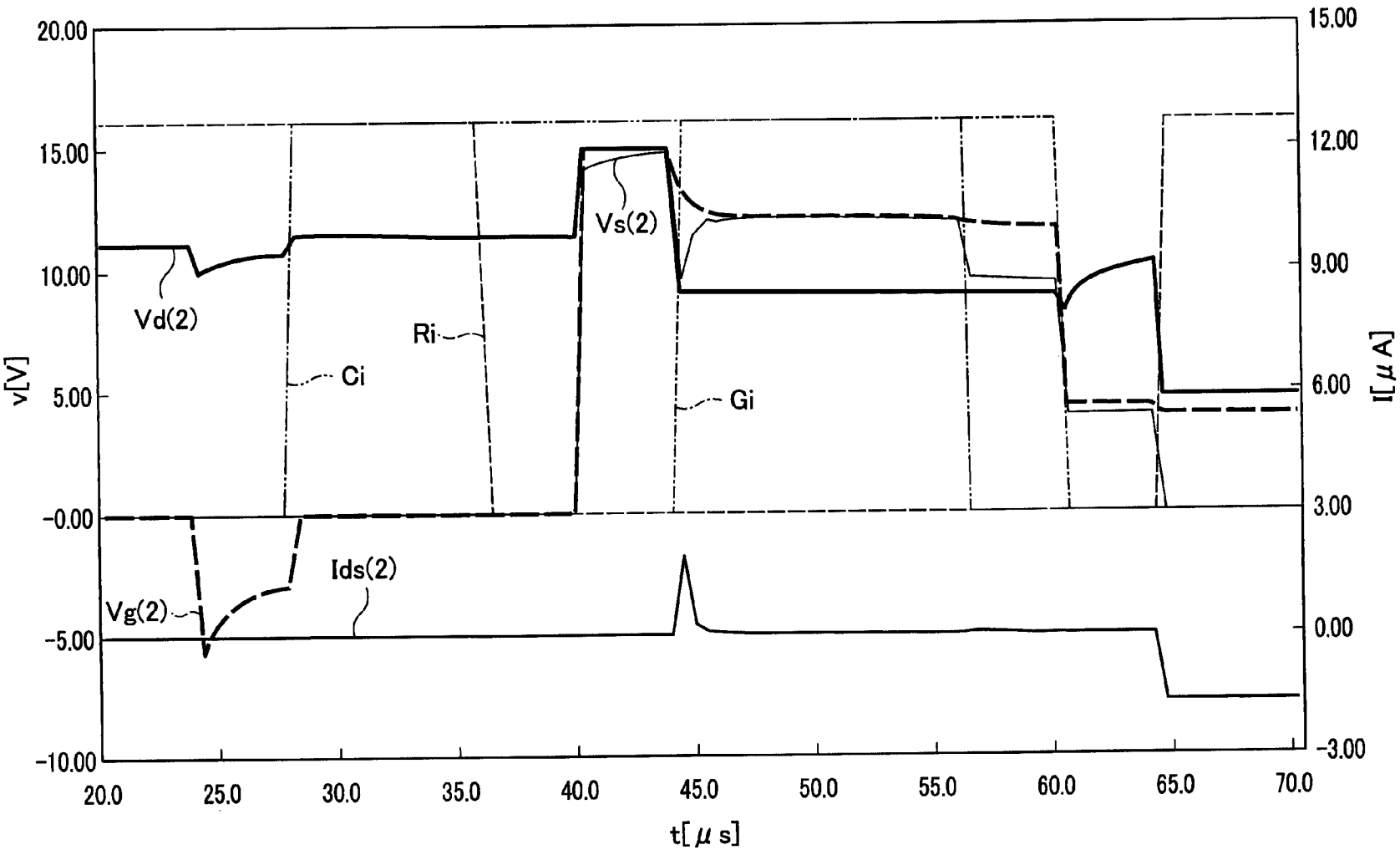
FIG. 18 is another graphical representation of the simulated gate voltage Vg, source voltage Vs, drain voltage Vd, and source-to-drain current Ids of a driver TFT in the FIG. 14 pixel circuit.

FIG. 16 through FIG. 18 show results of the simulation. "(1)" indicates a case where the threshold voltage Vth was a minimum of Vth(min), and the mobility μ was a maximum. "(2)" indicates a case where the threshold voltage Vth was a maximum of Vth(max), and the mobility μwas a minimum.

The figures show that the threshold of the driver TFT Q6 was adjusted from time 44 to 55 μs, rendering Vg(1)=10.22 V and Vg(2)=12.1 V. Since Vda=9 V, it would be understood that Vth was about 1.2 V in case (1) and about 3.1 V in (2).

These threshold voltage variations were no more than the mobility variations of the driver TFT Q16. This can be seen from the current Ids through the driver TFT Q16 which was −2.13 μA in case (1) and −1.67 μA in case (2) after time 65 μs when the electric potential line Ui went to Va.

The present invention enables the adjustment of the threshold of the driver TFT Q6 in this manner. Also, when compared to the pixel circuits discussed in the BACKGROUND OF THE INVENTION, the present invention requires a fewer elements to form a pixel: four TFTs, one capacitor, and one OLED. The invention reduces element counts per pixel, hence pixel size, over the conventional art to accommodate more pixels in a predetermined screen size. The invention allows improvement on image quality.

The TFTs in the pixels are all of n type. A fewer masks are needed, and cost is reduced.

Figure 19:
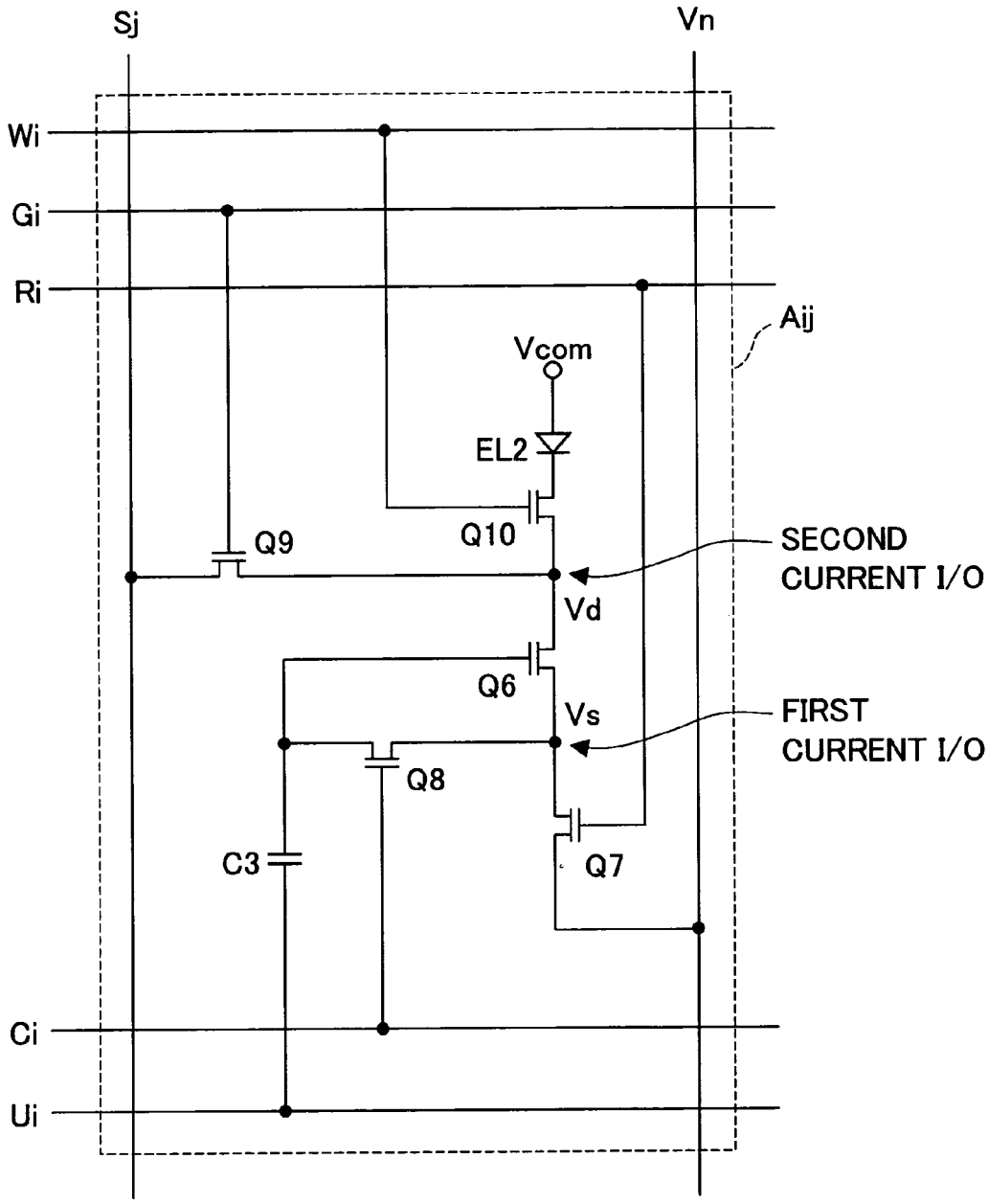
FIG. 19 is a circuit diagram illustrating another pixel circuit structure for embodiment 3.

While the gate line Gi is at GH, the voltage Vda is applied to the cathode of the OLED. But, the anode of the OLED voltage Vcom and the voltage Vda on the source line Sj are specified so that the OLED hardly lights as discussed earlier. If one finds the small current still annoying or wants to specify the voltage Vda on the source line Sj more freely, a fourth switching TFT Q10 will present a satisfactory solution. The fourth switching TFT Q10 is another n-type TFT provided between the drain of the driver TFT Q6 and the cathode of the OLED EL2 as shown in FIG. 19.

Figure 20:
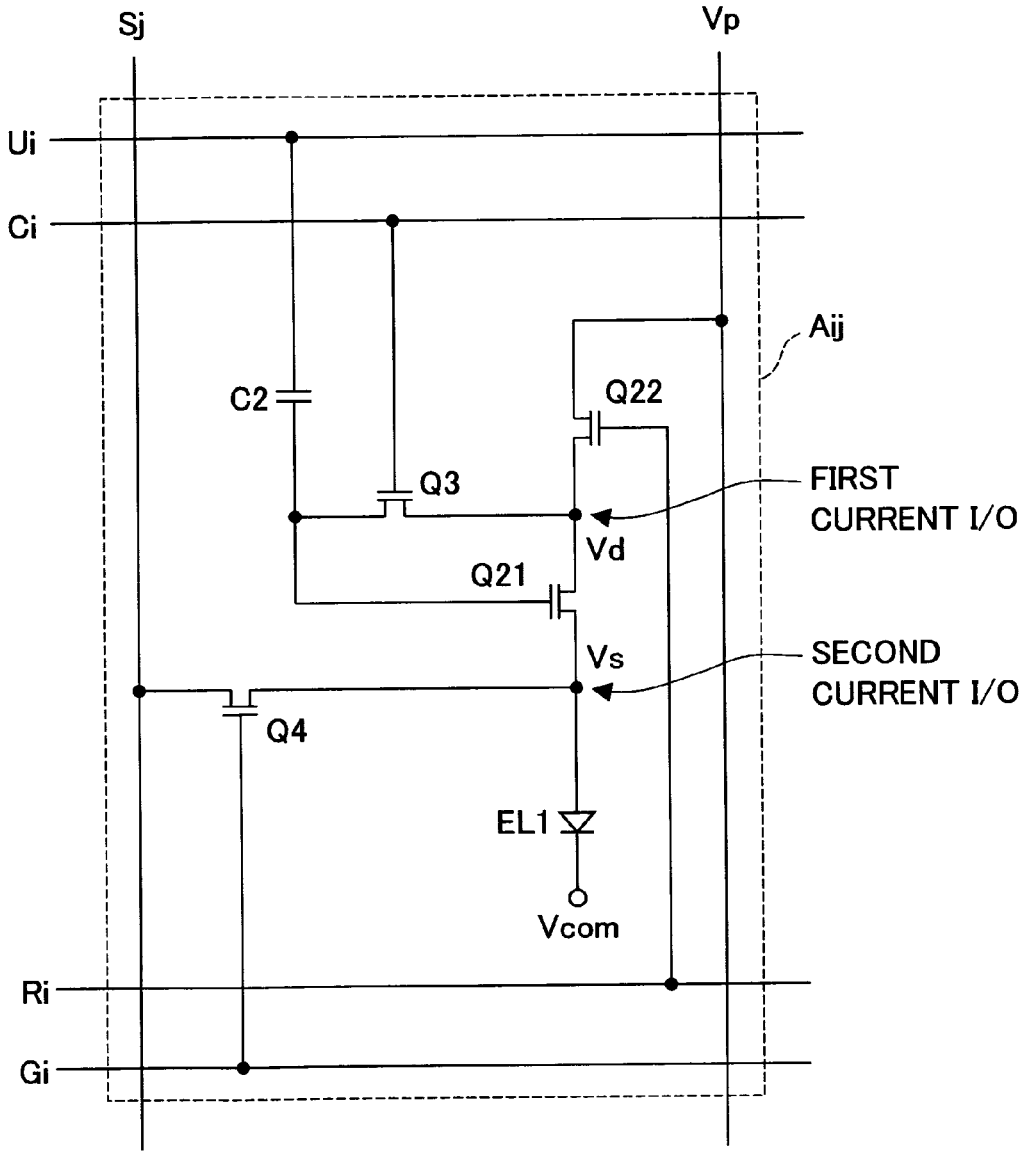
FIG. 20 is a circuit diagram illustrating a further pixel circuit structure for embodiment 3.

To form a pixel from only n-type TFTs, one can replace the driver TFT Q1 and the switching TFT Q2 in the FIG. 2 pixel circuit structure with n-type equivalents. The structure is shown in FIG. 20. In this structure, the source voltage of a driver TFT Q21, hence the current flow through the driver TFT Q21, may vary due to the volt-ampere characteristic of the OLED EL1. The FIG. 20 structure is nevertheless still usable if the characteristic of the OLED EL1 is stable. Drive timings for the structure are the same as in FIG. 15.

Figure 21:
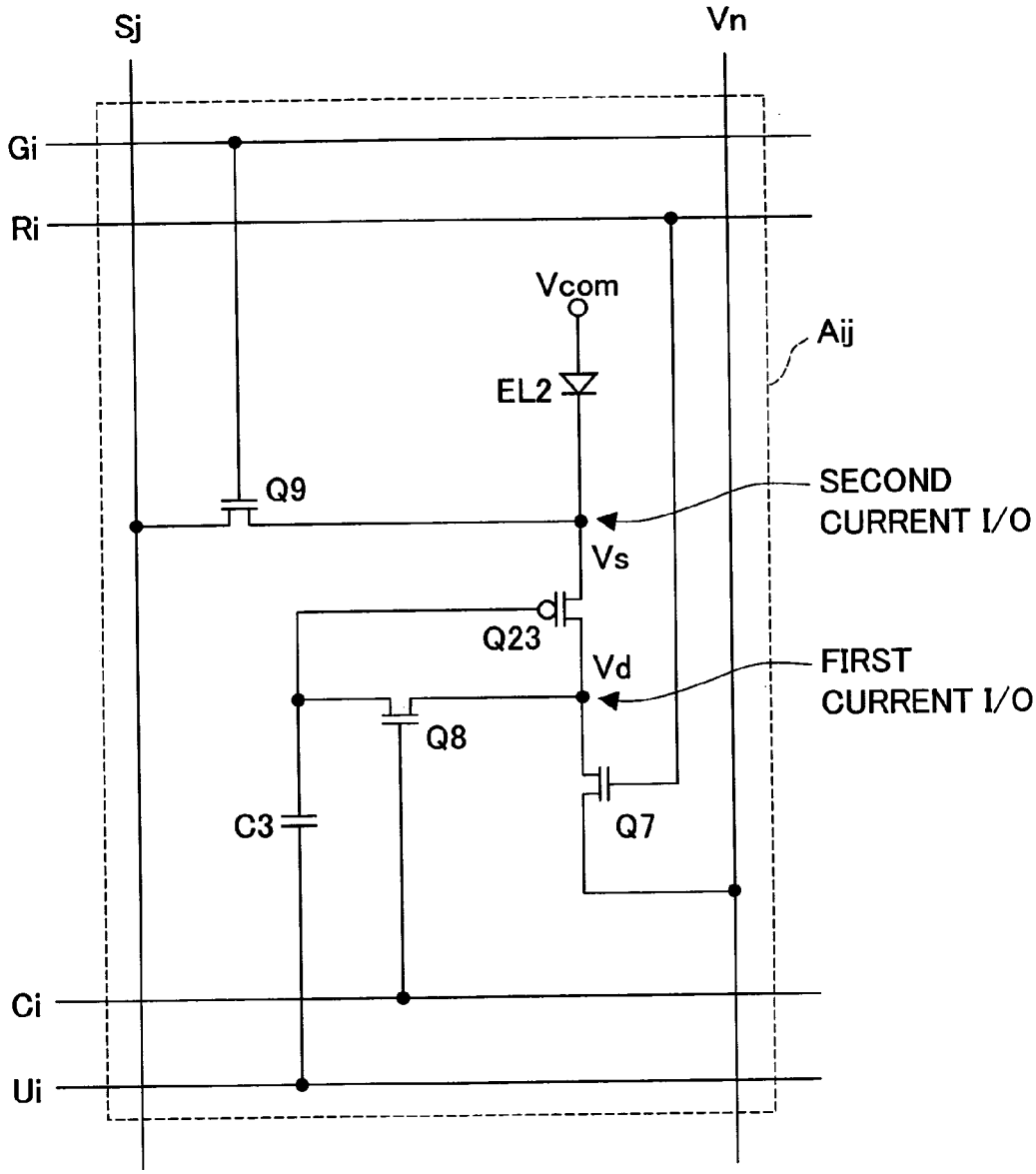
FIG. 21 is a circuit diagram illustrating still another pixel circuit structure for embodiment 3.

Conversely, one can replace the driver TFT Q6 in the FIG. 14 pixel circuit structure with a p-type equivalent to form a pixel as in FIG. 21. Similarly to the foregoing case, the current flow through a driver TFT Q23 varies due to the volt-ampere characteristic of the OLED EL2. The FIG. 21 structure is nevertheless still usable if the characteristic of the OLED EL2 is stable. Drive timings for this structure are the same as in FIG. 3.

Embodiment 4

Figure 22:
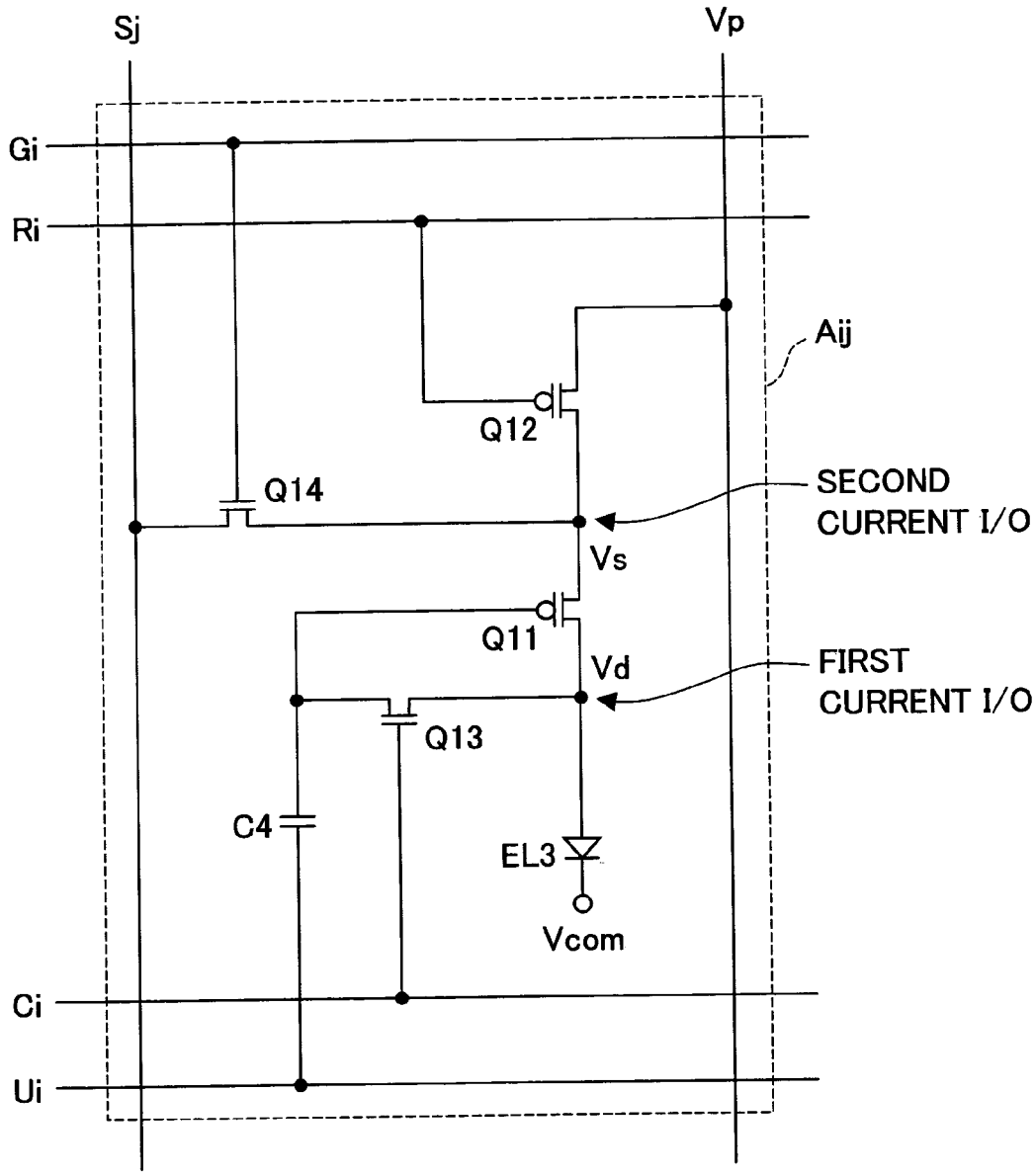
FIG. 22 is a circuit diagram illustrating a pixel circuit structure for embodiment 4.

Present embodiment 4 will describe fourth example of the display device in accordance with the present invention. The display device 1 of the present embodiment is the same as the display device 1 shown in FIG. 1; its description is not repeated here. FIG. 22 shows a pixel circuit structure in accordance with the present invention for present embodiment 4.

The illustrated pixel circuit Aij has a driver TFT (driver transistor) Q11 and a switching TFT (first switching transistor) Q12 connected in series between an OLED (electro-optical element) EL3 and a power supply line Vp.

Between the gate of the driver TFT Q11 and the electric potential line Ui is there provided a capacitor (first capacitor) C4. Between the drain (first current input/output terminal) and the gate of the driver TFT Q11 is there provided a switching TFT (second switching transistor) Q13.

A switching TFT (third switching transistor) Q14 is present between the source (second current input/output terminal) of the driver TFT Q11 and the source line Sj.

The OLED EL3 (electro-optical element) is connected to the drain (first current input/output terminal) of the driver TFT Q11.

In the FIG. 22 pixel circuit, the driver TFT Q11 and the switching TFT Q12 are of p type. The switching TFTs Q13, Q14 are of n type.

The gates of these switching TFTs Q12, Q13, Q14 are connected to the control lines Ri, Ci and the gate line Gi.

The timing chart for the FIG. 22 pixel circuit Aij is the same as the one in FIG. 3 of embodiment 1. Referring to the timing chart, the following will further describe the embodiment.

From time 0 to 16*t*1 is a select period for the pixel Aij. Voltage on the electric potential line Ui goes from Va to Vb at time 0.

At time t1, the control line Ci switches to GH (HIGH), turning on the switching TFT Q13. This short-circuits the gate and drain (first current input/output terminal) of the driver TFT Q11. The gate voltage becomes equal to Vp+Vth−α (Vth<0; α>0). The driver TFT Q11 is turned on (α is a voltage indicating an ON state).

At time 2*t*1, the control line Ri switches to GH, turning off the switching TFT Q12.

The gate line Gi then switches to GH, turning on the switching TFT Q14. Hence, the voltage Vda on the source line Sj is applied to the source (second current input/output terminal) of the driver TFT Q11.

Since Vda<Vp+Vth or Vda=Vp+Vth, the driver TFT Q11 turns off.

However, as the electric potential line Ui goes from the voltage Vb to Vc, the gate voltage of the driver TFT Q11 becomes lower than the voltage Vcom, turning on the driver TFT Q11. This allows a current flow from the source line Sj through the switching TFT Q14, the driver TFT Q11, and the switching TFT Q13 to the gate of the driver TFT Q11. Under these conditions, an inverse voltage is applied across the OLED EL3. The current flows until the gate voltage of the driver TFT Q11 reaches a threshold voltage. The gate voltage of the driver TFT Q11 is therefore Vda+Vth (Vth<0).

At time 12*t*1, the control line Ci switches to GL (LOW), turning off the switching TFT Q13. Thus, the capacitor C4 retains the gate voltage of the driver TFT Q11 at (Vda+Vth)−Vc.

Subsequently, the gate line Gi switches to GL, turning off the switching TFT Q14. The electric potential line Ui then goes from Vc to Va. The control line Ri switches to GL, turning on the switching TFT Q12.

Hence, the voltage Vp is applied to the source of the driver TFT Q11. The gate voltage Vg of the driver TFT Q11 equals (Vda+Vth)−Vc+Va. Accordingly, if Vg<Vp+Vth, the driver TFT Q11 turns on. Conversely, if Vg>Vp+Vth, the driver TFT Q11 turns off.

The voltage Vda+Vth is applied to the anode of the OLED EL3 while the gate line Gi is at GH. Since Vth<0, a moderate range of Vda does not cause the OLED EL3 to light.

Incidentally, it is preferable if Vda does not differ greatly from Vcom.

A simulation was done assuming a certain OLED's characteristics, as well as GL=−4 V, GH=12 V, Vcom=0 V, Vp=12 V, Vb=12, Vc=−4 V, and Va=7 V. The simulation showed that the driver TFT Q11 turned on at Vda=0.5 V. Under these conditions, Vg=(Vda+Vth)−Vc+Va=0.5 V+Vth−(−4) V+7 V=11.5 V+Vth. At this Vg, the driver TFT Q11 turns on when the source Vs is voltage Vp=12 V. The driver TFT Q1 turned off at Vda=2 V. Now, Vg=(Vda+Vth)−Vc+Va=2 V+Vth−(−4) V+7 V=13 V+Vth. At this Vg, the driver TFT Q11 turns off when the source Vs is voltage Vp=12 V.

At Vda as low as 2 V, the OLED EL1 hardly lit. This is because the simulation specified a high light-on voltage for the OLED. However, even when the light-on voltage of the OLED is low, the OLED EL1 hardly lights with the switching TFT Q14 turned on, if Vcom is properly regulated.

Figure 23:
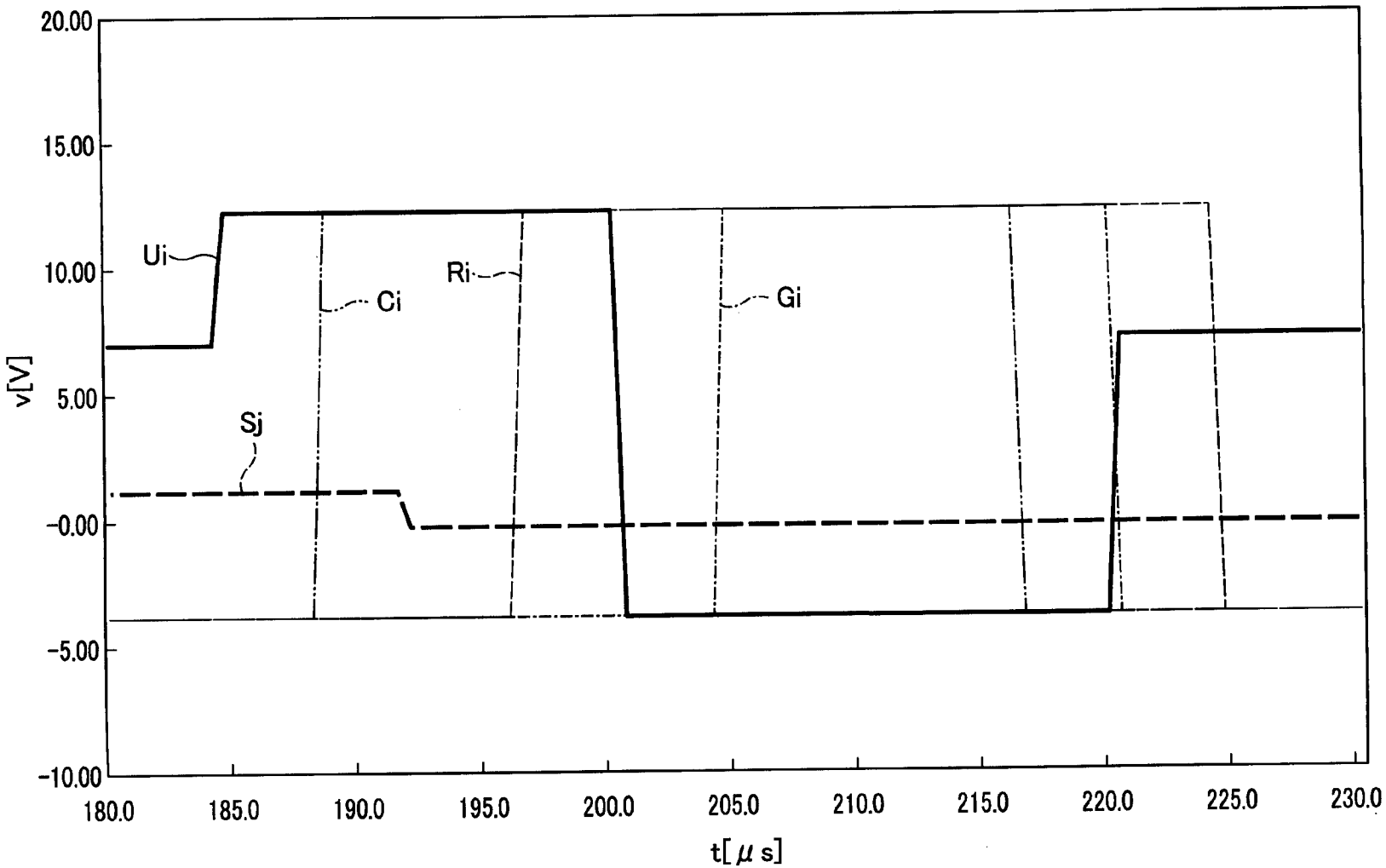
FIG. 23 is a graphical representation of simulated voltages on Sj, Gi, Ci, Ui, and Ri in the FIG. 22 pixel circuit.
Figure 24:
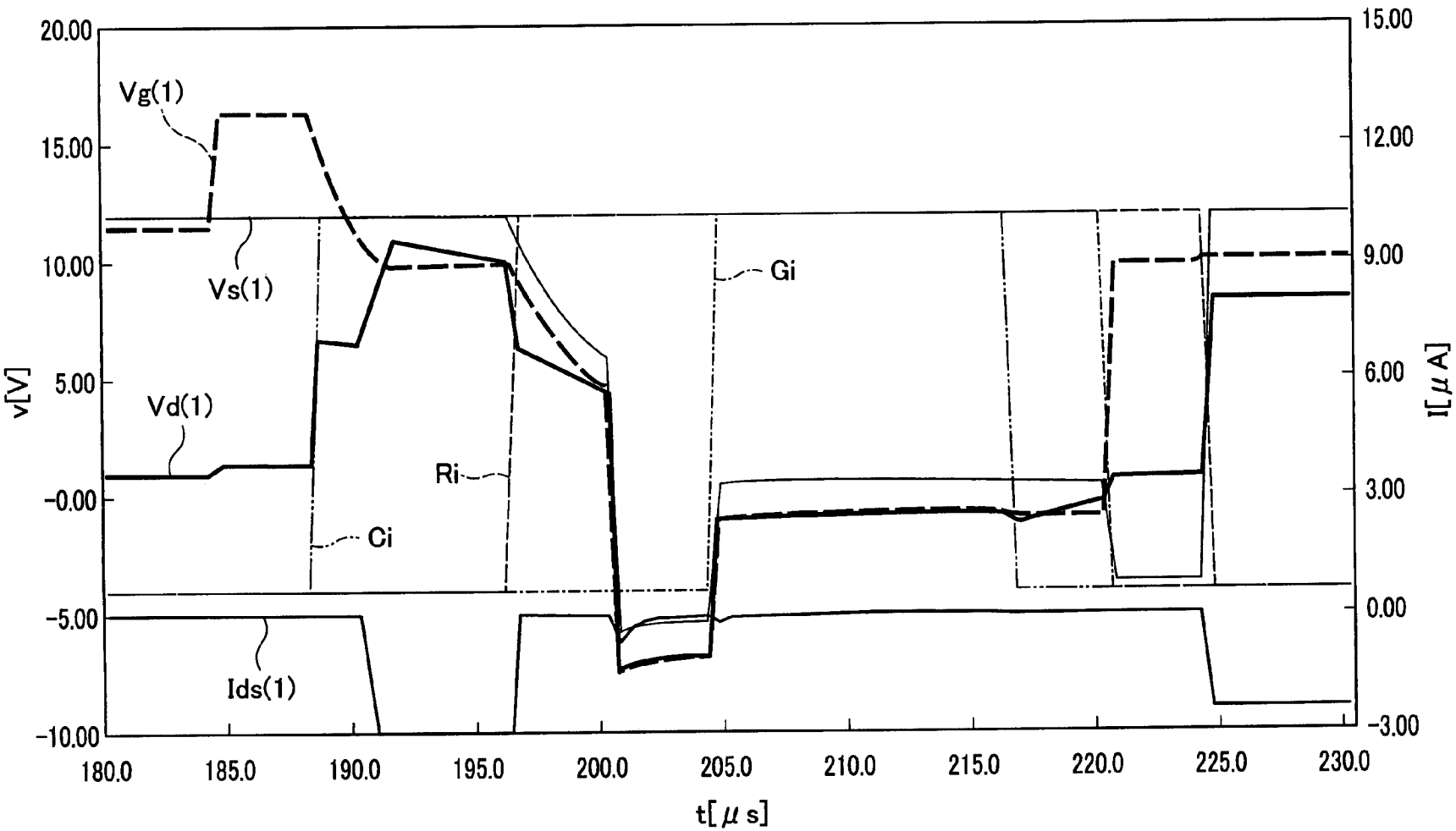
FIG. 24 is a graphical representation of the simulated gate voltage Vg, source voltage Vs, drain voltage Vd, and source-to-drain current Ids of a driver TFT in the FIG. 22 pixel circuit.
Figure 25:
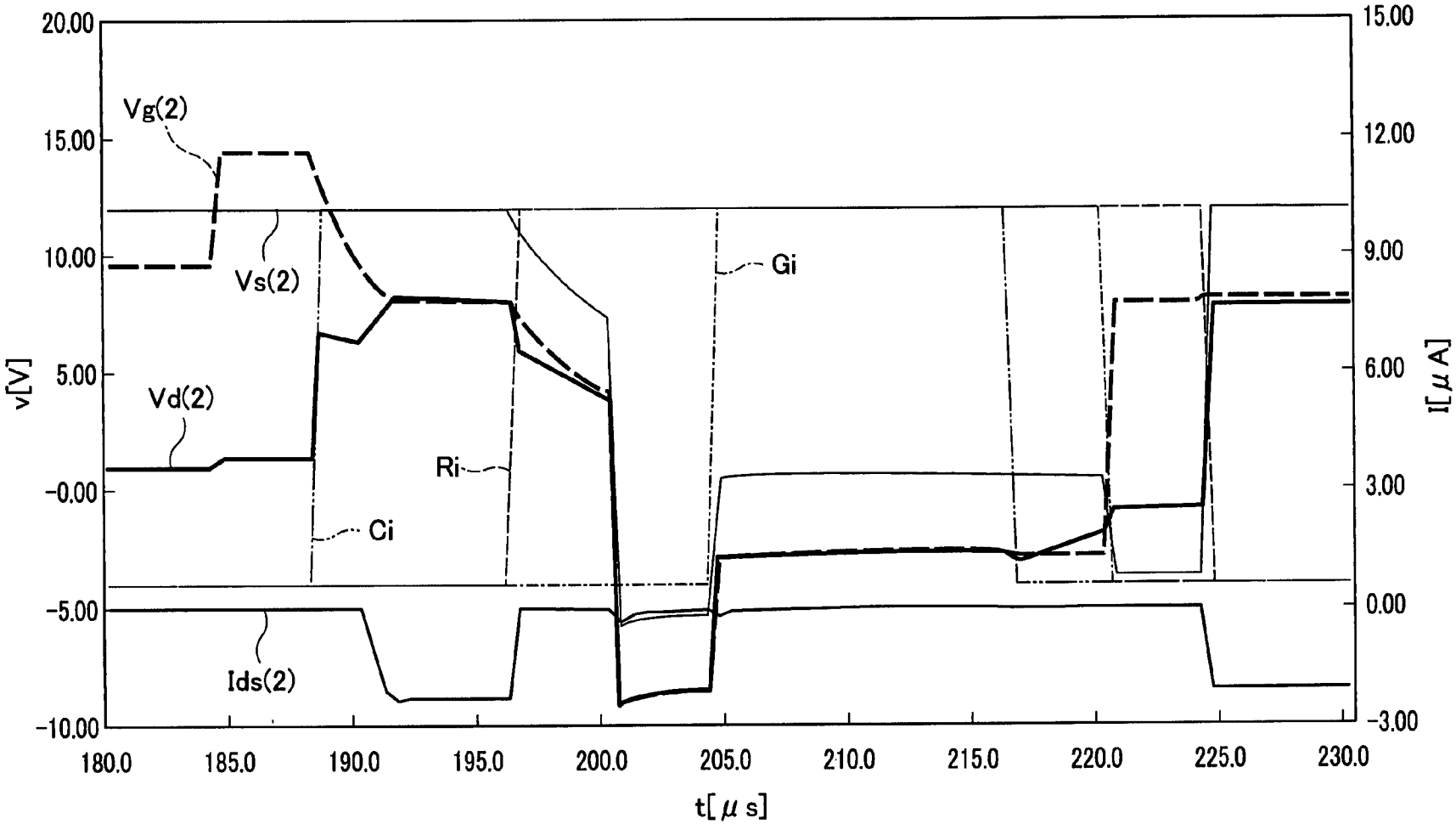
FIG. 25 is another graphical representation of the simulated gate voltage Vg, source voltage Vs, drain voltage Vd, and source-to-drain current Ids of a driver TFT in the FIG. 22 pixel circuit.

FIG. 23 through FIG. 25 show results of the simulation. "(1)" indicates a case where the absolute value of the threshold voltage Vth was a minimum of Vth(min), and the mobility μ was a maximum. "(2)" indicates a case where the absolute value of the threshold voltage Vth was a maximum of Vth (max), and the mobility μ was a minimum.

The figures show that the threshold of the driver TFT Q11 was adjusted from time 204 to 216 μs, rendering Vg(1)=−0.77 V and Vg(2)=−2.63 V. Since Vda=0.5 V, it would be understood that Vth was about −1.2 V in case (1) and about −3.1 V in case (2).

These threshold voltage variations were no more than the mobility variations of the driver TFT Q11. This can be seen from the current Ids through the driver TFT Q11 which was −2.39 μA in case (1) and −2.08 μA in case (2) after time 225 μs when the electric potential line Ui went to Va.

The present invention enables the adjustment of the threshold of the driver TFT Q11 in this manner. Also, when compared to the pixel circuits discussed in the BACKGROUND OF THE INVENTION, the present invention requires a fewer elements to form a pixel: four TFTs, one capacitor, and one OLED. The invention reduces element counts per pixel, hence pixel size, over the conventional art to accommodate more pixels in a predetermined screen size. The invention allows improvement on image quality.

Figure 26:
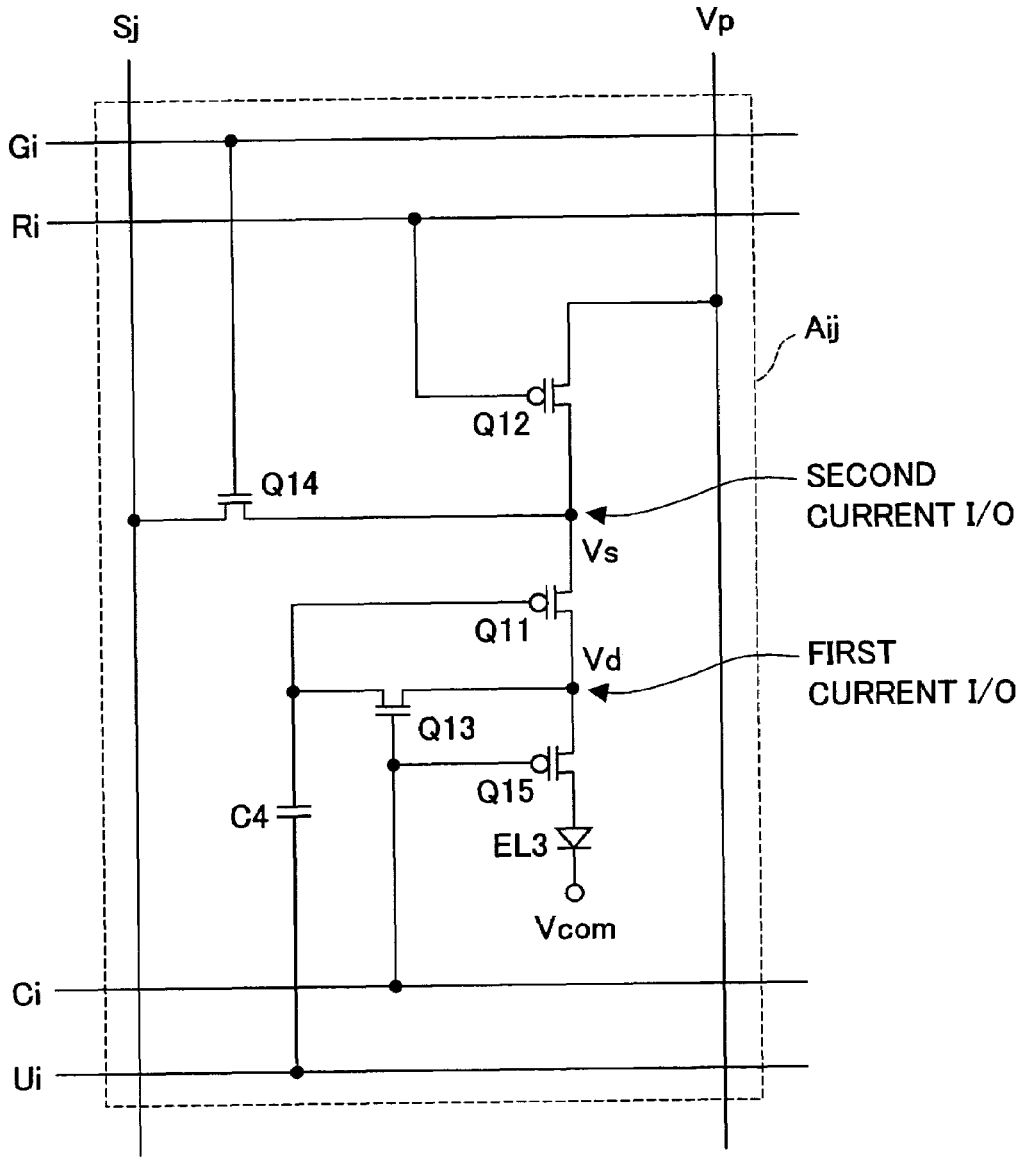
FIG. 26 is a circuit diagram illustrating another pixel circuit structure for embodiment 4.

From when the control line Ci switches to GH until the control line Ri switches to GL, the voltage Vp+Vth (Vth<0) is applied to the anode of the OLED. If one finds the current flow generated under these conditions annoying, a fourth switching TFT Q15 will present a satisfactory solution. The fourth switching TFT Q15 is a p-type TFT provided between the drain of the driver TFT Q11 and the anode of the OLED EL3 as shown in FIG. 26. The gate of the switching TFT Q15 can be connected to the gate line Ci.

Embodiment 5

Figure 27:
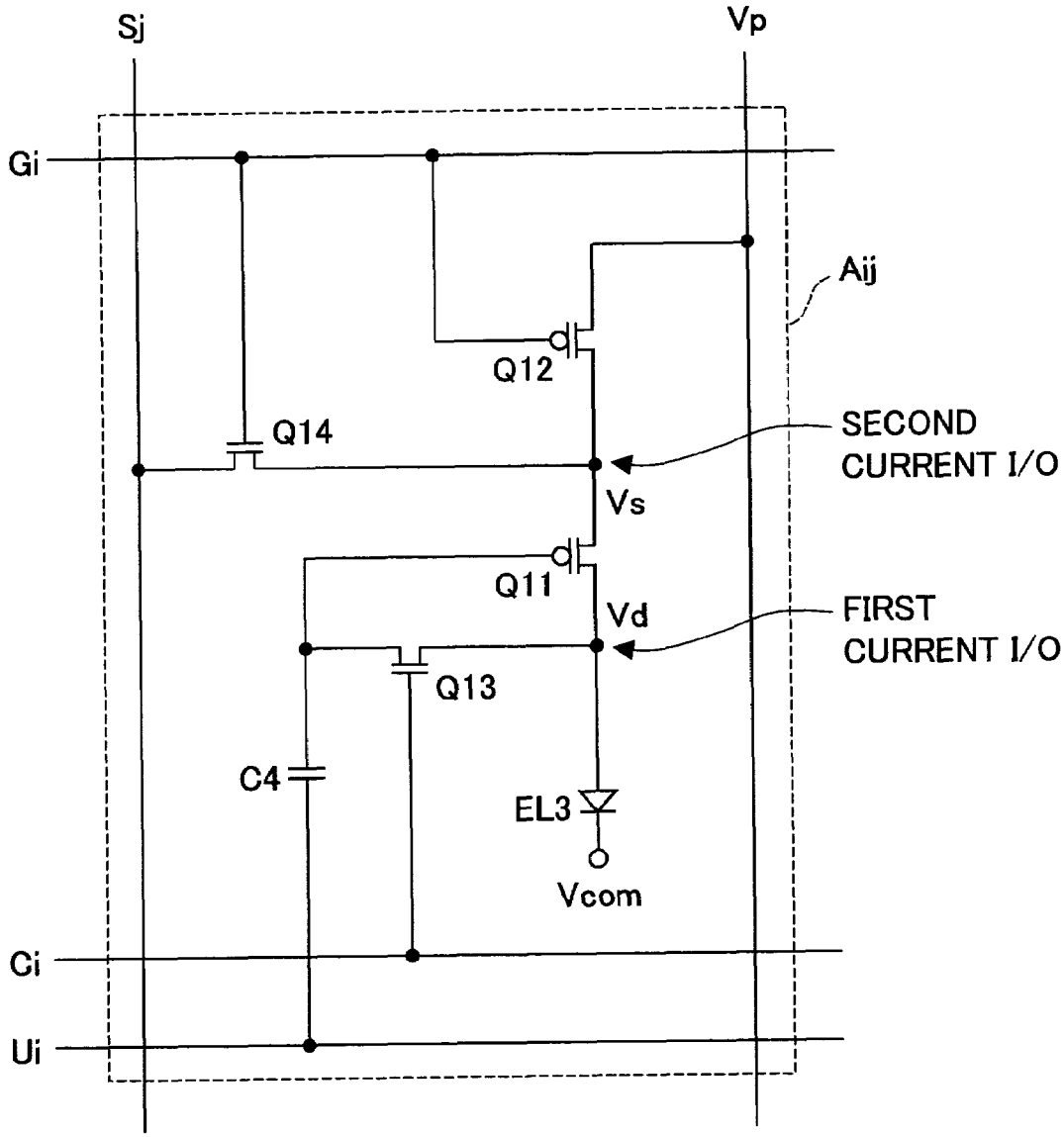
FIG. 27 is a circuit diagram illustrating a pixel circuit structure for embodiment 5.

Present embodiment 5 will describe a fifth example of the display device in accordance with the present invention. The display device 1 of the present embodiment is again the same as the display device 1 shown in FIG. 1; its description is not repeated here. FIG. 27 shows a pixel circuit structure in accordance with the present invention for present embodiment 5.

The illustrated pixel circuit Aij has a gate line Gi replacing and acting as both the control line Ri and gate line Gi in FIG. 22. Otherwise, the pixel circuit Aij is identical to the FIG. 22 pixel circuit; no more description will be given here.

The timing chart for the FIG. 27 pixel circuit Aij is the same as the one in FIG. 9 of embodiment 2. Referring to the timing chart, the following will further describe the embodiment.

From time 0 to 16*t*1 is a select period for the pixel Aij. Voltage on the electric potential line Ui goes from Va to Vb at time 0.

At time t1, the control line Ci switches to GH (HIGH), turning on the switching TFT Q13. This renders the gate voltage of the driver TFT Q11 equal to Vp+Vth−α (Vth<0; α>0). The driver TFT Q11 is turned on.

At time 3*t*1, the gate line Gi switches to GH, turning off the switching TFT Q12 and turning on the switching TFT Q14. Hence, the voltage Vda on the source line Sj is applied the source (second current input/output terminal) of the driver TFT Q11. Since Vda<Vp+Vth, the driver TFT Q11 turns off.

At time 4*t*1, the electric potential line Ui goes to Vc, lowering the gate voltage of the driver TFT Q11 to turn on the driver TFT Q11. This allows a current flow from the source line Sj through the switching TFT Q14, the driver TFT Q11, and the switching TFT Q13 to the gate of the driver TFT Q11. The current flows until the gate voltage of the driver TFT Q11 reaches a threshold voltage. The gate voltage of the driver TFT Q11 is therefore Vda+Vth (Vth<0).

At time 12*t*1, the control line Ci switches to GL (LOW), turning off the switching. TFT Q13. Thus, the capacitor C4 retains the gate voltage of the driver TFT Q11 at (Vda+Vth)−Vc.

Subsequently, the electric potential line Ui goes to Va. The gate line Gi then switches to GL, turning off the switching TFT Q14 and turning on the switching TFT Q12. Hence, the voltage Vp is applied to the source of the driver TFT Q11. The gate voltage Vg of the driver TFT Q11 equals (Vda+Vth)−Vc+Va. These voltages Vda, Vb, Vc, Va are specified similarly to embodiment 1; its description is not repeated here.

Figure 28:
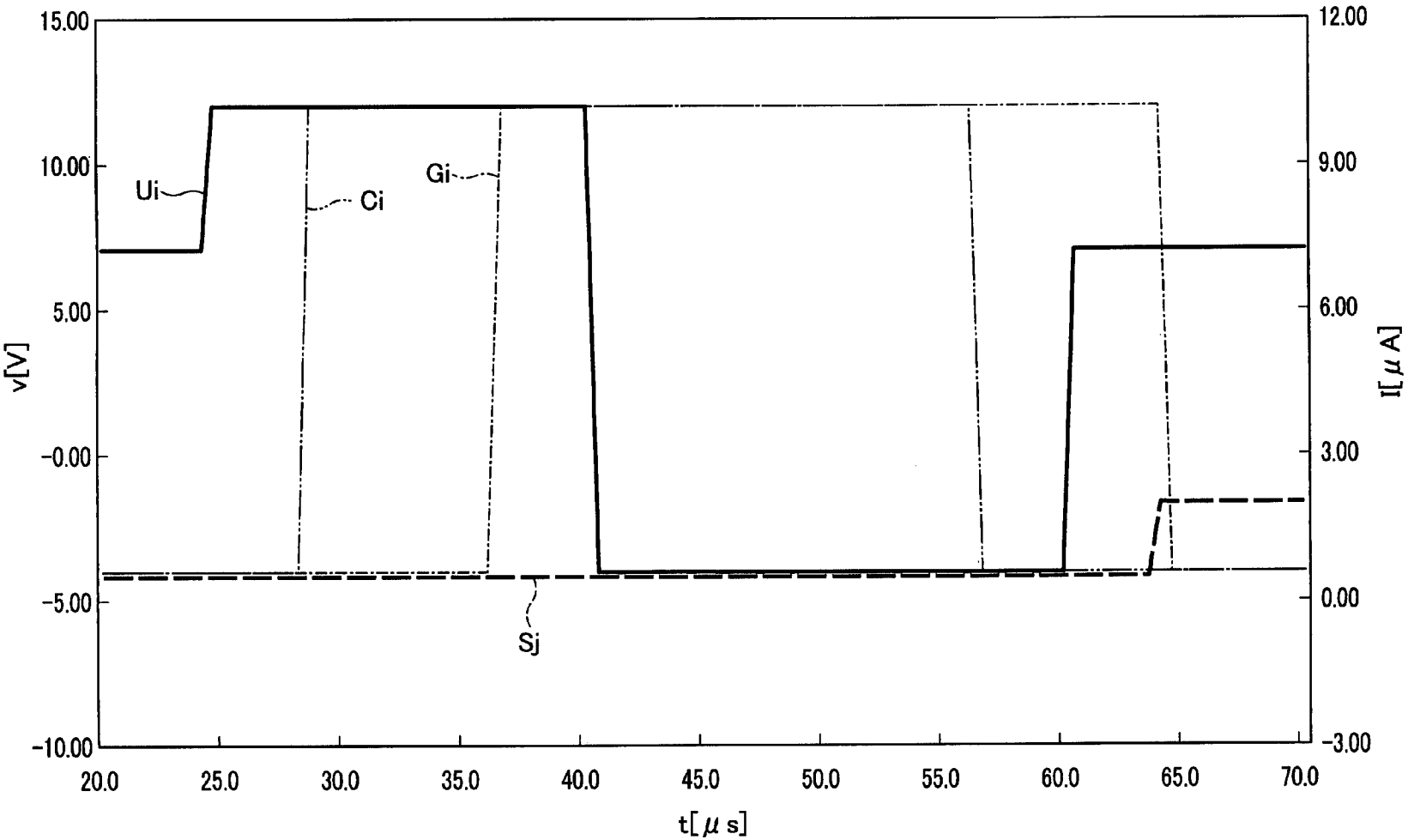
FIG. 28 is a graphical representation of simulated voltages on Sj, Gi, Ci, and Ui in the FIG. 27 pixel circuit.
Figure 29:
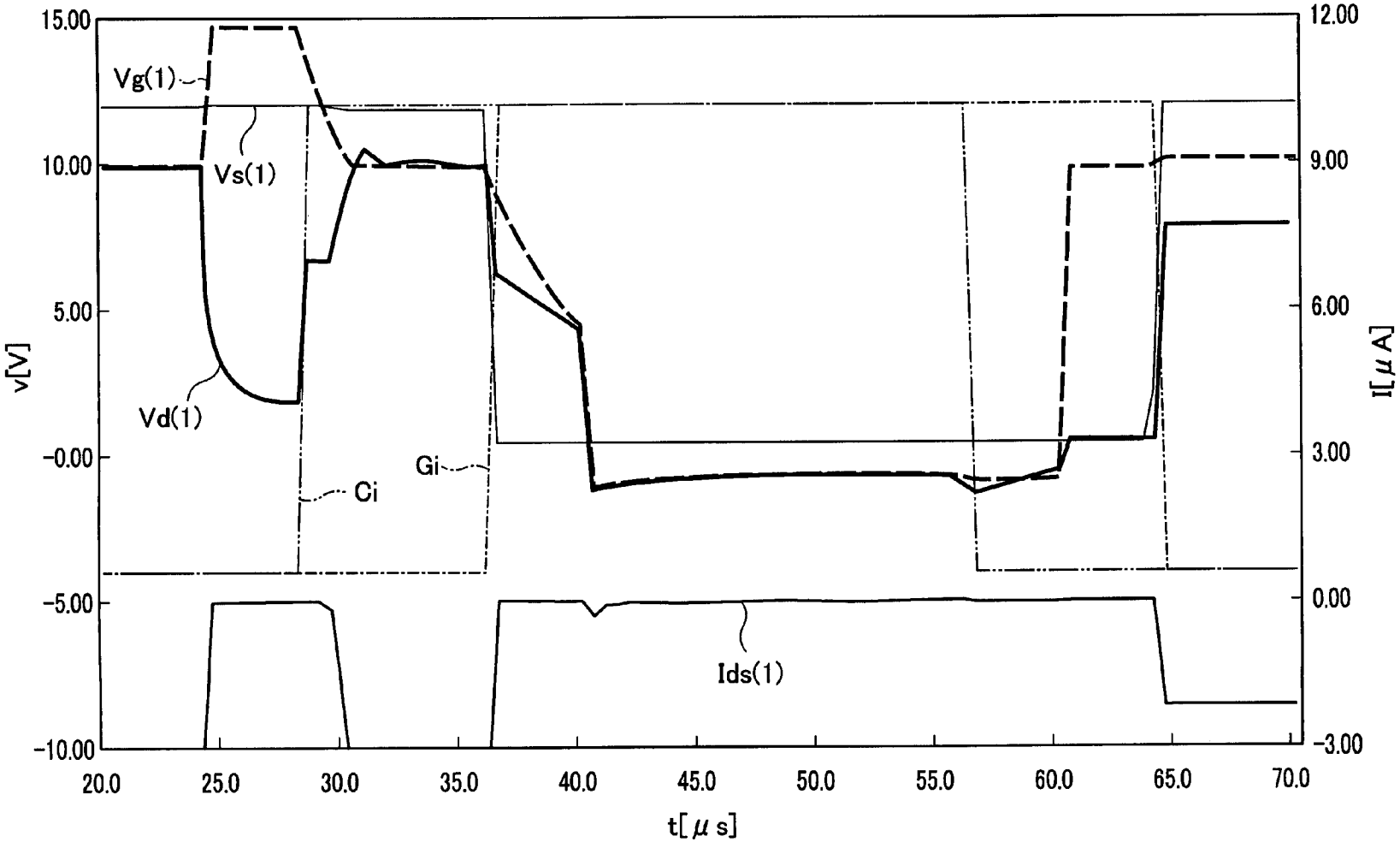
FIG. 29 is a graphical representation of the simulated gate voltage Vg, source voltage Vs, drain voltage Vd, and source-to-drain current Ids of a driver TFT in the FIG. 27 pixel circuit.
Figure 30:
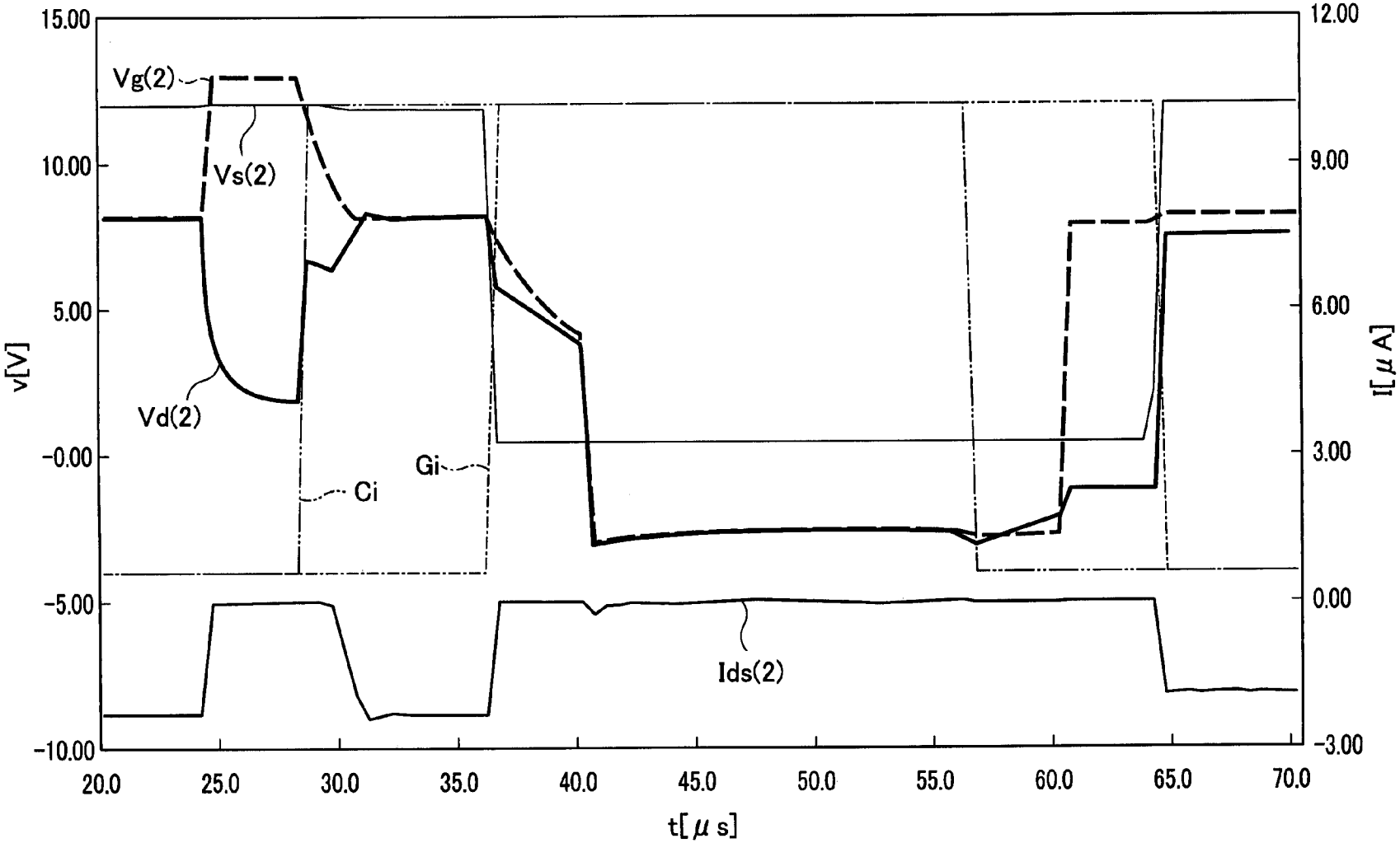
FIG. 30 is another graphical representation of the simulated gate voltage Vg, source voltage Vs, drain voltage Vd, and source-to-drain current Ids of a driver TFT in the FIG. 27 pixel circuit.

FIG. 28 through FIG. 30 show results of the simulation where the FIG. 27 pixel circuit was driven by the timing indicated in FIG. 9. As could be seen from these figures, the results are similar to those shown in FIG. 23 through FIG. 25, even with the switching TFTs Q12, Q14 sharing a common gate line.

This preferred embodiment of the present invention thus reduces element counts per pixel without significantly increasing line counts per pixel. The invention as such reduces element counts per pixel, hence pixel size, over the conventional art to accommodate more pixels in a predetermined screen size. The invention allows improvement on image quality.

Embodiment 6

Figure 31:
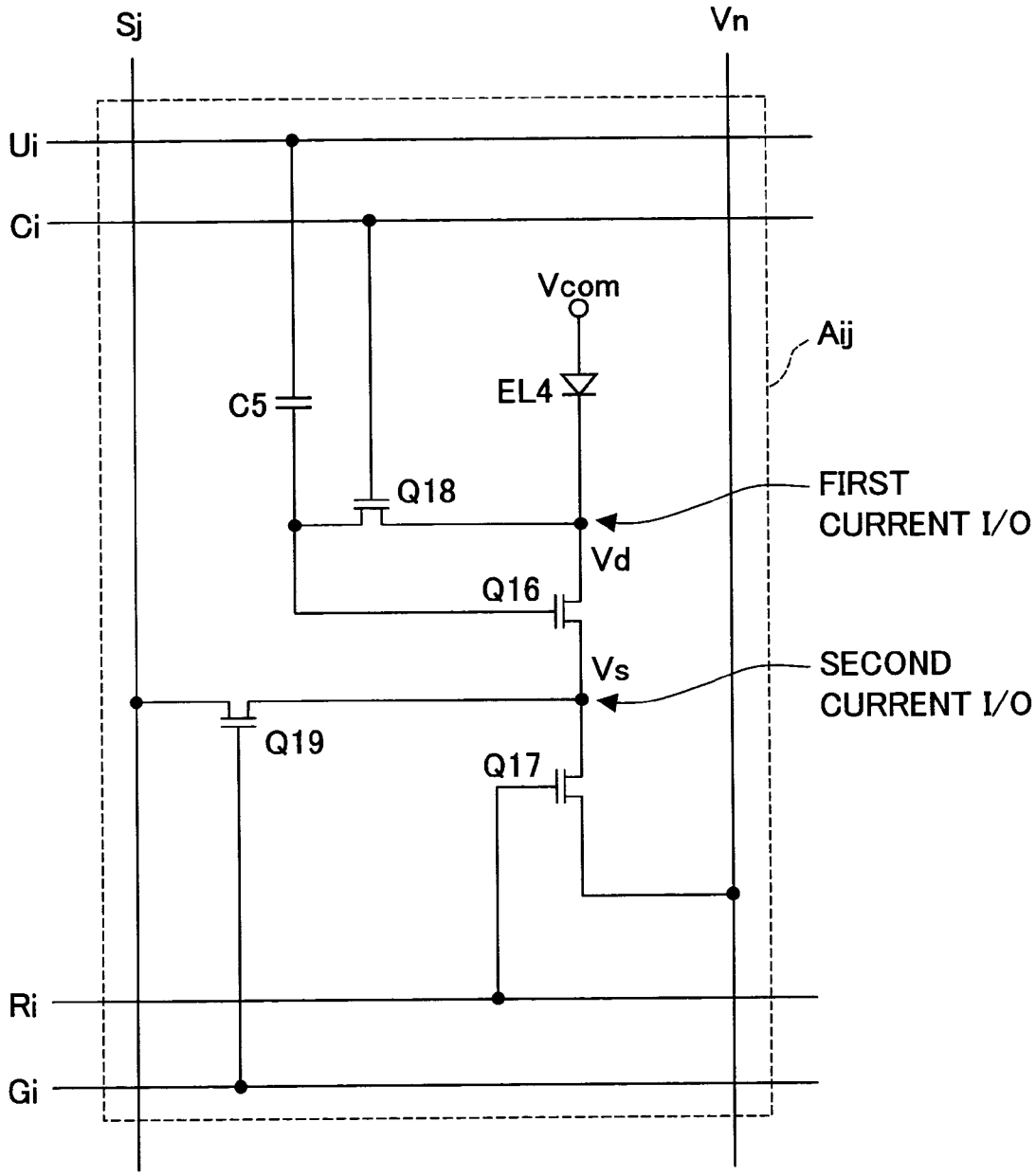
FIG. 31 is a circuit diagram illustrating a pixel circuit structure for embodiment 6.

Present embodiment 6 will describe sixth example of the display device in accordance with the present invention. The display device 1 of the present embodiment is again the same as the display device 1 shown in FIG. 1; its description is not repeated here. FIG. 31 shows a pixel circuit structure in accordance with the present invention for present embodiment 6.

The illustrated pixel circuit Aij has a driver TFT (driver transistor) Q16 and a switching TFT (first switching transistor) Q17 connected in series between an OLED (electro-optical element) EL4 and a power supply line Vn.

Between the gate of the driver TFT Q16 and the electric potential line Ui is there provided a capacitor (first capacitor) C5. Between the drain (first current input/output terminal) and the gate of the driver TFT Q16 is there provided a switching TFT (second switching transistor) Q18.

A switching TFT (third switching transistor) Q19 is present between the source (second current input/output terminal) of the driver TFT Q16 and the source line Sj.

The OLED EL4 (electro-optical element) is connected to the drain (first current input/output terminal) of the driver TFT Q16.

In the FIG. 31 pixel circuit, the driver TFT Q16 and the switching TFTs Q17 to Q19 are all of n type. So, all the switching TFTs can be made from amorphous silicon.

The gate of the switching TFT Q17 is connected to the control line Ri. The gate of the switching TFT Q18 is connected to the control line Ci. The gate of the switching TFT Q19 is connected to the gate line Gi.

Figure 32:
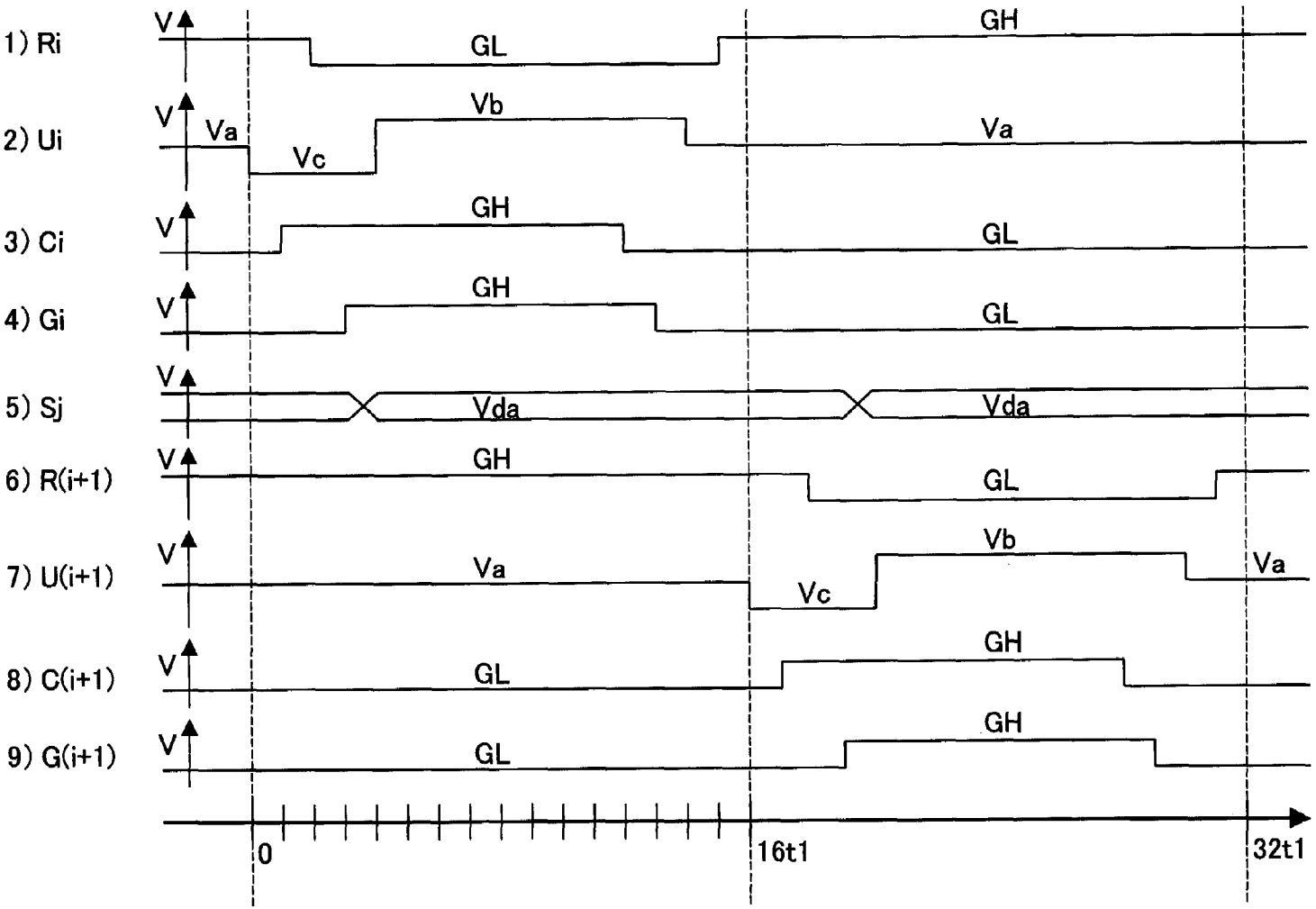
FIG. 32 is a timing diagram illustrating timings given by voltages on lines in the FIG. 31 pixel circuit.

FIG. 32 shows timings indicated by voltages on 1) the control line Ri, 2) the electric potential line Ui, 3) the control line Ci, 4) the gate line Gi, and 5) the source line Sj in the pixel circuit Aij. 6), R(i+1), 7) U(i+1), 8) C(i+1), and 9) G(i+1) are those for an adjacent pixel A(i+1)j.

From time 0 to 16*t*1 is a select period for the pixel Aij. Voltage on the electric potential line Ui goes from Va to Vc at time 0.

At time t1, the control line Ci switches to GH (HIGH), turning on the switching TFT Q18. This renders the gate voltage of the driver TFT Q16 equal to Vn+Vth+β (Vth>0; β>). The driver TFT Q16 is turned on.

At time 2*t*1, the control line Ri switches to GL (LOW), turning off the switching TFT Q17. The gate line Gi then switches to GH, turning on the switching TFT Q19. Hence, the voltage Vda on the source line Sj is applied to the source (second current input/output terminal) of the driver TFT Q16. Since Vda>Vn+Vth, the driver TFT Q16 turns off.

The electric potential line Ui then goes to Vb, increasing the gate voltage of the driver TFT Q16 to turn on the driver TFT Q16. This allows electric charge to flow from the gate of the driver TFT Q16 through the switching TFT Q18, the driver TFT Q16, and the switching TFT Q19 to the source line Sj. The electric charge flows until the gate voltage of the driver TFT Q16 reaches a threshold voltage. The gate voltage of the driver TFT Q16 is therefore Vda+Vth.

At time 12*t*1, the control line Ci switches to GL (LOW), turning off the switching TFT Q18.

Thus, the capacitor C5 retains the gate voltage of the driver TFT Q16 at (Vda+Vth)−Vb.

Subsequently, the gate line Gi switches to GL, turning off the switching TFT Q19. The electric potential line Ui goes to Va, and the control line Ri switches to GH, turning on the switching TFT Q17.

Hence, the voltage Vn is applied to the source of the driver TFT Q16. The gate voltage Vg of the driver TFT Q16 equals (Vda+Vth)−Vb+Va.

Accordingly, if Vg>Vn+Vth, the driver TFT Q16 turns on. Conversely, if Vg<Vn+Vth, the driver TFT Q16 turns off.

The voltage Vda+Vth is applied to the cathode of the OLED EL4 while the gate line Gi is at GH; a large difference between Vda and Vcom will cause the OLED EL4 to light. It is hence preferable if Vda does not differ greatly from Vcom.

A simulation was done assuming a certain OLED's characteristics, as well as GL=0 V, GH=16 V, Vcom=0 V, Vp=12 V, Vb=16, Vc=0 V, and Va=7 V. The simulation showed that the driver TFT Q16 turned on at Vda=10 V. Under these conditions, Vg=(Vda+Vth)−Vb+Va=10 V+Vth−16 V+7 V=1 V+Vth. The driver TFT Q16 turned off at Vda=8 V. Now, Vg=(Vda+Vth)−Vb+Va=8 V+Vth−16 V+7 V=−1 V+Vth.

Figure 33:
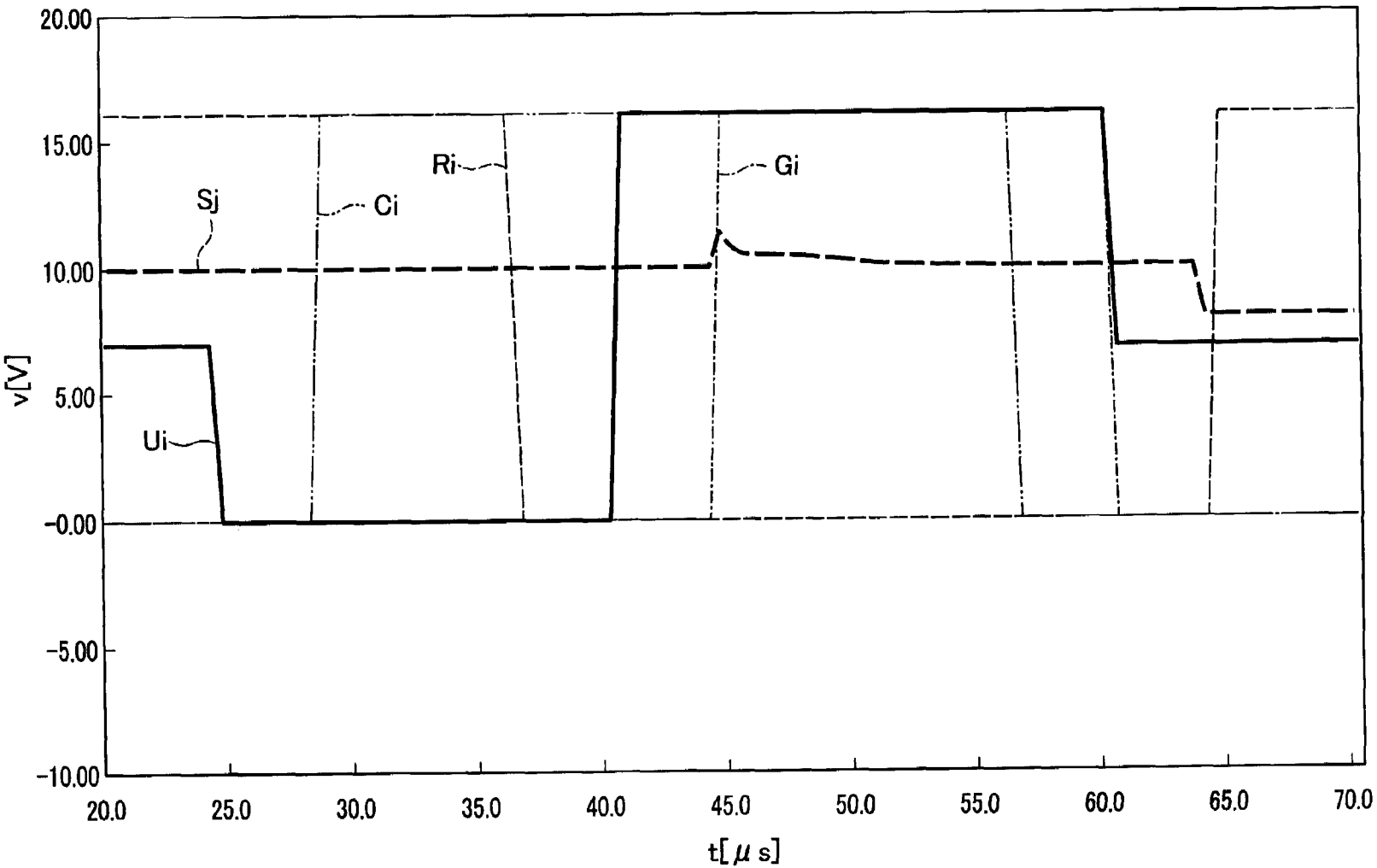
FIG. 33 is a graphical representation of simulated voltages on Sj, Gi, Ci, Ui, and Ri in the FIG. 31 pixel circuit.
Figure 34:
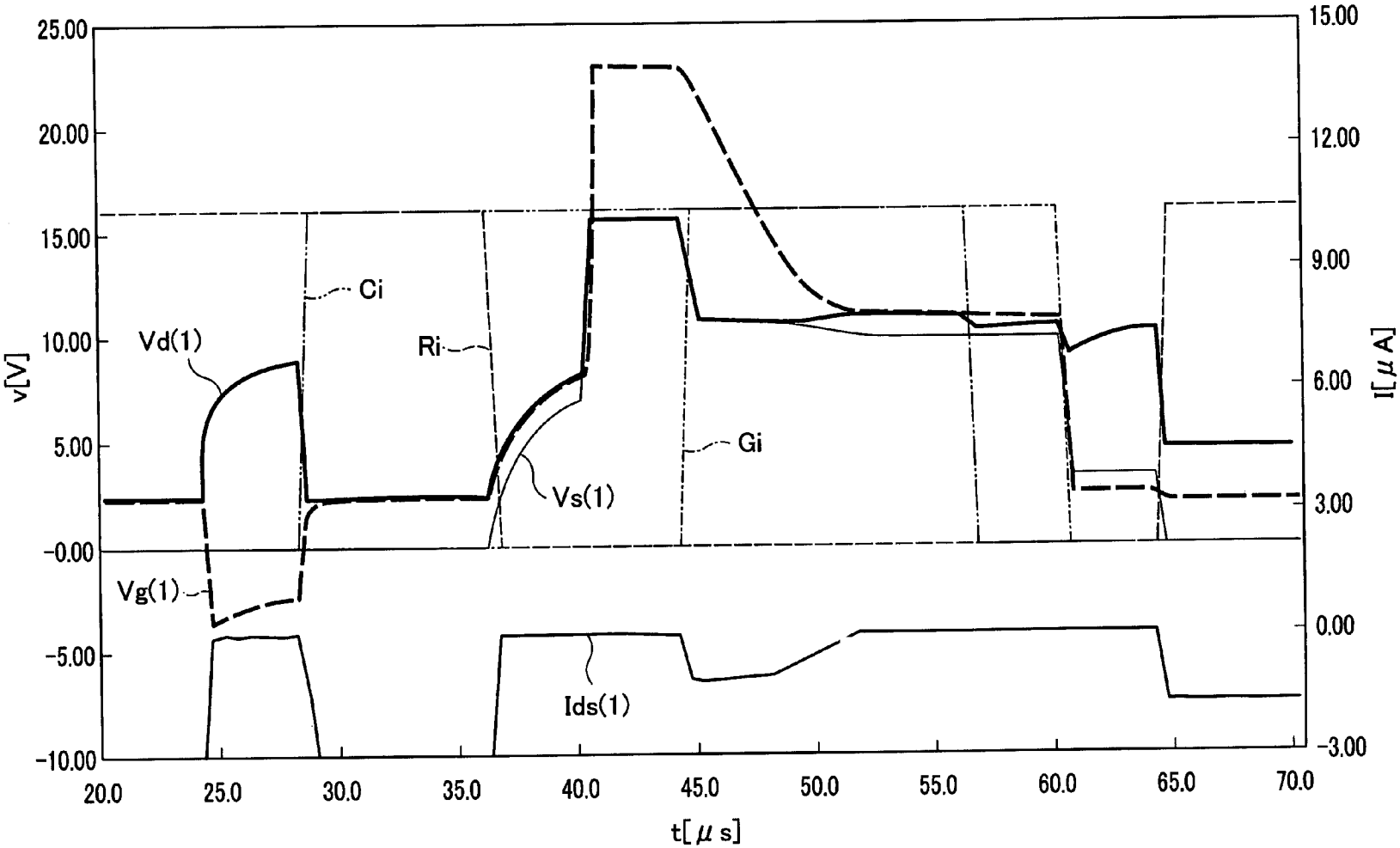
FIG. 34 is a graphical representation of the simulated gate voltage Vg, source voltage Vs, drain voltage Vd, and source-to-drain current Ids of a driver TFT in the FIG. 31 pixel circuit.
Figure 35:
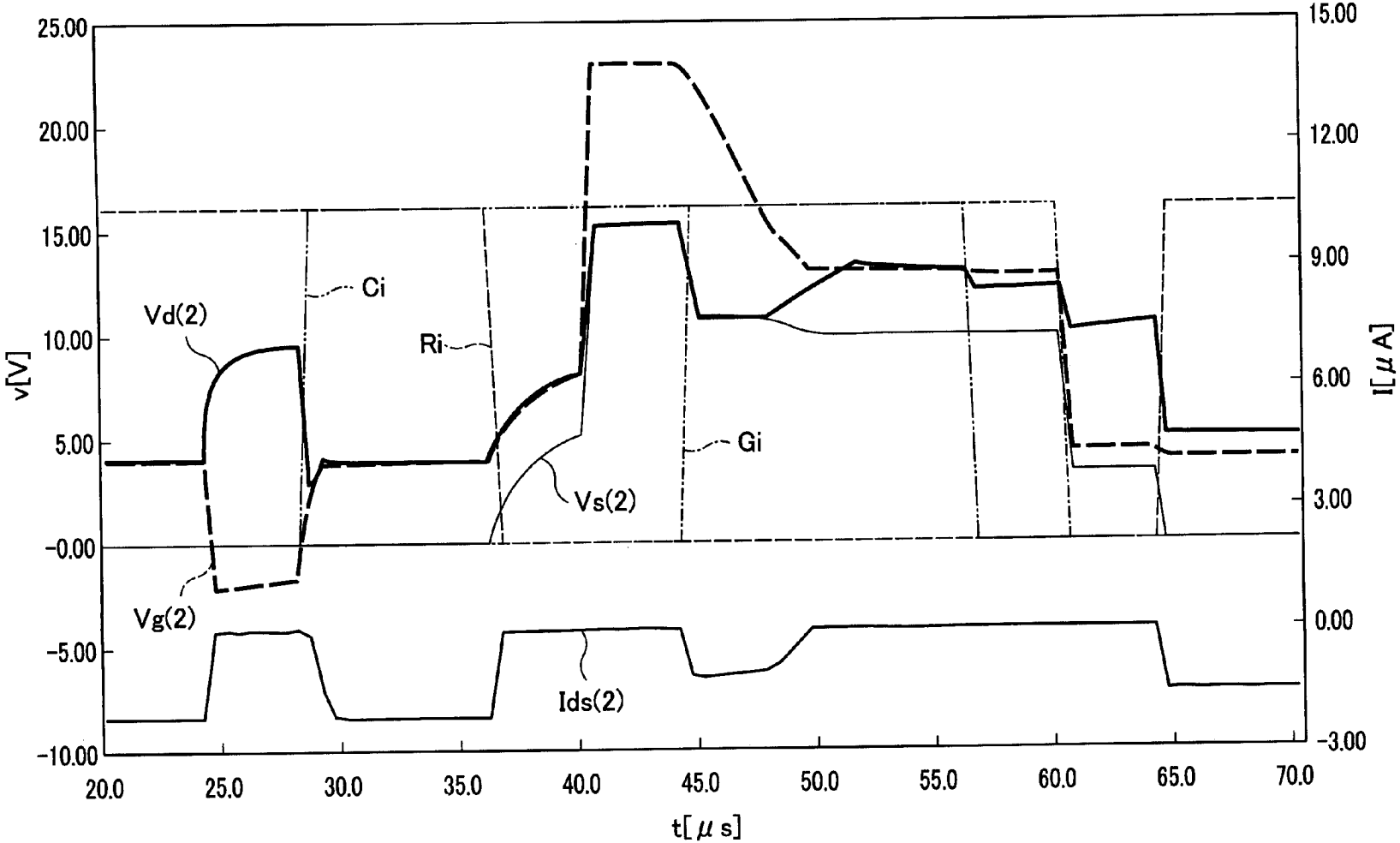
FIG. 35 is another graphical representation of the simulated gate voltage Vg, source voltage Vs, drain voltage Vd, and source-to-drain current Ids of a driver TFT in the FIG. 31 pixel circuit.

At Vda as low as 7 V, the OLED EL4 hardly lit. This is because the simulation specified a high light-on voltage for the OLED. However, even when the light-on voltage of the OLED is low, the OLED EL4 hardly lights with the switching TFT Q19 turned on, if Vcom is properly regulated, FIG. 33 through FIG. 35 show results of the simulation. "(1)" indicates a case where the threshold voltage Vth was a minimum of Vth(min), and the mobility p was a maximum. "(2)" indicates a case where the threshold voltage Vth was a maximum of Vth(max), and the mobility p was a minimum.

The figures show that the threshold of the driver TFT Q16 was adjusted from time 44 to 55 μs, rendering Vg(1)=11.1 V and Vg(2)=13.0 V. Since Vda=10 V, it would be understood that Vth was about 1.1 V in case (1) and about 3.0 V in case (2).

These threshold voltage variations were no more than the mobility variations of the driver TFT Q16. This can be seen from the current Ids through the driver TFT Q16 which was −1.72 μA in case (1) and −1.58 μA in case (2) after time 65 μs when the electric potential line Ui went to Va.

The present invention enables the adjustment of the threshold of the driver TFT Q16 in this manner. Also, when compared to the pixel circuits discussed in the BACKGROUND OF THE INVENTION, the present invention requires a fewer elements to form a per pixel: four TFTs, one capacitor, and one OLED. The invention reduces element counts per pixel, hence pixel size, over the conventional art to accommodate more pixels in a predetermined screen size. The invention allows improvement on image quality.

The TFT in the pixels are all of n-type. A fewer masks are needed, and cost is reduced.

Figure 36:
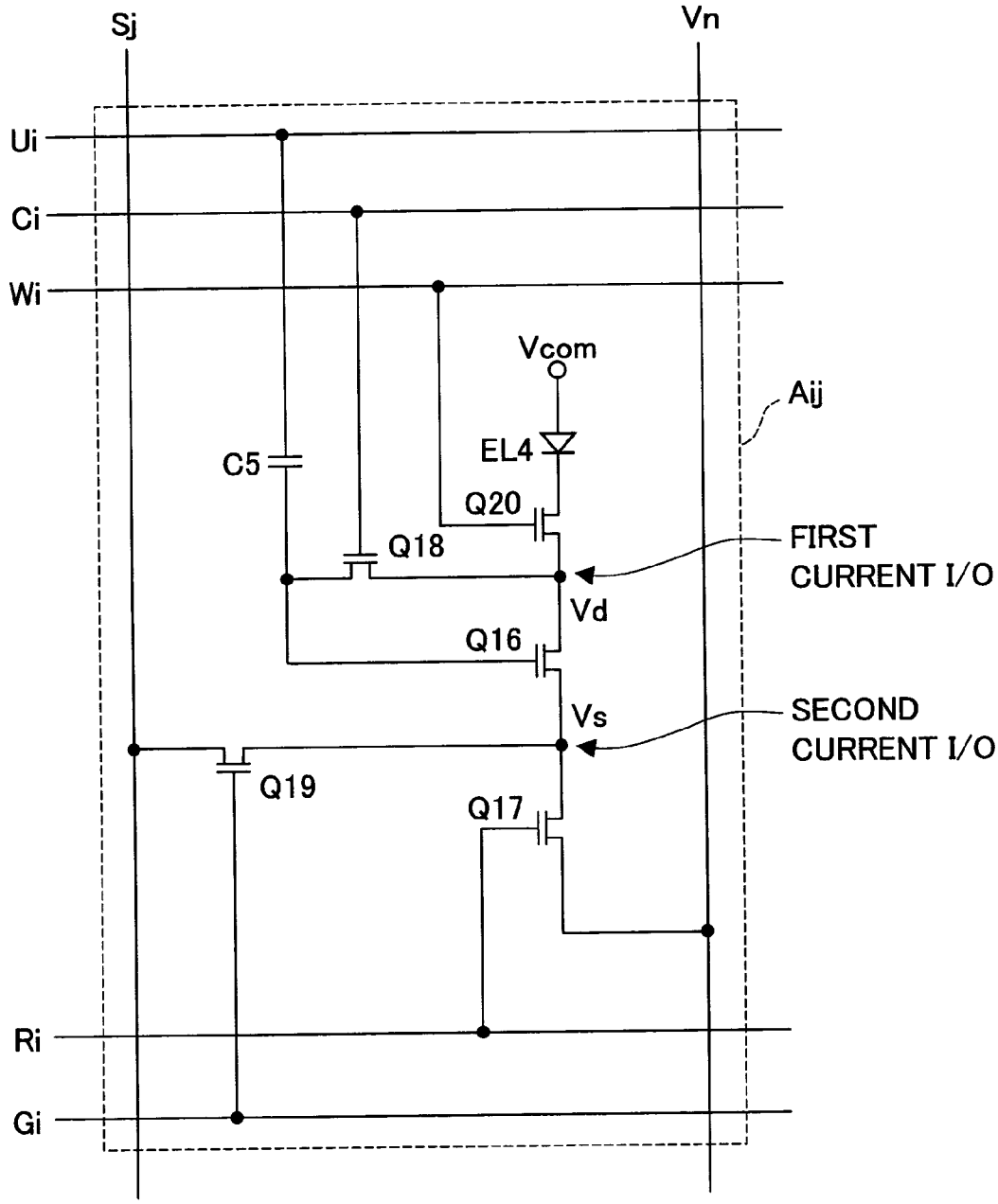
FIG. 36 is a circuit diagram illustrating another pixel circuit structure for embodiment 6.

While the gate line Gi is at GH, the voltage Vda is applied to the cathode of the OLED. But, the anode of the OLED voltage Vcom and the voltage Vda on the source line Sj are specified so that the OLED hardly lights as discussed earlier. If one finds the small current still annoying or wants to specify the voltage Vda on the source line Sj more freely, a fourth switching TFT Q20 will present a satisfactory solution. The fourth switching TFT Q20 is another n-type TFT provided between the drain of the driver TFT Q16 and the cathode of the OLED EL4 as shown in FIG. 36.

Figure 37:
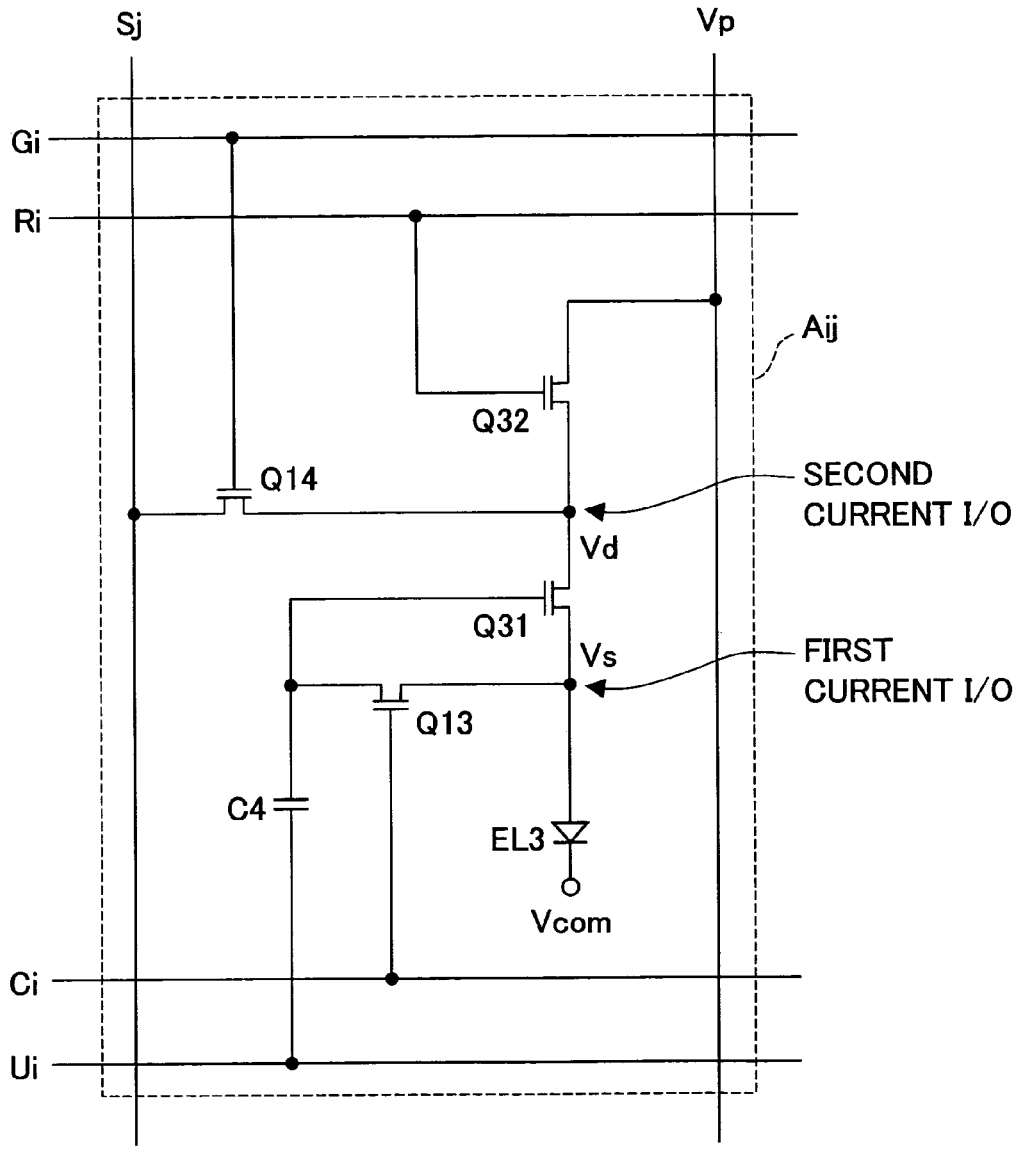
FIG. 37 is a circuit diagram illustrating a further pixel circuit structure for embodiment 6.

To form a pixel from only n-type TFTs, one can replace the driver TFT Q11 and the switching TFT Q12 in the FIG. 22 pixel circuit structure with n-type equivalents. The structure is shown in FIG. 37. In this structure, the current flow through the OLED EL3 is seriously affected by the volt-ampere characteristic of the OLED EL3. The FIG. 37 structure is nevertheless still usable if the characteristic of the OLED EL3 is stable. Drive timings for the structure are the same as in FIG. 32.

Figure 38:
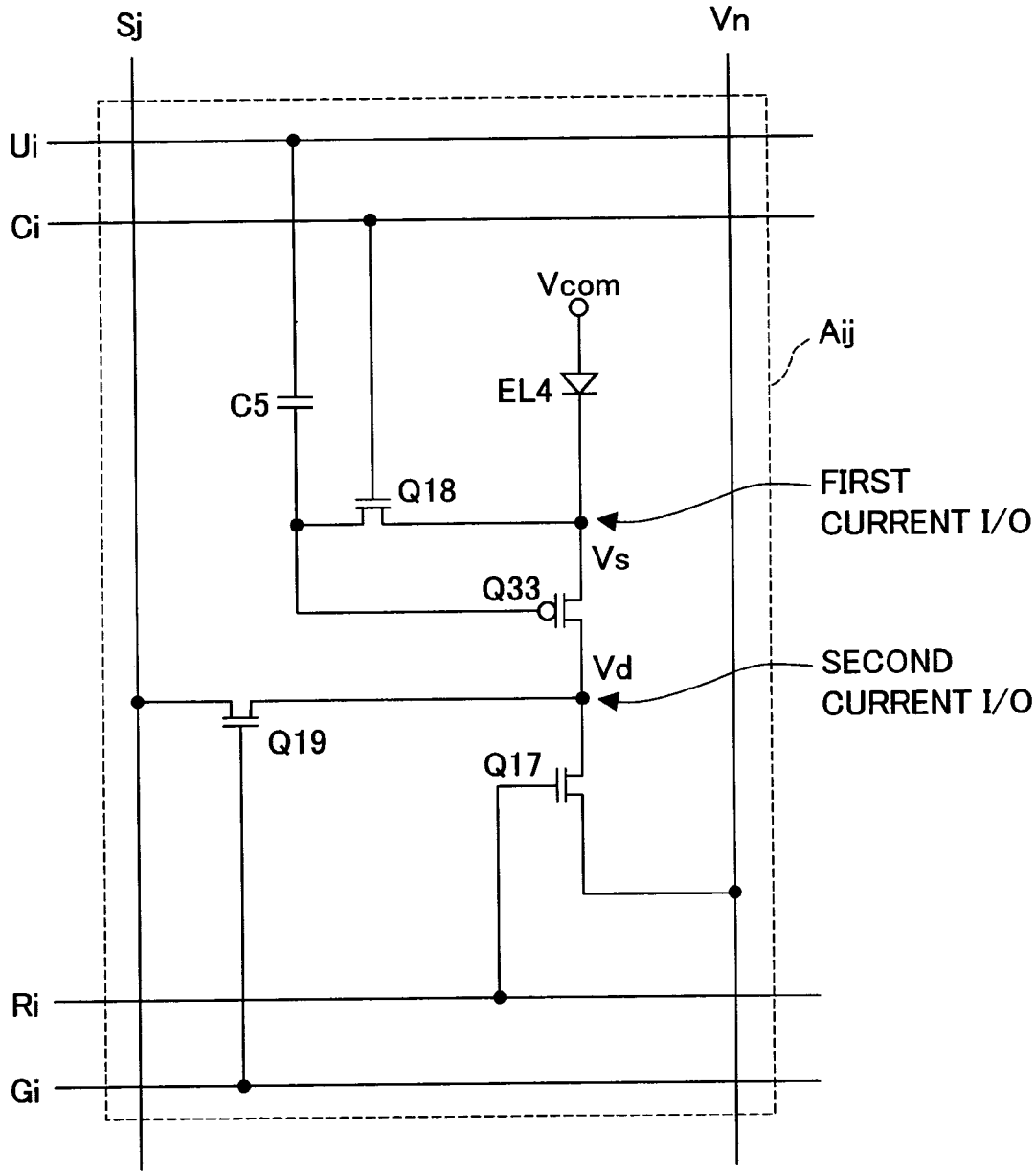
FIG. 38 is a circuit diagram illustrating still another pixel circuit structure for embodiment 6.

Conversely, one can replace the driver TFT Q16 in the FIG. 31 pixel circuit structure with a p-type equivalent. The current flow through the OLED EL4 is then affected by the volt-ampere characteristic of the OLED EL4. The structure is nevertheless still usable if the characteristic of the OLED EL4 is stable. The structure is shown in FIG. 38. Drive timings for the structure are the same as in FIG. 3.

A display device in accordance with the present invention includes electro-optical elements (EL1) arranged in a matrix and may be arranged as follows: Between the electro-optical element (EL1) and a power supply line (Vp) is there provided a driver transistor (Q1) and a first switching transistor (Q2) connected in series. A first capacitor (C2) is provided between the gate of the driver transistor (Q1) and an electric potential line (Ui). A second switching transistor (Q3) is provided between the gate and a first current input/output terminal (source or drain) of the driver transistor (Q1). A third switching transistor (Q4) is provided between the source line (Sj) and a second current input/output terminal (drain or source) of the driver transistor (Q1).

In addition, the display device in accordance with the present invention, in the foregoing structure, may be arranged so that the electro-optical element (EL1) is connected to the second current input/output terminal (source or drain) of the driver transistor (Q1).

In addition, the display device in accordance with the present invention, in the foregoing structure, may be arranged so that the electro-optical element (EL3) is connected to the first current input/output terminal (source or drain) of the driver transistor (Q11).

In addition, the display device in accordance with the present invention, in the foregoing structure, may be arranged so that a common control line (Gi) connects to the gates of the first switching transistor (Q2) and the third switching transistor (Q4).

In addition, the display device in accordance with the present invention, in the foregoing structure, may be arranged so that a fourth switching transistor (Q5) is provided between the driver transistor (Q1) and the electro-optical element (EL1).

In addition, the display device in accordance with the present invention, in the foregoing structure, may be arranged so that all the transistors in the pixel are of a single type, either n type or p type.

A method of driving a display device in accordance with the present invention is for driving a display device and may be arranged as follows: The device has electro-optical elements (EL1) arranged in a matrix. Between the electro-optical element (EL1) and a power supply line (Vp) is there provided a driver transistor (Q1) and a first switching transistor (Q2) connected in series. A first capacitor (C2) is provided between the gate of the driver transistor (Q1) and an electric potential line (Ui).

In a first period, the first current input/output terminal (source or drain) of the driver transistor (Q1) is short circuited to its gate.

In a second period, the second current input/output terminal (drain) of the driver transistor (Q1) is short circuited to the source line (Sj). A voltages Vda is fed to the second current input/output terminal (drain) to change voltage on the electric potential line (Ui) and compensate for the threshold voltage variations of the driver transistor (Q1).

In a third period, the voltage of the electric potential line (Ui) is changed again to allow a desired current to flow to the electro-optical element (EL1).

In addition, the pixel circuit includes four transistors, a capacitor, and an electro-optical element. Building each switch section from one transistor reduces required element counts per pixel. Pixel size is thus reduced, and more pixels can be accommodated in a predetermined screen size. Display quality improves further. The invention allows improvement on image quality.

In addition, the display device in accordance with the present invention, further to the foregoing structure, may be arranged so that the electro-optical element is connected to the second current input/output terminal of the driver transistor. According to the structure, when the third switching transistor is ON, the voltage Vda fed through the source line is applied to the electro-optical element. Therefore, selecting a suitable voltage Vda reduces unnecessary lighting of the electro-optical elements. Dark luminance is lowed. Thus, in addition to the effects brought along by the foregoing structure, contrast increases. Display quality improve further.

In addition, the display device in accordance with the present invention, further to the foregoing structure, may be arranged so that the electro-optical element is connected to the first current input/output terminal of the driver transistor. According to the structure, when the third switching transistor is ON, the voltage fed to the electro-optical element is equal to the voltage Vda on the source line either plus/minus the threshold voltage Vth of the driver transistor. Therefore, selecting a suitable voltages Vda reduces unnecessary lighting of the electro-optical element. Dark luminance is lowed. Thus, in addition to the effects brought along by the foregoing structure, contrast increases. Display quality improves further.

In addition, the display device in accordance with the present invention, further to the foregoing structure, may be arranged so that a common control line connects to the gates of the first switching transistor and the third switching transistor. According to the structure, a control line connects to the gates of the first switching transistor and the third switching transistor, which reduces the line counts per pixel. Pixel size is reduced, and more pixels can be accommodated in a predetermined screen size. In addition to the effects brought along by the foregoing structure, the invention allows improvement on image quality.

In addition, the display device in accordance with the present invention, further to the foregoing structure, may further include a fourth switching transistor between the driver transistor and the electro-optical element. The fourth switching transistor inhibits current flow to the electro-optical element while the third switching transistor is ON. According to the structure, while the third switching transistors is ON, no current flows to the electro-optical element if the voltages Vda fed to the source line is set to any given value. Therefore, unnecessary lighting of the electro-optical element is lessened. Dark luminance is lowered. Therefore, in addition to the effects brought along by the foregoing structure, contrast increases. Display quality improves further.

In addition, the display device in accordance with the present invention, further to the foregoing structure, may be arranged so that all the first to third transistors are of a single type, either n-type or p-type. According to the structure, all the transistors in the pixel are of a single type, either n-type or p-type. Therefore, the mask to make different types of TFTs becomes unnecessary. Therefore, in addition to the effects brought along by the foregoing structure, the mask counts may be reduced. Manufacture cost may be reduced.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display device, comprising:

source lines for feeding voltages Vda representing display data;

first capacitors having first terminals whose voltages switch between at least three values regardless of voltages of other elements and second terminals connected to gates of driver transistors;

electric potential lines connected to the first terminals of the first capacitors;

electro-optical elements located near intersections of the source lines and the electric potential lines to form a matrix;

the driver transistors, having a threshold voltage Vth, connected at sources and drains thereof to the electro-optical elements and power supply lines;

the driver transistors and first switching transistors connected in series between the power supply lines and the electro-optical elements;

second switching transistors connected between the gates and first current input/output terminals which are either the sources or the drains of the driver transistors; and third switching transistors connected between the source lines and second current input/output terminals which are either the drains or the sources of the driver transistors.

2. The display device of claim 1, wherein the electro-optical elements are connected respectively to the second current input/output terminals of the driver transistors.

3. The display device of claim 1, wherein the electro-optical elements are connected respectively to the first current input/output terminals of the driver transistors.

4. The display device of claim 1, wherein gates of the first switching transistors and those of the third switching transistors are connected to common control lines.

5. The display device of claim 1, further comprising fourth switching transistors, provided between the driver transistors and the electro- optical elements, for disabling current flow to the electro-optical elements while the third switching transistors are ON.

6. The display device of claim 1, wherein all the first to third transistors are of a single type, either n type or p type.

7. A method of driving a display device which includes: source lines for feeding voltages Vda representing display data; first capacitors having first terminals whose voltages switch between at least three values regardless of voltages of other elements and second terminals connected to gates of driver transistors; electric potential lines connected to the first terminals of the first capacitors; electro-optical elements located near intersections of the source lines and the electric potential lines to form a matrix; the driver transistors, having a threshold voltage Vth, connected at sources and drains thereof to the electro-optical elements and power supply lines; the driver transistors and first switching transistors connected in series between the power supply lines and the electro-optical elements; second switching transistors connected between the gates and first current input/output terminals which are either the sources or the drains- of the driver transistors; and third switching transistors connected between the source lines and second current input/output terminals which are either the drains or the sources of the driver transistors, a short-circuit state being referred to as ON, a non-short-circuit state being referred to as OFF, ON/OFF between the driver transistors and the power supply lines by the first switching transistors, ON/OFF between the gates and the first current Input/output terminals of the driver transistors by the second switching transistors, and ON/OFF between the source lines and the second current input/output terminals of the driver transistors by the third switching transistors being expressed In a sequential format, (ON/OFF, ON/OFF, ON/OFF), said method comprising the sequential steps of:

in a first period, firstly switching the voltages of the first terminals of the first capacitors to a first predetermined value, achieving (ON, ON, OFF), and after gate voltages of the driver transistors having become equal to voltages on the power supply lines, achieving (OFF, ON, OFF);

in a second period, achieving (OFF, ON, ON) to match voltages of the second current input/output terminals of the driver transistors with the voltages Vda on the source lines, switching the voltages of the first terminals of the first capacitors a second predetermined value to render the driver transistors ON and rendering the gate voltages equal to Vda+Vth via the drains and the sources of the driver transistors to compensate for variations of the threshold voltage of the driver transistors, and when the driver transistors are rendered OFF as a result, achieving (OFF, OFF, OFF); and in a third period, rendering the voltages of the first terminals of the first capacitors equal to a third predetermined value which is between the first and second predetermined values, and achieving (ON, OFF, OFF) to feed the voltages on the power supply lines to the first current input/output terminals of the driver transistors in order to control based on magnitudes of Vda so that desired currents flow from the driver transistors to the electro-optical elements.

* * * * *